US010036221B2

(12) United States Patent
Davies et al.

(10) Patent No.: US 10,036,221 B2
(45) Date of Patent: Jul. 31, 2018

(54) DOWNHOLE TOOL AND METHOD OF USE

(71) Applicant: Downhole Technology, LLC, Houston, TX (US)

(72) Inventors: Evan Lloyd Davies, Houston, TX (US); Duke VanLue, Tomball, TX (US); Luis Miguel Avila, Houston, TX (US)

(73) Assignee: Downhole Technology, LLC, Houston, TX (US)

( * ) Notice: Subject to any disclaimer, the term of this patent is extended or adjusted under 35 U.S.C. 154(b) by 302 days.

(21) Appl. No.: 14/948,240

(22) Filed: Nov. 20, 2015

(65) Prior Publication Data

US 2016/0145957 A1 May 26, 2016

Related U.S. Application Data

(63) Continuation-in-part of application No. 14/723,931, filed on May 28, 2015, now Pat. No. 9,316,086, which is a continuation of application No. 13/592,004, filed on Aug. 22, 2012, now Pat. No. 9,074,439.

(Continued)

(51) Int. Cl.

*E21B 23/01* (2006.01)
*E21B 23/06* (2006.01)

(Continued)

(52) U.S. Cl.

CPC ..... *E21B 23/01* (2013.01); *E21B 23/06* (2013.01); *E21B 33/128* (2013.01);

(Continued)

(58) Field of Classification Search

CPC .... E21B 23/01; E21B 33/124; E21B 33/1292; E21B 34/16; E21B 2034/002

See application file for complete search history.

(56) References Cited

U.S. PATENT DOCUMENTS 2,230,712 A 2/1941 Bendeler et al.
2,797,758 A * 7/1957 Showalter ..... E21B 33/12 166/187

(Continued)

FOREIGN PATENT DOCUMENTS

EP 0504848 9/1992
EP 0890706 1/1993

(Continued)

OTHER PUBLICATIONS

International Preliminary Report on Patentability, PCT/US2012/051938, 6 pages, dated Feb. 25, 2014.

(Continued)

*Primary Examiner* — Daniel P Stephenson

(74) *Attorney, Agent, or Firm* — Rao DeBoer Osterrieder, PLLC; John M. DeBoer

(57) ABSTRACT

A downhole tool having a mandrel made of composite material, a fingered member disposed around the mandrel, and a first conical member also disposed around the mandrel. There is an insert positioned proximate to the fingered member and the first conical member, and in engagement with an end of the fingered member. The insert has a circular body, a first end, a second end, and a helical winding groove formed in the circular body between the first end and the second end.

20 Claims, 32 Drawing Sheets

Related U.S. Application Data

(60) Provisional application No. 62/218,434, filed on Sep. 14, 2015, provisional application No. 61/526,217, filed on Aug. 22, 2011, provisional application No. 61/558,207, filed on Nov. 10, 2011.

(51) Int. Cl.
*E21B 33/128* (2006.01)
*E21B 33/129* (2006.01)
*E21B 33/12* (2006.01)

(52) U.S. Cl.
CPC ..... *E21B 33/129* (2013.01); *E21B 33/1216* (2013.01); *E21B 33/1291* (2013.01)

(56) References Cited

U.S. PATENT DOCUMENTS 3,343,607 A 9/1967 Current
3,422,898 A 1/1969 Conrad
3,687,196 A 8/1972 Mullins
3,769,127 A 10/1973 Goldsworthy et al.
3,776,561 A 12/1973 Haney
4,359,090 A 11/1982 Luke
4,388,971 A 6/1983 Peterson
4,436,150 A 3/1984 Barker
4,437,516 A 3/1984 Cockrell
4,440,223 A 4/1984 Akkerman
4,469,172 A 9/1984 Clark
4,708,202 A * 11/1987 Sukup ..... E21B 33/1204 166/122
4,711,300 A 12/1987 Wardlaw et al.
4,784,226 A 11/1988 Wyatt
5,025,858 A 6/1991 Glaser
5,048,606 A 9/1991 Allwin
5,113,940 A 5/1992 Glaser
5,147,857 A 9/1992 Raddatz et al.
5,224,540 A 7/1993 Streich et al.
5,246,069 A 9/1993 Glaser et al.
5,253,714 A 10/1993 Davis et al.
5,333,685 A 8/1994 Gilbert
5,376,200 A 12/1994 Hall
5,449,040 A 9/1995 Milner
5,484,040 A 1/1996 Penisson
5,819,846 A 10/1998 Bolt et al.
5,839,515 A 11/1998 Yuan et al.
5,842,517 A 12/1998 Coone
5,927,403 A 7/1999 Dallas
5,967,352 A 10/1999 Repp
5,984,007 A 11/1999 Yuan
6,167,963 B1 1/2001 McMahan et al.
6,241,018 B1 6/2001 Eriksen
6,353,771 B1 3/2002 Southland
6,354,372 B1 3/2002 Carisella et al.
6,425,442 B1 7/2002 Latiolais et al.
6,491,116 B2 12/2002 Berscheidt et al.
6,578,638 B2 6/2003 Guillory
6,708,768 B2 3/2004 Slup et al.
6,712,153 B2 3/2004 Turley et al.
6,899,181 B2 5/2005 Simpson et al.
7,044,230 B2 5/2006 Starr et al.
7,087,109 B2 8/2006 Bredt et al.
7,093,664 B2 8/2006 Todd et al.
7,255,178 B2 8/2007 Slup et al.
7,350,569 B2 4/2008 Collins et al.
7,350,582 B2 4/2008 McKeachnie et al.
7,373,973 B2 * 5/2008 Smith ..... E21B 33/1216 166/134
7,475,736 B2 1/2009 Lehr et al.
7,735,549 B1 6/2010 Nish et al.
7,740,079 B2 6/2010 Clayton et al.
7,762,323 B2 * 7/2010 Frazier ..... E21B 33/134 166/126
7,980,300 B2 7/2011 Roberts et al.
8,002,030 B2 8/2011 Turley et al.
8,016,295 B2 * 9/2011 Guest ..... E21B 33/1216 277/584
8,079,413 B2 12/2011 Frazier
8,127,851 B2 3/2012 Misselbrook
8,167,033 B2 5/2012 White
8,205,671 B1 6/2012 Branton
8,211,248 B2 7/2012 Marya
8,231,947 B2 7/2012 Vaidya et al.
8,336,616 B1 12/2012 McClinton
8,381,809 B2 2/2013 White
8,459,346 B2 6/2013 Frazier
8,469,088 B2 6/2013 Shkurti et al.
8,567,492 B2 * 10/2013 White ..... E21B 33/1216 166/134
8,596,347 B2 12/2013 Valencia et al.
8,839,855 B1 2/2014 McClinton et al.
8,770,276 B1 7/2014 Nish et al.
8,770,280 B2 * 7/2014 Buytaert ..... E21B 17/10 166/241.6
8,887,818 B1 11/2014 Carr et al.
2003/0000710 A1 * 1/2003 Turley ..... E21B 33/1208 166/386
2003/0226660 A1 12/2003 Winslow et al.
2004/0003928 A1 * 1/2004 Frazier ..... E21B 33/1204 166/387
2004/0045723 A1 3/2004 Slup et al.
2005/0183864 A1 * 8/2005 Trinder ..... E21B 17/1078 166/382
2006/0243455 A1 * 11/2006 Telfer ..... E21B 21/103 166/386
2007/0039742 A1 2/2007 Costa
2008/0128133 A1 6/2008 Turley et al.
2008/0196879 A1 8/2008 Broome et al.
2008/0264627 A1 10/2008 Roberts et al.
2009/0038790 A1 2/2009 Barlow
2009/0090516 A1 * 4/2009 DeLucia ..... E21B 33/13 166/382
2009/0229424 A1 9/2009 Montgomery
2009/0236091 A1 9/2009 Hammami et al.
2010/0155050 A1 6/2010 Frazier
2010/0263876 A1 10/2010 Frazier
2011/0024134 A1 2/2011 Buckner
2011/0048740 A1 3/2011 Ward et al.
2011/0048743 A1 3/2011 Stafford et al.
2011/0088891 A1 4/2011 Stout
2011/0094802 A1 4/2011 Vatne
2011/0232899 A1 9/2011 Porter
2011/0259610 A1 10/2011 Shkurti et al.
2011/0290473 A1 12/2011 Frazier
2012/0061105 A1 * 3/2012 Neer ..... E21B 33/1216 166/387
2012/0125642 A1 5/2012 Chenault et al.
2012/0181032 A1 7/2012 Naedler et al.
2012/0234538 A1 9/2012 Martin et al.
2012/0279700 A1 11/2012 Frazier
2013/0048313 A1 * 2/2013 VanLue ..... E21B 33/128 166/387
2013/0098600 A1 4/2013 Roberts
2013/0306331 A1 11/2013 Bishop et al.
2014/0020911 A1 * 1/2014 Martinez ..... E21B 23/01 166/387
2014/0120346 A1 5/2014 Rochen
2014/0224476 A1 8/2014 Frazier
2014/0374163 A1 12/2014 Rui et al.
2015/0013996 A1 * 1/2015 Davies ..... E21B 33/134 166/382
2015/0144348 A1 5/2015 Okura et al.
2015/0354313 A1 12/2015 McClinton et al.
2016/0123104 A1 5/2016 Harris
2016/0145957 A1 * 5/2016 Davies ..... E21B 23/01 166/382
2016/0305215 A1 10/2016 Harris et al.

FOREIGN PATENT DOCUMENTS

EP 1643602 4/2006
WO 2007014339 2/2007
WO WO-2007014339 A2 * 2/2007 ..... E21B 43/103

(56) References Cited

FOREIGN PATENT DOCUMENTS

| | | | |
|---|---|---|---|
| WO | 2008100644 | 8/2008 | |
| WO | WO-2008100644 A1 * | 8/2008 | ..... E21B 43/08 |
| WO | 20091128853 | 9/2009 | |
| WO | 2011097091 | 8/2011 | |

OTHER PUBLICATIONS

International Search Report, PCT/US2012/051938, 3 pages, dated Jan. 3, 2013.
International Preliminary Report on Patentability, PCT/US2012/051940, 6 pages, dated Feb. 25, 2014.
Written Opinion dated Jan. 3, 2013 for Intl App No. PCT/US2012/051938 (5 pages).
Search Report and Written Opinion dated Feb. 21, 2013 for Intl App No. PCT/US2012/051936 (9 pages).
Search Report and Written Opinion dated Feb. 27, 2013 for Intl App No. PCT/US2012/051940 (10 pages).
Search Report dated Mar. 11, 2013 for Intl App No. PCT/US2012/051934 (3 pages).
Lehr et al., "Best Practices for Multizone Isolation Using Composite Plugs," Society of Petroleum Engineers, SPE 142744 ConocoPhillips and Baker Hughes Conference Paper, dated Jun. 8, 2011 (40 pgs.).
International Preliminary Report on Patentability, PCT/US2012/051934, 6 pages, dated Feb. 25, 2014.
International Preliminary Report on Patentability, PCT/US2012/051936, 5 pages, dated Feb. 25, 2014.
Search Report dated Feb. 27, 2013 for Intl App No. PCT/US2012/051940 (3 pages).
Search Report dated Feb. 21, 2013 for Intl App No. PCT/US2012/051936 (3 pages).
Search Report and Written Opinion dated Mar. 11, 2013 for Intl App No. PCT/US2012/051934 (10 pages).

* cited by examiner

PRIOR ART

202

DOWNHOLE TOOL AND METHOD OF USE

CROSS-REFERENCE TO RELATED APPLICATIONS

This application claims the benefit under 35 U.S.C. § 119(e) of U.S. Provisional Patent Application Ser. No. 62/218,434, filed on Sep. 14, 2015. This application is a continuation-in-part of U.S. Non-Provisional patent application Ser. No. 14/723,931, filed May 28, 2015, which is a continuation of U.S. Non-Provisional patent application Ser. No. 13/592,004, now U.S. Pat. No. 9,074,439, filed Aug. 22, 2012, which claims the benefit under 35 U.S.C. § 119(e) of U.S. Provisional Patent Application Ser. No. 61/526,217, filed on Aug. 22, 2011, and U.S. Provisional Patent Application Ser. No. 61/558,207, filed on Nov. 10, 2011. The disclosure of each application is hereby incorporated herein by reference in its entirety for all purposes.

STATEMENT REGARDING FEDERALLY SPONSORED RESEARCH OR DEVELOPMENT

Not applicable.

BACKGROUND

Field of the Disclosure

This disclosure generally relates to tools used in oil and gas wellbores. More specifically, the disclosure relates to downhole tools that may be run into a wellbore and useable for wellbore isolation, and systems and methods pertaining to the same. In particular embodiments, the tool may be a composite plug made of drillable materials.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs is typically has low permeability, and it is uneconomical to produce the hydrocarbons (i.e., gas, oil, etc.) in commercial quantities from this formation without the use of drilling accompanied with fracing operations.

Fracing is common in the industry and growing in popularity and general acceptance, and includes the use of a plug set in the wellbore below or beyond the respective target zone, followed by pumping or injecting high pressure frac fluid into the zone. The frac operation results in fractures or "cracks" in the formation that allow hydrocarbons to be more readily extracted and produced by an operator, and may be repeated as desired or necessary until all target zones are fractured.

A frac plug serves the purpose of isolating the target zone for the frac operation. Such a tool is usually constructed of durable metals, with a sealing element being a compressible material that may also expand radially outward to engage the tubular and seal off a section of the wellbore and thus allow an operator to control the passage or flow of fluids. For example, by forming a pressure seal in the wellbore and/or with the tubular, the frac plug allows pressurized fluids or solids to treat the target zone or isolated portion of the formation.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 105 (e.g., e-line, wireline, coiled tubing, etc.) and/or with setting tool 112, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

Upon proper setting, the plug may be subjected to high or extreme pressure and temperature conditions, which means the plug must be capable of withstanding these conditions without destruction of the plug or the seal formed by the seal element. High temperatures are generally defined as downhole temperatures above 200° F., and high pressures are generally defined as downhole pressures above 7,500 psi, and even in excess of 15,000 psi. Extreme wellbore conditions may also include high and low pH environments. In these conditions, conventional tools, including those with compressible seal elements, may become ineffective from degradation. For example, the sealing element may melt, solidify, or otherwise lose elasticity, resulting in a loss the ability to form a seal barrier.

Before production operations commence, the plugs must also be removed so that installation of production tubing may occur. This typically occurs by drilling through the set plug, but in some instances the plug can be removed from the wellbore essentially intact. A common problem with retrievable plugs is the accumulation of debris on the top of the plug, which may make it difficult or impossible to engage and remove the plug. Such debris accumulation may also adversely affect the relative movement of various parts within the plug. Furthermore, with current retrieving tools, jarring motions or friction against the well casing may cause accidental unlatching of the retrieving tool (resulting in the tools slipping further into the wellbore), or re-locking of the plug (due to activation of the plug anchor elements). Problems such as these often make it necessary to drill out a plug that was intended to be retrievable.

However, because plugs are required to withstand extreme downhole conditions, they are built for durability and toughness, which often makes the drill-through process difficult. Even drillable plugs are typically constructed of a metal such as cast iron that may be drilled out with a drill bit at the end of a drill string. Steel may also be used in the structural body of the plug to provide structural strength to set the tool. The more metal parts used in the tool, the longer the drilling operation takes. Because metallic components are harder to drill through, this process may require additional trips into and out of the wellbore to replace worn out drill bits.

The use of plugs in a wellbore is not without other problems, as these tools are subject to known failure modes. When the plug is run into position, the slips have a tendency to pre-set before the plug reaches its destination, resulting in damage to the casing and operational delays. Pre-set may result, for example, because of residue or debris (e.g., sand) left from a previous frac. In addition, conventional plugs are known to provide poor sealing, not only with the casing, but also between the plug's components. For example, when the sealing element is placed under compression, its surfaces do not always seal properly with surrounding components (e.g., cones, etc.).

Downhole tools are often activated with a drop ball that is flowed from the surface down to the tool, whereby the pressure of the fluid must be enough to overcome the static pressure and buoyant forces of the wellbore fluid(s) in order for the ball to reach the tool. Frac fluid is also highly pressurized in order to not only transport the fluid into and through the wellbore, but also extend into the formation in order to cause fracture. Accordingly, a downhole tool must be able to withstand these additional higher pressures.

Additional shortcomings pertain to a downhole tool's ability to properly seal in the presence of an overly large annulus between the casing and the tool. Referring briefly to FIGS. 1A and 1B together, a side view of a conventional downhole tool prior to setting and a close-up partial side view of the downhole tool in a set position with a sealed annulus are shown. As illustrated, workstring 112 is used to move tool 102 to its desired downhole position. Typically the tool 102 will have a tool OD that, in combination with an ID of the casing 108, will leave a minimal annulus 190, typically in the range of about ¼".

During the setting sequence compression of tool components occurs (e.g., cones 128, 136), which results in subsequent compression (via setting forces, Fs), and lateral or radial expansion, of the sealing element 122 away from the tool body and into the annulus 190. As shown in FIG. 1B, the sealing element 122 adequately expands into the tool annulus 190, and ultimately into sealing contact with the surface 107 of the casing 108, forming a seal 125. Because the sealing element 122 need only extrude a minimal amount, adequate amount of sealing element material remains supported by the tool 102. The seal 125 is normally strong enough to withstand 10,000 psi without any problems.

However, this is not the case when the annulus 190 exceeds a typical minimal size, such as when the annulus is in the range of ½" to about 1" (or conceivably greater). This occurs, for example, when the size of the casing ID increases. Intuitively, the solution would be to increase the tool OD in a comparable manner so that the delta in the tool annulus is negligible or nil; however, this is not possible in situations where the casing has a narrowing or restriction of some kind.

Although there are a number of reasons as to why narrowing of casing 108 may occur, often the narrowing occurs when a "patch" or bandaid has been utilized to repair (or otherwise circumvent) damage, such as a cut or a crack, in the casing. Referring briefly to FIGS. 1C and 1D together, a simplified side diagram view of a downhole tool prior to and after passing through a narrowing in a casing, respectively, are shown. As illustrated in FIG. 1C, downhole tool 102 is moving downhole through casing 108 to its desired position, but must pass through narrowing 145. As a result of narrowing 145, the casing 108 includes a first portion 147 of the casing having a first diameter 187 equivalent to that of a second portion 149 of casing. But as a result of narrowing 145, downhole tool 102 must have a tool OD 141 small enough (including with standard clearance) in order to pass through the narrowing 145. Once the tool 102 reaches its destination within the second portion 149, a large tool annulus 190 is present for which the tool 102 must be able to functionally and structurally seal off so that downhole operations can begin.

FIGS. 1E, 1F, and 1G illustrate the occurrence (sequentially) of a typical failure mode in a conventional downhole tool that needs to seal an oversized tool annulus. Specifically, FIG. 1E shows a close-up side view of the beginning of typical failure mode in a conventional downhole tool that needs to seal an oversized tool annulus; FIG. 1F shows a close-up side view of an intermediate extrusion position of a sealing element during the failure mode of the downhole tool of FIG. 1E; and FIG. 1G a close-up side view of the sealing element being entirely extruded from the downhole tool of FIG. 1E.

As shown in FIG. 1E, upon initiating the setting sequence (including resultant setting forces Fs from conical members 136 and 128), the sealing element 122 will begin to extend laterally (extrude) into the tool annulus 190. However, because the lateral distance between the tool 102 and the surface 107 of the casing is greater, more of the sealing element 122 must be extruded. Because more material must be extruded in order to traverse the distance to the casing, more compression is required, as shown in FIG. 1F.

Eventually, the extrusion distance is so great that the entire sealing element 122 is compressed and extruded in its entirety from the tool 102. In the alternative, in the event the sealing element 122 makes some minimal amount of sealing engagement with the casing, the seal 125 is weak, and a minimum amount of pressure in the annulus (or annulus pressure Fa) 'breaks' the seal and/or 'flows' the sealing element 122 away from the tool 102, as shown in FIG. 1G.

There are needs in the art for novel systems and methods for isolating wellbores in a viable and economical fashion. There is a great need in the art for downhole plugging tools that form a reliable and resilient seal against a surrounding tubular. There is also a need for a downhole tool made substantially of a drillable material that is easier and faster to drill. It is highly desirous for these downhole tools to readily and easily withstand extreme wellbore conditions, and at the same time be cheaper, smaller, lighter, and useable in the presence of high pressures associated with drilling and completion operations.

There is a need in the art for a downhole plugging tool that can properly seal a larger than normal tool annulus. There is further need for a downhole tool that can support the extrusion of a seal element in an oversized tool annulus. This is especially desirous in instances where the tool must be small enough in OD to pass through a narrowing in casing, and into a larger downhole ID.

SUMMARY

Embodiments of the present disclosure pertain to a downhole tool having a mandrel comprising one or more sets of threads; a fingered member disposed around the mandrel; a first conical shaped member also disposed around the mandrel; and an insert positioned between the fingered member and the first conical member, and in proximity with an end of the fingered member. The fingered member may include a plurality of fingers configured for at least partially blocking a tool annulus. The fingered member may include a plurality of fingers, with one or more of the plurality of fingers configured to move from a first position to a second position. The first position may be an initial run-in or pre-set position. The second position may be a set or extended position. The fingered member may incur induced breakage upon the one or more fingers moving from the first position to the second position.

The downhole tool may include a first slip; a second slip; a bearing plate; a second conical member; a sealing element; and a lower sleeve threadingly engaged with the mandrel.

The downhole tool may have one or more components made from a material comprising one or more of filament wound material, fiberglass cloth wound material, and molded fiberglass composite.

The downhole tool may have one or more components made from a dissolvable alloy.

The downhole tool may have a mandrel made from one or more materials comprising composite, aluminum, degradable metals and polymers, degradable composite metal, fresh-water degradable metal, and brine degradable metal.

The downhole tool may have a mandrel made from a material consisting of fresh-water degradable composite metal, polymer, and elastomers.

One or more ends of the plurality of fingers may include an outer tapered surface.

The fingered member may include an outer surface, and an inner surface. A first groove may be disposed within the outer surface. A second groove may be disposed within the inner surface.

Other embodiments of the disclosure pertain to a downhole tool that may have a mandrel comprising one or more sets of threads; a fingered member disposed around the mandrel; and a first conical shaped member also disposed around the mandrel and proximate to an end of the fingered member. The fingered member may include a plurality of fingers configured for at least partially blocking a tool annulus. The fingered member may include a plurality of fingers configured to move from a first position to a second position. The second position of the plurality of fingers may be suitable for limiting or otherwise supporting extrusion of a sealing element.

The downhole tool may include a first slip; a second slip; a bearing plate; a second conical member; a sealing element; and a lower sleeve threadingly engaged with the mandrel.

One or more ends of the plurality of fingers may include an outer tapered surface.

The fingered member may include an outer surface, and an inner surface. There may be a first groove disposed within the outer surface. There may be a second groove disposed within the inner surface.

The downhole tool may have one or more components made from one or more materials comprising composite, aluminum, degradable metals and polymers, degradable composite metal, fresh-water degradable metal, and brine degradable metal.

One or more components of the tool may be made from a material comprising one or more of filament wound material, fiberglass cloth wound material, and molded fiberglass composite.

Yet other embodiments of the disclosure pertain to a method for performing a downhole operation in a tubular that may include the steps of running a downhole tool through a first portion of the tubular; continuing to run the downhole tool until arriving at a position within a second portion of the tubular; and setting the downhole tool within the second portion, wherein the first portion comprises a first inner diameter that is smaller than a second inner diameter of the second portion.

The first inner diameter may be that of a patch positioned within the first portion of the tubular.

The downhole tool of the method may include a mandrel configured with one or more sets of threads; a fingered member disposed around the mandrel; a first conical shaped member also disposed around the mandrel; and an insert positioned between the fingered member and the first conical shaped member. The fingered member may include a plurality of fingers configured to move from an initial position to a set position. The insert may be made of polyether ether ketone.

The downhole tool of the method may include a first slip; a second slip; a bearing plate; a second conical member; a sealing element; and a lower sleeve threadingly engaged with the mandrel.

The fingered member may include an outer surface, and an inner surface. There may be a first groove is disposed or otherwise formed within the outer surface. There may be a second groove disposed or otherwise formed within the inner surface.

One or more components of the downhole tool of the method may be made from a material comprising one or more of filament wound material, fiberglass cloth wound material, and molded fiberglass composite.

The downhole tool may have one or more components made from one or more materials comprising composite, aluminum, degradable metals and polymers, degradable composite metal, fresh-water degradable metal, and brine degradable metal.

One or more components of the tool may be made from a material comprising one or more of filament wound material, fiberglass cloth wound material, and molded fiberglass composite.

The downhole tool of the method may be a tool selected from a group consisting of a frac plug and a bridge plug.

The insert of the downhole tool may include a circular body, a first end, and a second end. There may be a helical groove formed in the circular body between the first end and the second end.

The insert of the downhole tool may include an outer surface and an inner surface. A depth of the helical wound groove may extend between the outer surface and the inner surface.

Yet other embodiments of the disclosure pertain to a fingered member for a downhole tool that may have a circular body; a plurality of fingers extending from the body; and a void formed between respective fingers.

There may be a transition zone between the circular body and the plurality of fingers.

The transition zone may include an inner surface and an outer surface.

The inner surface may include a first inner groove. The outer surface may include a first outer groove.

These and other embodiments, features and advantages will be apparent in the following detailed description and drawings.

BRIEF DESCRIPTION OF THE DRAWINGS

For a more detailed description of the present invention, reference will now be made to the accompanying drawings, wherein.

DETAILED DESCRIPTION

Figure 1:
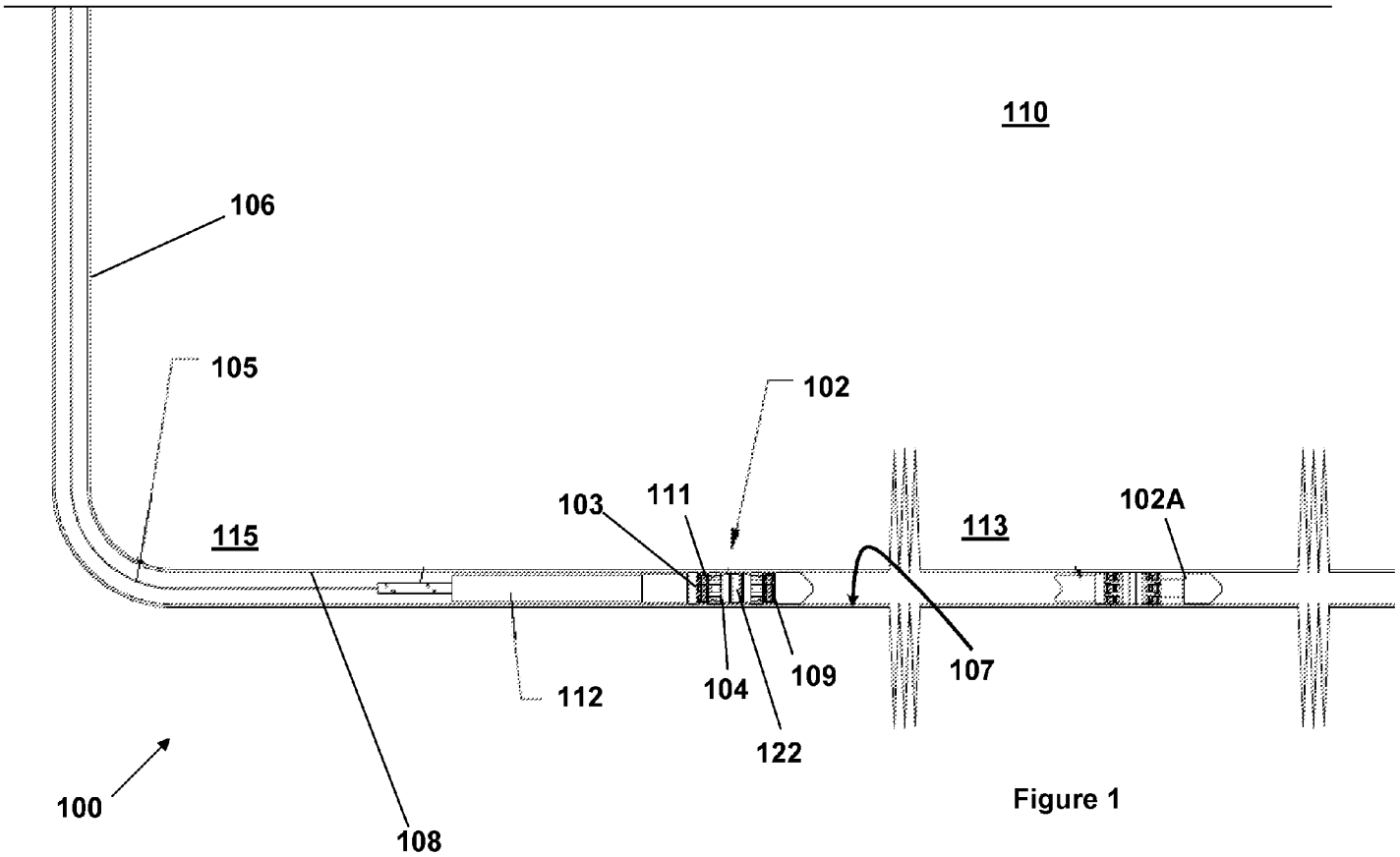
FIG. 1 is a side view of a process diagram of a conventional plugging system.
Figure 1A:
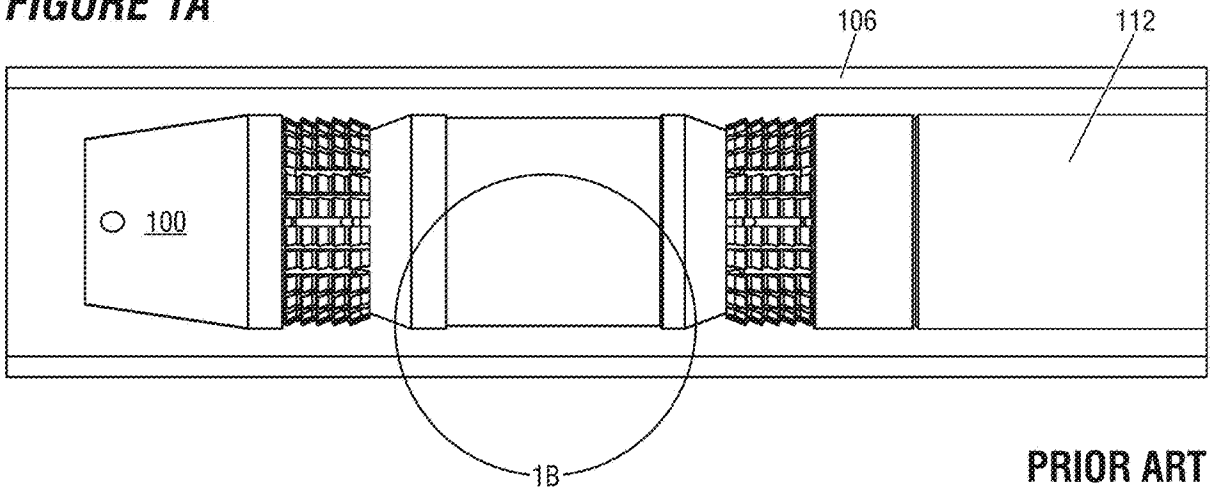
FIGURE 1A PRIOR ART
FIG. 1A shows a side view of a conventional downhole tool prior to setting.
Figure 1B:
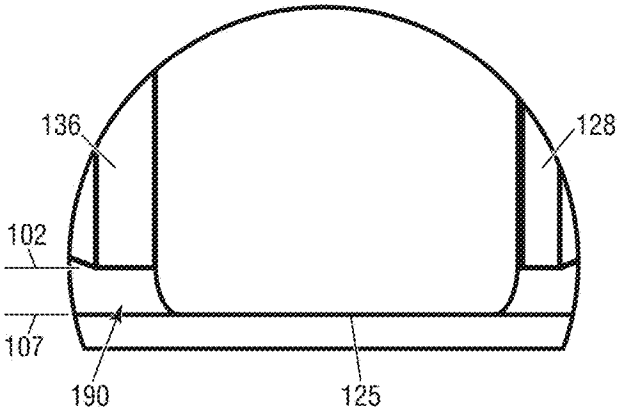
FIGURE 1B PRIOR ART
FIG. 1B shows a close-up partial side view of the downhole tool in a set position with a sealed annulus.
Figure 1C:
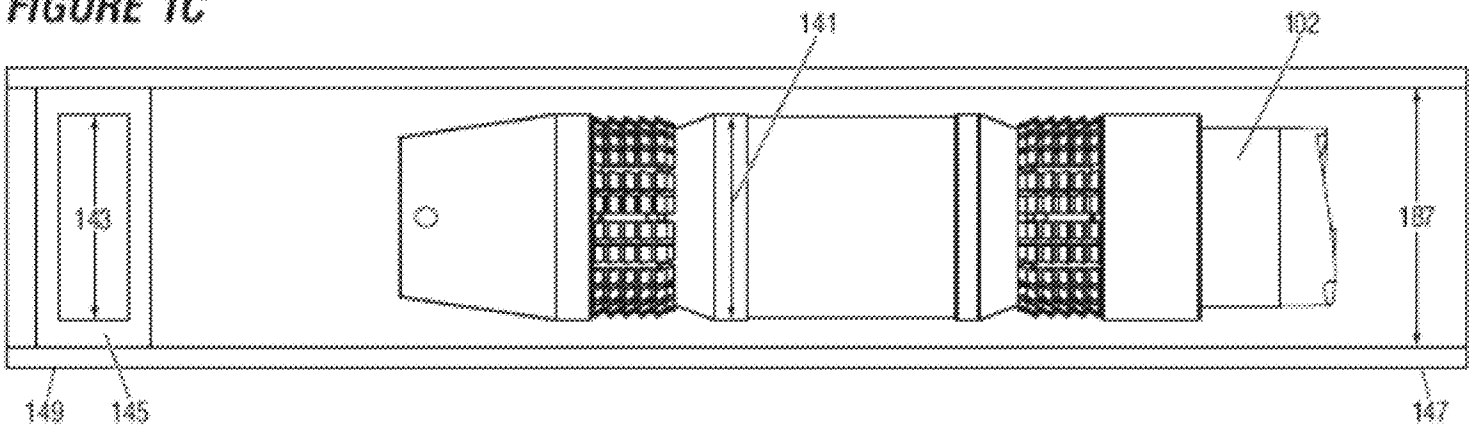
FIGURE 1C PRIOR ART
FIG. 1C shows a simplified side diagram view of a downhole tool prior to passing through a narrowing in a casing.
Figure 1D:
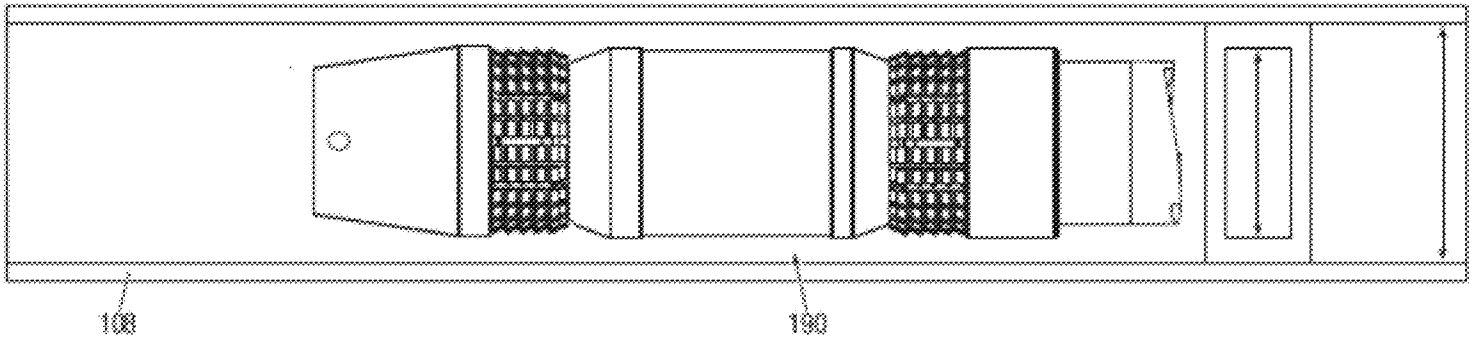
FIGURE 1D PRIOR ART
FIG. 1D shows a simplified side diagram view of the downhole tool of FIG. 1C after passing through the narrowing.
Figure 1E:
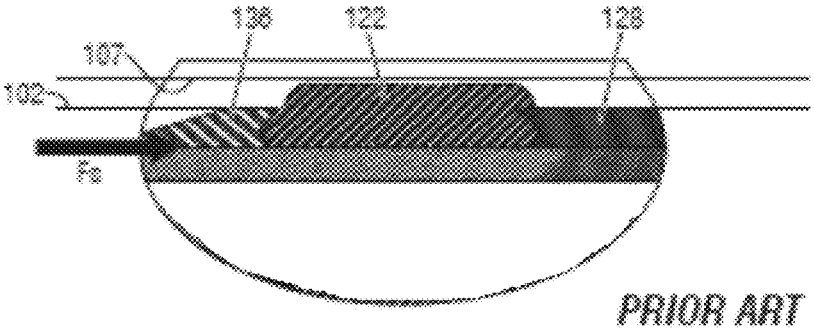
FIG. 1E shows a close-up side view of the beginning of typical failure mode in a conventional downhole tool that needs to seal an oversized tool annulus.
Figure 1F:
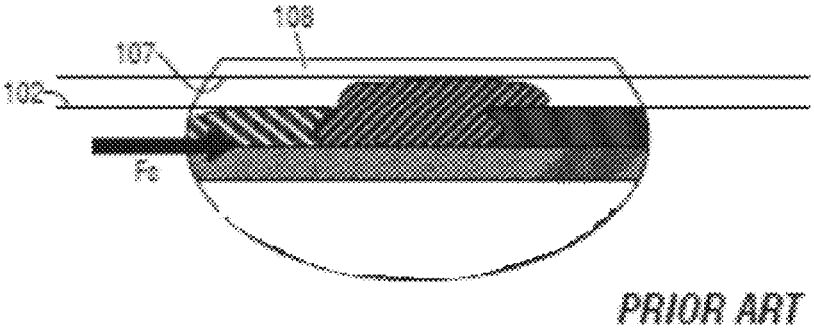
FIG. 1F shows a close-up side view of an intermediate extrusion position of a sealing element during the failure mode of the downhole tool of FIG. 1E.
Figure 1G:
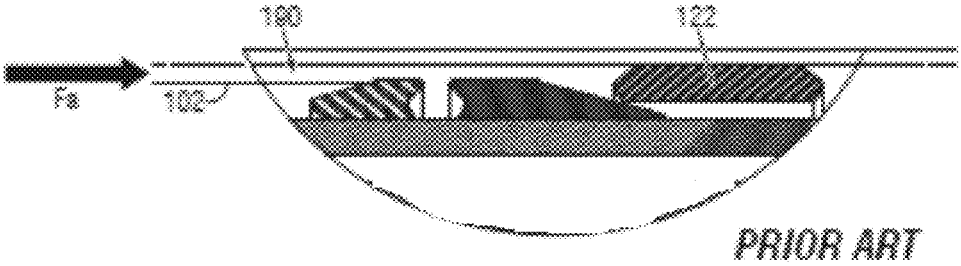
FIG. 1G a close-up side view of the sealing element being entirely extruded from the downhole tool of FIG. 1E.

Herein disclosed are novel apparatuses, systems, and methods that pertain to downhole tools usable for wellbore operations, details of which are described herein.

Downhole tools according to embodiments disclosed herein may include one or more anchor slips, one or more compression cones engageable with the slips, and a compressible seal element disposed therebetween, all of which may be configured or disposed around a mandrel. The mandrel may include a flow bore open to an end of the tool and extending to an opposite end of the tool. In embodiments, the downhole tool may be a frac plug or a bridge plug. Thus, the downhole tool may be suitable for frac operations. In an exemplary embodiment, the downhole tool may be a composite frac plug made of drillable material, the plug being suitable for use in vertical or horizontal wellbores.

A downhole tool useable for isolating sections of a wellbore may include the mandrel having a first set of threads and a second set of threads. The tool may include a composite member disposed about the mandrel and in engagement with the seal element also disposed about the mandrel. In accordance with the disclosure, the composite member may be partially deformable. For example, upon application of a load, a portion of the composite member, such as a resilient portion, may withstand the load and maintain its original shape and configuration with little to no deflection or deformation. At the same time, the load may result in another portion, such as a deformable portion, that experiences a deflection or deformation, to a point that the deformable portion changes shape from its original configuration and/or position.

Accordingly, the composite member may have first and second portion, or comparably an upper portion and a lower portion. It is noted that first, second, upper, lower, etc. are for illustrative and/or explanative aspects only, such that the composite member is not limited to any particular orientation. In embodiments, the upper (or deformable) portion and the lower (or resilient) portion may be made of a first material. The resilient portion may include an angled surface, and the deformable portion may include at least one groove. A second material may be bonded or molded to (or with) the composite member. In an embodiment, the second material may be bonded to the deformable portion, and at least partially fill into the at least one groove.

The deformable portion may include an outer surface, an inner surface, a top edge, and a bottom edge. The depth (width) of the at least one groove may extend from the outer surface to the inner surface. In some embodiments, the at least one groove may be formed in a spiral or helical pattern along or in the deformable portion from about the bottom edge to about the top edge. The groove pattern is not meant to be limited to any particular orientation, such that any groove may have variable pitch and vary radially.

In embodiments, the at least one groove may be cut at a back angle in the range of about 60 degrees to about 120 degrees with respect to a tool (or tool component) axis. There may be a plurality of grooves formed within the composite member. In an embodiment, there may be about two to three similarly spiral formed grooves in the composite member. In other embodiments, the grooves may have substantially equidistant spacing therebetween. In yet other embodiments, the back angle may be about 75 degrees (e.g., tilted downward and outward).

The downhole tool may include a first slip disposed about the mandrel and configured for engagement with the composite member. In an embodiment, the first slip may engage the angled surface of the resilient portion of the composite member. The downhole tool may further include a cone piece disposed about the mandrel. The cone piece may include a first end and a second end, wherein the first end may be configured for engagement with the seal element. The downhole tool may also include a second slip, which may be configured for contact with the cone. In an embodiment, the second slip may be moved into engagement or compression with the second end of the cone during setting. In another embodiment, the second slip may have a one-piece configuration with at least one groove or undulation disposed therein.

In accordance with embodiments of the disclosure, setting of the downhole tool in the wellbore may include the first slip and the second slip in gripping engagement with a surrounding tubular, the seal element sealingly engaged with the surrounding tubular, and/or application of a load to the mandrel sufficient enough to shear one of the sets of the threads.

Any of the slips may be composite material or metal (e.g., cast iron). Any of the slips may include gripping elements, such as inserts, buttons, teeth, serrations, etc., configured to provide gripping engagement of the tool with a surrounding surface, such as the tubular. In an embodiment, the second slip may include a plurality of inserts disposed therearound. In some aspects, any of the inserts may be configured with a flat surface, while in other aspects any of the inserts may be configured with a concave surface (with respect to facing toward the wellbore).

The downhole tool (or tool components) may include a longitudinal axis, including a central long axis. During setting of the downhole tool, the deformable portion of the composite member may expand or "flower", such as in a radial direction away from the axis. Setting may further result in the composite member and the seal element compressing together to form a reinforced seal or barrier therebetween. In embodiments, upon compressing the seal element, the seal element may partially collapse or buckle around an inner circumferential channel or groove disposed therein.

The mandrel may have a distal end and a proximate end. There may be a bore formed therebetween. In an embodiment, one of the sets of threads on the mandrel may be shear threads. In other embodiments, one of the sets of threads may be shear threads disposed along a surface of the bore at the proximate end. In yet other embodiments, one of the sets of threads may be rounded threads. For example, one of the sets of threads may be rounded threads that are disposed along an external mandrel surface, such as at the distal end. The round threads may be used for assembly and setting load retention.

The mandrel may be coupled with a setting adapter configured with corresponding threads that mate with the first set of threads. In an embodiment, the adapter may be configured for fluid to flow therethrough. The mandrel may also be coupled with a sleeve configured with corresponding threads that mate with threads on the end of the mandrel. In an embodiment, the sleeve may mate with the second set of threads. In other embodiments, setting of the tool may result in distribution of load forces along the second set of threads at an angle that is directed away from an axis.

Although not limited, the downhole tool or any components thereof may be made of a composite material. In an embodiment, the mandrel, the cone, and the first material each consist of filament wound drillable material.

In embodiments, an e-line or wireline mechanism may be used in conjunction with deploying and/or setting the tool. There may be a pre-determined pressure setting, where upon excess pressure produces a tensile load on the mandrel that results in a corresponding compressive force indirectly between the mandrel and a setting sleeve. The use of the stationary setting sleeve may result in one or more slips being moved into contact or secure grip with the surrounding tubular, such as a casing string, and also a compression (and/or inward collapse) of the seal element. The axial compression of the seal element may be (but not necessarily) essentially simultaneous to its radial expansion outward and into sealing engagement with the surrounding tubular. To disengage the tool from the setting mechanism (or wireline adapter), sufficient tensile force may be applied to the mandrel to cause mated threads therewith to shear.

When the tool is drilled out, the lower sleeve engaged with the mandrel (secured in position by an anchor pin, shear pin, etc.) may aid in prevention of tool spinning. As drill-through of the tool proceeds, the pin may be destroyed or fall, and the lower sleeve may release from the mandrel and may fall further into the wellbore and/or into engagement with another downhole tool, aiding in lockdown with the subsequent tool during its drill-through. Drill-through may continue until the downhole tool is removed from engagement with the surrounding tubular.

The downhole tool may have a mandrel of embodiments disclosed herein, and a fingered member disposed around the mandrel. There may be a first conical shaped member also disposed around the mandrel. There may be an insert positioned between the fingered member and the first conical member. The insert may be in proximity with an end of the fingered member. The fingered member may include a plurality of fingers configured for at least partially blocking a tool annulus. One or more of plurality of fingers may be configured to move from a respective first position to a respective second position. Movement of one or more of the fingers may be the result of setting force induced or otherwise applied to the tool. Upon one or more of the plurality of fingers moving to the second position, the fingered member may provide backup support to, or otherwise limit extrusion (or expansion) of, a sealing element.

The downhole tool may include a first slip; a second slip; a bearing plate; a second conical member; a sealing element; and a lower sleeve threadingly engaged with the mandrel. One or more of these or other components of the downhole tool may be made from a material comprising one or more of filament wound material, fiberglass cloth wound material, and molded fiberglass composite. One or more of these or other components may be made of a dissolvable or degradable metal.

One or more ends of the plurality of fingers may include an outer tapered surface. The fingered member may include an outer surface, and an inner surface. There may be a first groove disposed within the outer surface. There may be a second groove disposed within the inner surface.

Figure 2A:
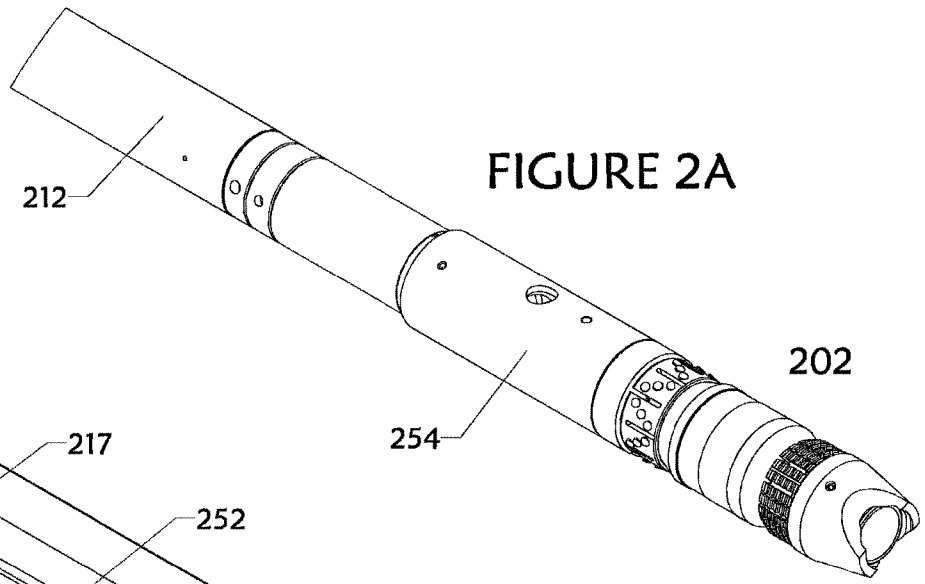
FIG. 2A shows an isometric view of a system having a downhole tool, according to embodiments of the disclosure.
Figure 2B:
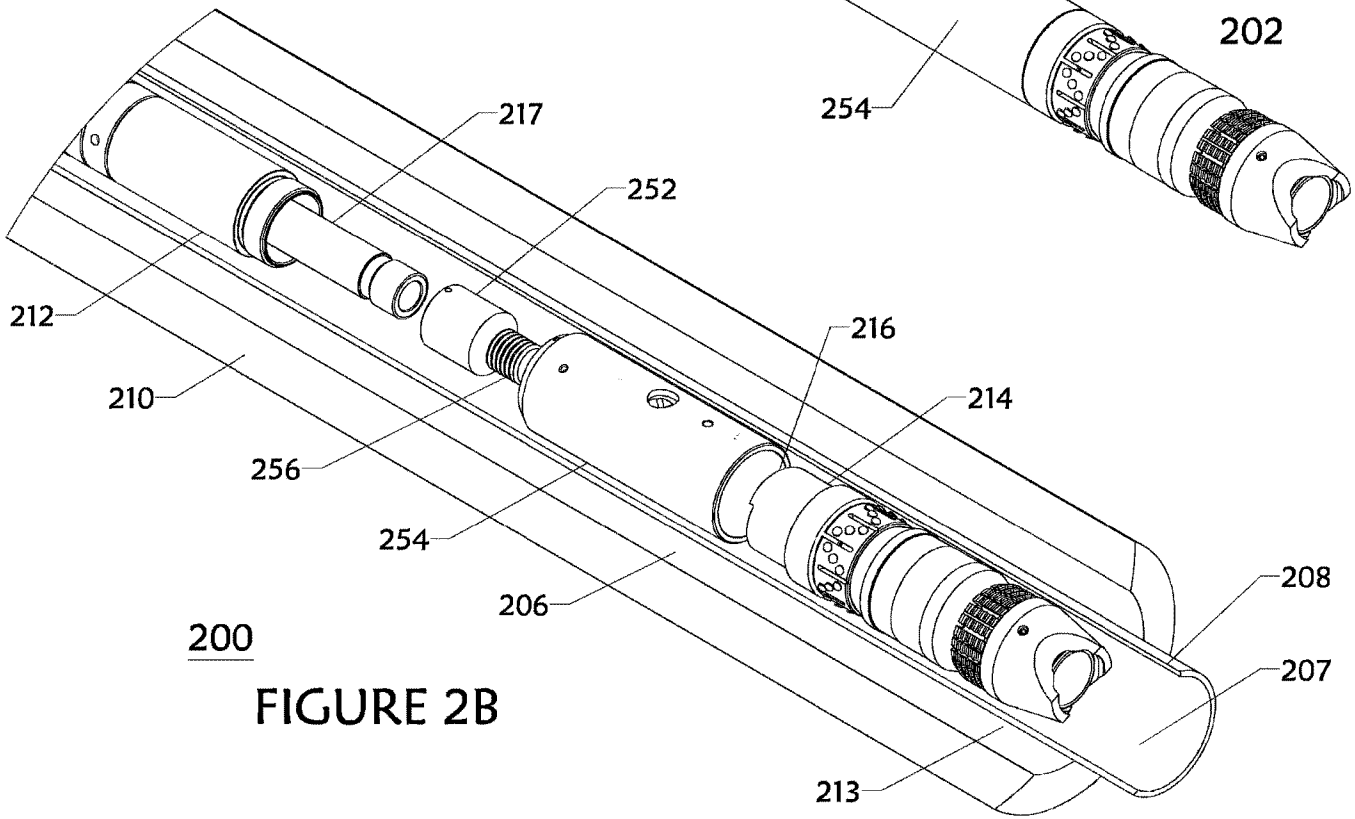
FIG. 2B shows an isometric view of the downhole tool of FIG. 2A positioned within a tubular, according to embodiments of the disclosure.

Referring now to FIGS. 2A and 2B together, isometric views of a system 200 having a downhole tool 202 illustrative of embodiments disclosed herein, are shown. FIG. 2A shows an isometric view of the system with the downhole tool in general, while FIG. 2B shows an isometric view of the downhole tool of FIG. 2A positioned within a tubular, according to embodiments of the disclosure.

FIG. 2B depicts a wellbore 206 formed in a subterranean formation 210 with a tubular 208 disposed therein. In an embodiment, the tubular 208 may be casing (e.g., casing, hung casing, casing string, etc.) (which may be cemented). A workstring 212 (which may include a part 217 of a setting tool coupled with adapter 252) may be used to position or run the downhole tool 202 into and through the wellbore 206 to a desired location.

In accordance with embodiments of the disclosure, the tool 202 may be configured as a plugging tool, which may be set within the tubular 208 in such a manner that the tool 202 forms a fluid-tight seal against the inner surface 207 of the tubular 208. In an embodiment, the downhole tool 202 may be configured as a bridge plug, whereby flow from one section of the wellbore 213 to another (e.g., above and below the tool 202) is controlled. In other embodiments, the downhole tool 202 may be configured as a frac plug, where flow into one section 213 of the wellbore 206 may be blocked and otherwise diverted into the surrounding formation or reservoir 210.

In yet other embodiments, the downhole tool 202 may also be configured as a ball drop tool. In this aspect, a ball may be dropped into the wellbore 206 and flowed into the tool 202 and come to rest in a corresponding ball seat at the end of the mandrel 214. The seating of the ball may provide a seal within the tool 202 resulting in a plugged condition, whereby a pressure differential across the tool 202 may result. The ball seat may include a radius or curvature.

In other embodiments, the downhole tool 202 may be a ball check plug, whereby the tool 202 is configured with a ball already in place when the tool 202 runs into the wellbore. The tool 202 may then act as a check valve, and provide one-way flow capability. Fluid may be directed from the wellbore 206 to the formation with any of these configurations.

Once the tool 202 reaches the set position within the tubular, the setting mechanism or workstring 212 may be detached from the tool 202 by various methods, resulting in the tool 202 left in the surrounding tubular and one or more sections of the wellbore isolated. In an embodiment, once the tool 202 is set, tension may be applied to the adapter 252 until the threaded connection between the adapter 252 and the mandrel 214 is broken. For example, the mating threads on the adapter 252 and the mandrel 214 (256 and 216, respectively as shown in FIG. 2D) may be designed to shear, and thus may be pulled and sheared accordingly in a manner known in the art. The amount of load applied to the adapter 252 may be in the range of about, for example, 20,000 to 40,000 pounds force. In other applications, the load may be in the range of less than about 10,000 pounds force.

Accordingly, the adapter 252 may separate or detach from the mandrel 214, resulting in the workstring 212 being able to separate from the tool 202, which may be at a predetermined moment. The loads provided herein are non-limiting and are merely exemplary. The setting force may be determined by specifically designing the interacting surfaces of the tool and the respective tool surface angles. The tool 202 may also be configured with a predetermined failure point (not shown) configured to fail or break. For example, the failure point may break at a predetermined axial force greater than the force required to set the tool but less than the force required to part the body of the tool.

Operation of the downhole tool 202 may allow for fast run in of the tool 202 to isolate one or more sections of the wellbore 206, as well as quick and simple drill-through to destroy or remove the tool 202. Drill-through of the tool 202 may be facilitated by components and subcomponents of tool 202 made of drillable material that is less damaging to a drill bit than those found in conventional plugs. In an embodiment, the downhole tool 202 and/or its components may be a drillable tool made from drillable composite material(s), such as glass fiber/epoxy, carbon fiber/epoxy, glass fiber/PEEK, carbon fiber/PEEK, etc. Other resins may include phenolic, polyamide, etc. All mating surfaces of the downhole tool 202 may be configured with an angle, such that corresponding components may be placed under compression instead of shear.

Figure 2C:
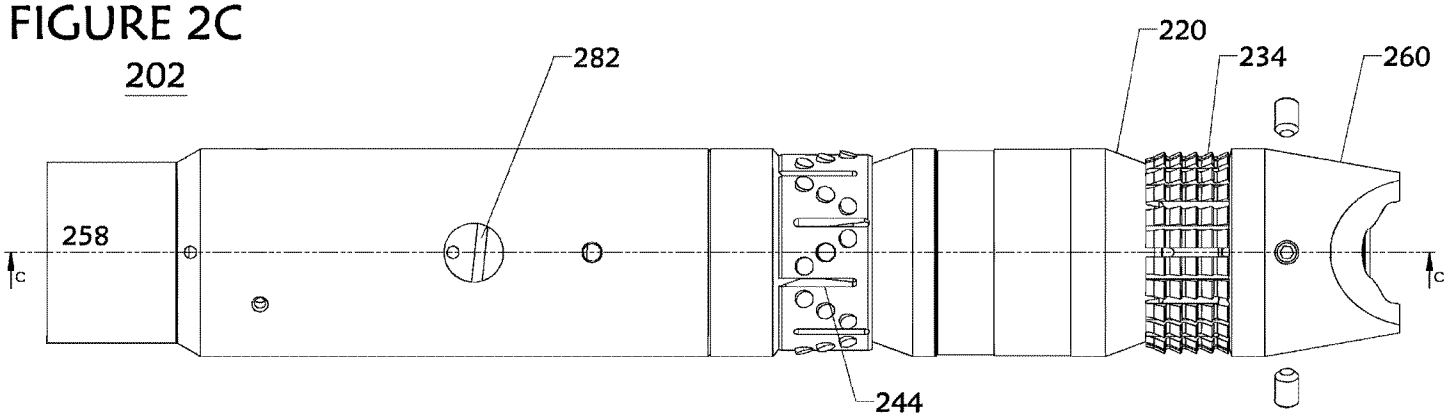
FIG. 2C shows a side longitudinal view of a downhole tool according to embodiments of the disclosure.
Figure 2D:
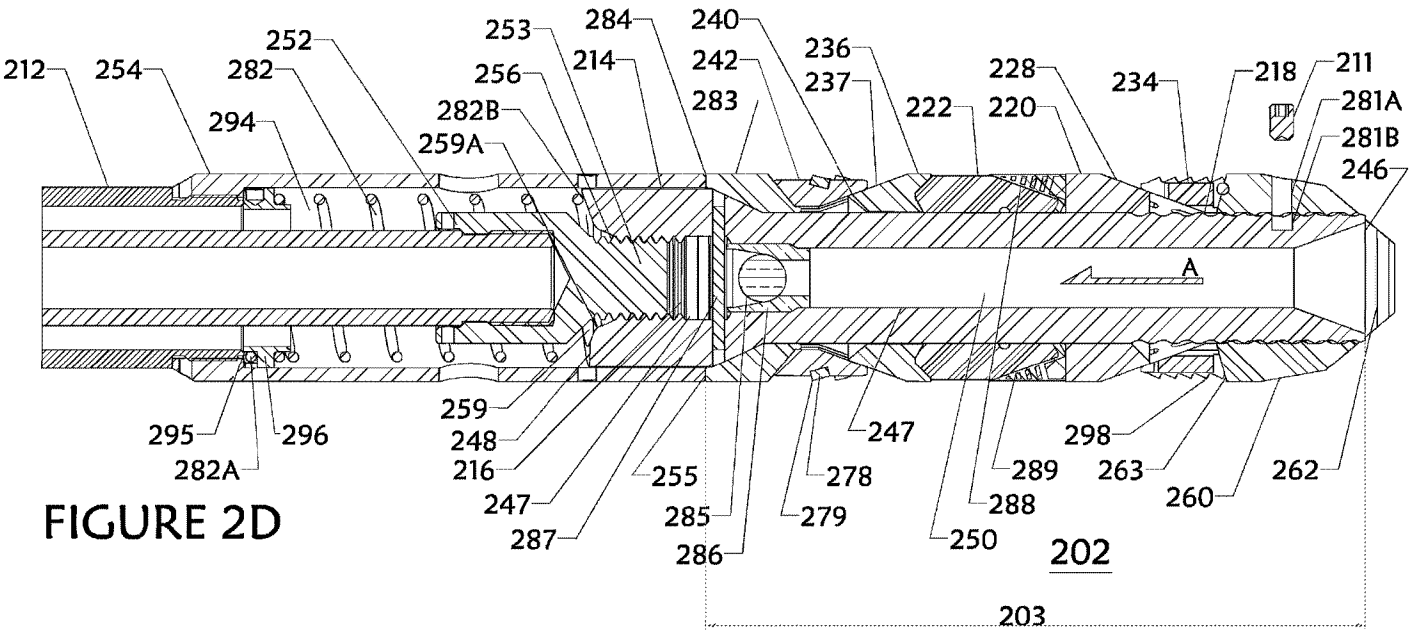
FIG. 2D shows a longitudinal cross-sectional view of a downhole tool according to embodiments of the disclosure.
Figure 2E:
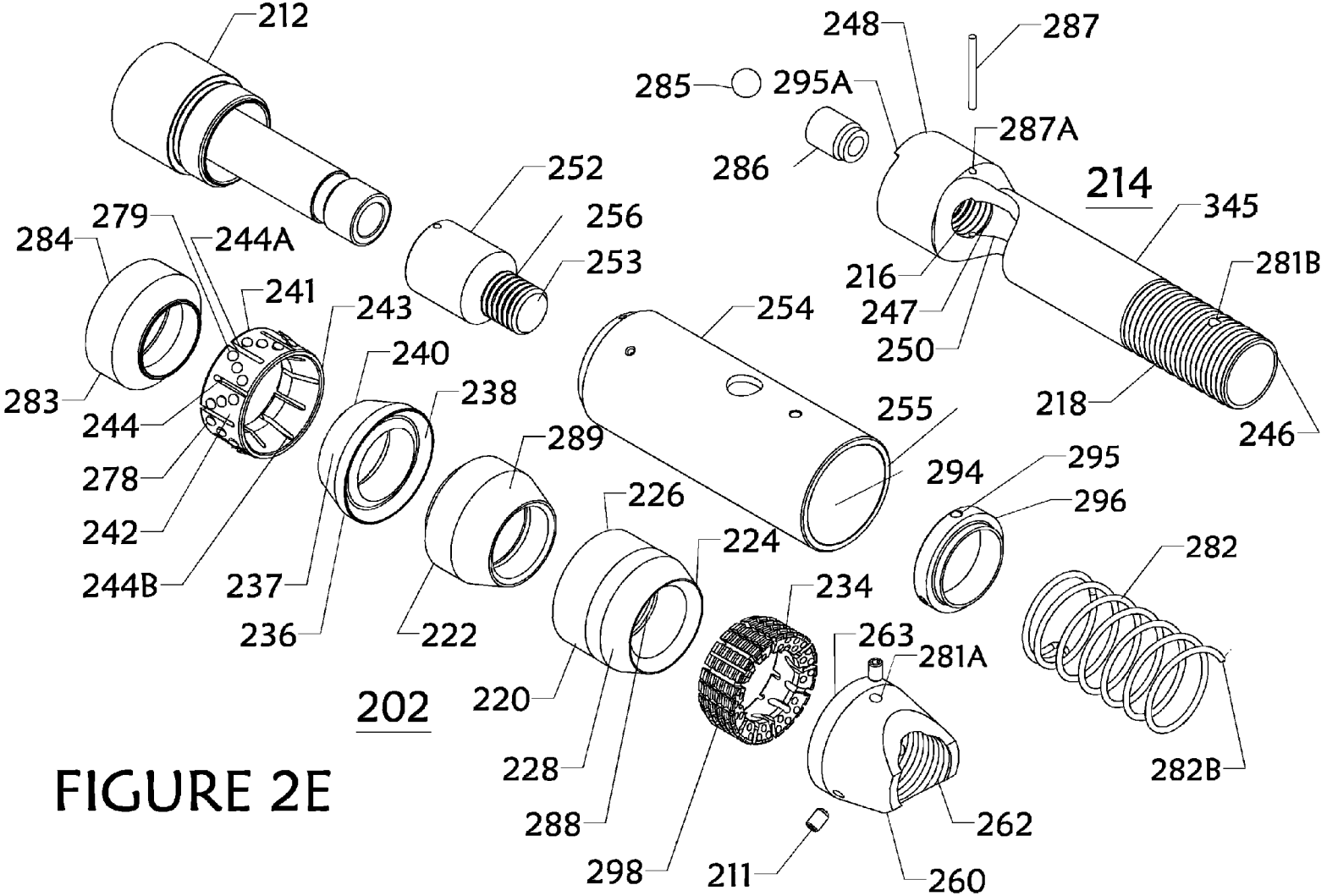
FIG. 2E shows an isometric component break-out view of a downhole tool according to embodiments of the disclosure.

Referring now to FIGS. 2C-2E together, a longitudinal view, a longitudinal cross-sectional view, and an isometric component break-out view, respectively, of downhole tool 202 useable with system (200, FIG. 2A) and illustrative of embodiments disclosed herein, are shown. The downhole tool 202 may include a mandrel 214 that extends through the tool (or tool body) 202. The mandrel 214 may be a solid body. In other aspects, the mandrel 214 may include a flowpath or bore 250 formed therein (e.g., an axial bore). The bore 250 may extend partially or for a short distance through the mandrel 214, as shown in FIG. 2E. Alternatively, the bore 250 may extend through the entire mandrel 214, with an opening at its proximate end 248 and oppositely at its distal end 246 (near downhole end of the tool 202), as illustrated by FIG. 2D.

The presence of the bore 250 or other flowpath through the mandrel 214 may indirectly be dictated by operating conditions. That is, in most instances the tool 202 may be large enough in diameter (e.g., 4-¾ inches) that the bore 250 may be correspondingly large enough (e.g., 1-¼ inches) so that debris and junk can pass or flow through the bore 250 without plugging concerns. However, with the use of a smaller diameter tool 202, the size of the bore 250 may need to be correspondingly smaller, which may result in the tool 202 being prone to plugging. Accordingly, the mandrel may be made solid to alleviate the potential of plugging within the tool 202.

With the presence of the bore 250, the mandrel 214 may have an inner bore surface 247, which may include one or more threaded surfaces formed thereon. As such, there may be a first set of threads 216 configured for coupling the mandrel 214 with corresponding threads 256 of a setting adapter 252.

The coupling of the threads, which may be shear threads, may facilitate detachable connection of the tool 202 and the setting adapter 252 and/or workstring (212, FIG. 2B) at the threads. It is within the scope of the disclosure that the tool 202 may also have one or more predetermined failure points (not shown) configured to fail or break separately from any threaded connection. The failure point may fail or shear at a predetermined axial force greater than the force required to set the tool 202.

The adapter 252 may include a stud 253 configured with the threads 256 thereon. In an embodiment, the stud 253 has external (male) threads 256 and the mandrel 214 has internal (female) threads; however, type or configuration of threads is not meant to be limited, and could be, for example, a vice versa female-male connection, respectively.

The downhole tool 202 may be run into wellbore (206, FIG. 2A) to a desired depth or position by way of the workstring (212, FIG. 2A) that may be configured with the setting device or mechanism. The workstring 212 and setting sleeve 254 may be part of the plugging tool system 200 utilized to run the downhole tool 202 into the wellbore, and activate the tool 202 to move from an unset to set position. The set position may include seal element 222 and/or slips 234, 242 engaged with the tubular (208, FIG. 2B). In an embodiment, the setting sleeve 254 (that may be configured as part of the setting mechanism or workstring) may be utilized to force or urge compression of the seal element 222, as well as swelling of the seal element 222 into sealing engagement with the surrounding tubular.

The setting device(s) and components of the downhole tool 202 may be coupled with, and axially and/or longitudinally movable along mandrel 214. When the setting sequence begins, the mandrel 214 may be pulled into tension while the setting sleeve 254 remains stationary. The lower sleeve 260 may be pulled as well because of its attachment to the mandrel 214 by virtue of the coupling of threads 218 and threads 262. As shown in the embodiment of FIGS. 2C and 2D, the lower sleeve 260 and the mandrel 214 may have matched or aligned holes 281A and 281B, respectively, whereby one or more anchor pins 211 or the like may be disposed or securely positioned therein. In embodiments, brass set screws may be used. Pins (or screws, etc.) 211 may prevent shearing or spin-off during drilling or run-in.

As the lower sleeve 260 is pulled in the direction of Arrow A, the components disposed about mandrel 214 between the lower sleeve 260 and the setting sleeve 254 may begin to compress against one another. This force and resultant movement causes compression and expansion of seal element 222. The lower sleeve 260 may also have an angled sleeve end 263 in engagement with the slip 234, and as the lower sleeve 260 is pulled further in the direction of Arrow A, the end 263 compresses against the slip 234. As a result, slip(s) 234 may move along a tapered or angled surface 228 of a composite member 220, and eventually radially outward into engagement with the surrounding tubular (208, FIG. 2B).

Serrated outer surfaces or teeth 298 of the slip(s) 234 may be configured such that the surfaces 298 prevent the slip 234 (or tool) from moving (e.g., axially or longitudinally) within the surrounding tubular, whereas otherwise the tool 202 may inadvertently release or move from its position. Although slip 234 is illustrated with teeth 298, it is within the scope of the disclosure that slip 234 may be configured with other gripping features, such as buttons or inserts (e.g., FIGS. 13A-13D).

Initially, the seal element 222 may swell into contact with the tubular, followed by further tension in the tool 202 that may result in the seal element 222 and composite member 220 being compressed together, such that surface 289 acts on the interior surface 288. The ability to "flower", unwind, and/or expand may allow the composite member 220 to extend completely into engagement with the inner surface of the surrounding tubular.

Additional tension or load may be applied to the tool 202 that results in movement of cone 236, which may be disposed around the mandrel 214 in a manner with at least one surface 237 angled (or sloped, tapered, etc.) inwardly of second slip 242. The second slip 242 may reside adjacent or proximate to collar or cone 236. As such, the seal element 222 forces the cone 236 against the slip 242, moving the slip 242 radially outwardly into contact or gripping engagement with the tubular. Accordingly, the one or more slips 234, 242 may be urged radially outward and into engagement with the tubular (208, FIG. 2B). In an embodiment, cone 236 may be slidingly engaged and disposed around the mandrel 214. As shown, the first slip 234 may be at or near distal end 246, and the second slip 242 may be disposed around the mandrel 214 at or near the proximate end 248. It is within the scope of the disclosure that the position of the slips 234 and 242 may be interchanged. Moreover, slip 234 may be interchanged with a slip comparable to slip 242, and vice versa.

Because the sleeve 254 is held rigidly in place, the sleeve 254 may engage against a bearing plate 283 that may result in the transfer load through the rest of the tool 202. The setting sleeve 254 may have a sleeve end 255 that abuts against the bearing plate end 284. As tension increases through the tool 202, an end of the cone 236, such as second end 240, compresses against slip 242, which may be held in place by the bearing plate 283. As a result of cone 236 having freedom of movement and its conical surface 237, the cone 236 may move to the underside beneath the slip 242, forcing the slip 242 outward and into engagement with the surrounding tubular (208, FIG. 2B).

The second slip 242 may include one or more, gripping elements, such as buttons or inserts 278, which may be configured to provide additional grip with the tubular. The inserts 278 may have an edge or corner 279 suitable to provide additional bite into the tubular surface. In an embodiment, the inserts 278 may be mild steel, such as 1018 heat treated steel. The use of mild steel may result in reduced or eliminated casing damage from slip engagement and reduced drill string and equipment damage from abrasion.

In an embodiment, slip 242 may be a one-piece slip, whereby the slip 242 has at least partial connectivity across its entire circumference. Meaning, while the slip 242 itself may have one or more grooves 244 configured therein, the slip 242 itself has no initial circumferential separation point. In an embodiment, the grooves 244 may be equidistantly spaced or disposed in the second slip 242. In other embodiments, the grooves 244 may have an alternatingly arranged configuration. That is, one groove 244A may be proximate to slip end 241, the next groove 244B may be proximate to an opposite slip end 243, and so forth.

The tool 202 may be configured with ball plug check valve assembly that includes a ball seat 286. The assembly may be removable or integrally formed therein. In an embodiment, the bore 250 of the mandrel 214 may be configured with the ball seat 286 formed or removably disposed therein. In some embodiments, the ball seat 286 may be integrally formed within the bore 250 of the mandrel 214. In other embodiments, the ball seat 286 may be separately or optionally installed within the mandrel 214, as may be desired.

The ball seat 286 may be configured in a manner so that a ball 285 seats or rests therein, whereby the flowpath through the mandrel 214 may be closed off (e.g., flow through the bore 250 is restricted or controlled by the presence of the ball 285). For example, fluid flow from one direction may urge and hold the ball 285 against the seat 286, whereas fluid flow from the opposite direction may urge the ball 285 off or away from the seat 286. As such, the ball 285 and the check valve assembly may be used to prevent or otherwise control fluid flow through the tool 202. The ball 285 may be conventially made of a composite material, phenolic resin, etc., whereby the ball 285 may be capable of holding maximum pressures experienced during downhole operations (e.g., fracing). By utilization of retainer pin 287, the ball 285 and ball seat 286 may be configured as a retained ball plug. As such, the ball 285 may be adapted to serve as a check valve by sealing pressure from one direction, but allowing fluids to pass in the opposite direction.

The tool 202 may be configured as a drop ball plug, such that a drop ball may be flowed to a drop ball seat 259. The drop ball may be much larger diameter than the ball of the ball check. In an embodiment, end 248 may be configured with a drop ball seat surface 259 such that the drop ball may come to rest and seat at in the seat proximate end 248. As applicable, the drop ball (not shown here) may be lowered into the wellbore (206, FIG. 2A) and flowed toward the drop ball seat 259 formed within the tool 202. The ball seat may be formed with a radius 259A (i.e., circumferential rounded edge or surface).

In other aspects, the tool 202 may be configured as a bridge plug, which once set in the wellbore, may prevent or allow flow in either direction (e.g., upwardly/downwardly, etc.) through tool 202. Accordingly, it should be apparent to one of skill in the art that the tool 202 of the present disclosure may be configurable as a frac plug, a drop ball plug, bridge plug, etc. simply by utilizing one of a plurality of adapters or other optional components. In any configuration, once the tool 202 is properly set, fluid pressure may be increased in the wellbore, such that further downhole operations, such as fracture in a target zone, may commence.

The tool 202 may include an anti-rotation assembly that includes an anti-rotation device or mechanism 282, which may be a spring, a mechanically spring-energized composite tubular member, and so forth. The device 282 may be configured and usable for the prevention of undesired or inadvertent movement or unwinding of the tool 202 components. As shown, the device 282 may reside in cavity 294 of the sleeve (or housing) 254. During assembly the device 282 may be held in place with the use of a lock ring 296. In other aspects, pins may be used to hold the device 282 in place.

FIG. 2D shows the lock ring 296 may be disposed around a part 217 of a setting tool coupled with the workstring 212. The lock ring 296 may be securely held in place with screws inserted through the sleeve 254. The lock ring 296 may include a guide hole or groove 295, whereby an end 282A of the device 282 may slidingly engage therewith. Protrusions or dogs 295A may be configured such that during assembly, the mandrel 214 and respective tool components may ratchet and rotate in one direction against the device 282; however, the engagement of the protrusions 295A with device end 282B may prevent back-up or loosening in the opposite direction.

The anti-rotation mechanism may provide additional safety for the tool and operators in the sense it may help prevent inoperability of tool in situations where the tool is inadvertently used in the wrong application. For example, if the tool is used in the wrong temperature application, components of the tool may be prone to melt, whereby the device 282 and lock ring 296 may aid in keeping the rest of the tool together. As such, the device 282 may prevent tool components from loosening and/or unscrewing, as well as prevent tool 202 unscrewing or falling off the workstring 212.

Drill-through of the tool 202 may be facilitated by the fact that the mandrel 214, the slips 234, 242, the cone(s) 236, the composite member 220, etc. may be made of drillable material that is less damaging to a drill bit than those found in conventional plugs. The drill bit will continue to move through the tool 202 until the downhole slip 234 and/or 242 are drilled sufficiently that such slip loses its engagement with the well bore. When that occurs, the remainder of the tools, which generally would include lower sleeve 260 and any portion of mandrel 214 within the lower sleeve 260 falls into the well. If additional tool(s) 202 exist in the well bore beneath the tool 202 that is being drilled through, then the falling away portion will rest atop the tool 202 located further in the well bore and will be drilled through in connection with the drill through operations related to the tool 202 located further in the well bore. Accordingly, the tool 202 may be sufficiently removed, which may result in opening the tubular 208.

Referring now to FIGS. 3A, 3B, 3C and 3D together, an isometric view and a longitudinal cross-sectional view of a mandrel usable with a downhole tool, a longitudinal cross-sectional view of an end of a mandrel, and a longitudinal cross-sectional view of an end of a mandrel engaged with a sleeve, in accordance with embodiments disclosed herein, are shown. Components of the downhole tool may be arranged and disposed about the mandrel 314, as described and understood to one of skill in the art. The mandrel 314, which may be made from filament wound drillable material, may have a distal end 346 and a proximate end 348. The filament wound material may be made of various angles as desired to increase strength of the mandrel 314 in axial and radial directions. The presence of the mandrel 314 may provide the tool with the ability to hold pressure and linear forces during setting or plugging operations.

The mandrel 314 may be sufficient in length, such that the mandrel may extend through a length of tool (or tool body) (202, FIG. 2B). The mandrel 314 may be a solid body. In other aspects, the mandrel 314 may include a flowpath or bore 350 formed therethrough (e.g., an axial bore). There may be a flowpath or bore 350, for example an axial bore, that extends through the entire mandrel 314, with openings at both the proximate end 348 and oppositely at its distal end 346. Accordingly, the mandrel 314 may have an inner bore surface 347, which may include one or more threaded surfaces formed thereon.

The ends 346, 348 of the mandrel 314 may include internal or external (or both) threaded portions. As shown in FIG. 3C, the mandrel 314 may have internal threads 316 within the bore 350 configured to receive a mechanical or wireline setting tool, adapter, etc. (not shown here). For example, there may be a first set of threads 316 configured for coupling the mandrel 314 with corresponding threads of another component (e.g., adapter 252, FIG. 2B). In an embodiment, the first set of threads 316 are shear threads. In an embodiment, application of a load to the mandrel 314 may be sufficient enough to shear the first set of threads 316. Although not necessary, the use of shear threads may eliminate the need for a separate shear ring or pin, and may provide for shearing the mandrel 314 from the workstring.

The proximate end 348 may include an outer taper 348A. The outer taper 348A may help prevent the tool from getting stuck or binding. For example, during setting the use of a smaller tool may result in the tool binding on the setting sleeve, whereby the use of the outer taper 348 will allow the tool to slide off easier from the setting sleeve. In an embodiment, the outer taper 348A may be formed at an angle φ of about 5 degrees with respect to the axis 358. The length of the taper 348A may be about 0.5 inches to about 0.75 inches There may be a neck or transition portion 349, such that the mandrel may have variation with its outer diameter. In an embodiment, the mandrel 314 may have a first outer diameter D1 that is greater than a second outer diameter D2. Conventional mandrel components are configured with shoulders (i.e., a surface angle of about 90 degrees) that result in components prone to direct shearing and failure. In contrast, embodiments of the disclosure may include the transition portion 349 configured with an angled transition surface 349A. A transition surface angle b may be about 25 degrees with respect to the tool (or tool component axis) 358.

The transition portion 349 may withstand radial forces upon compression of the tool components, thus sharing the load. That is, upon compression the bearing plate 383 and mandrel 314, the forces are not oriented in just a shear direction. The ability to share load(s) among components means the components do not have to be as large, resulting in an overall smaller tool size.

In addition to the first set of threads 316, the mandrel 314 may have a second set of threads 318. In one embodiment, the second set of threads 318 may be rounded threads disposed along an external mandrel surface 345 at the distal end 346. The use of rounded threads may increase the shear strength of the threaded connection.

Figure 3A:
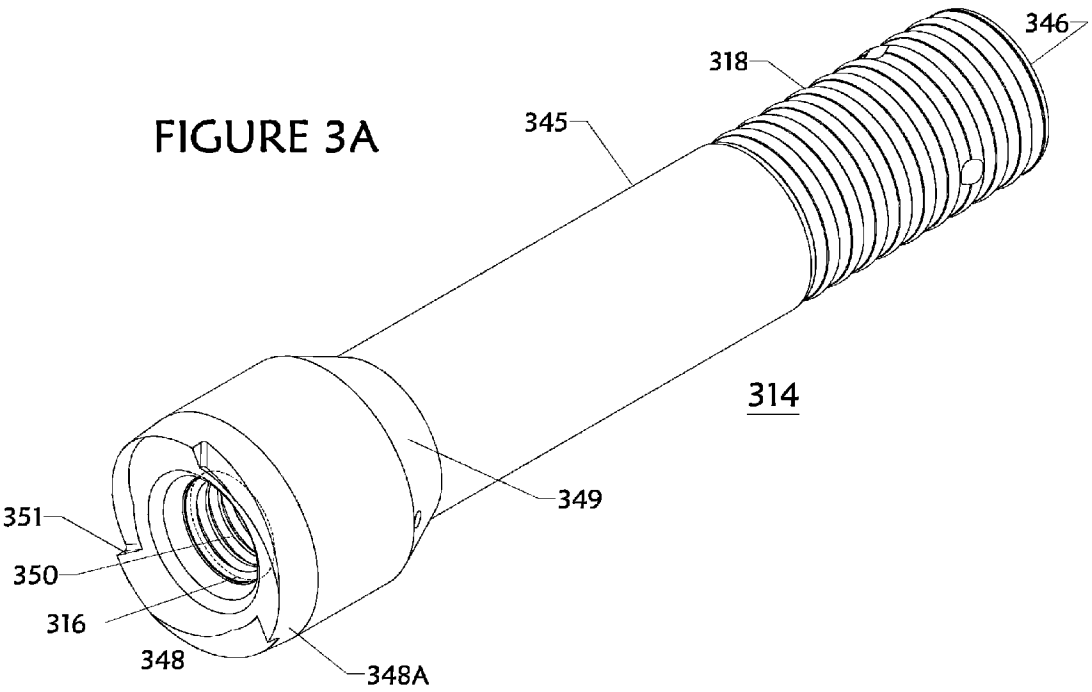
FIG. 3A shows an isometric view of a mandrel usable with a downhole tool according to embodiments of the disclosure.
Figure 3B:
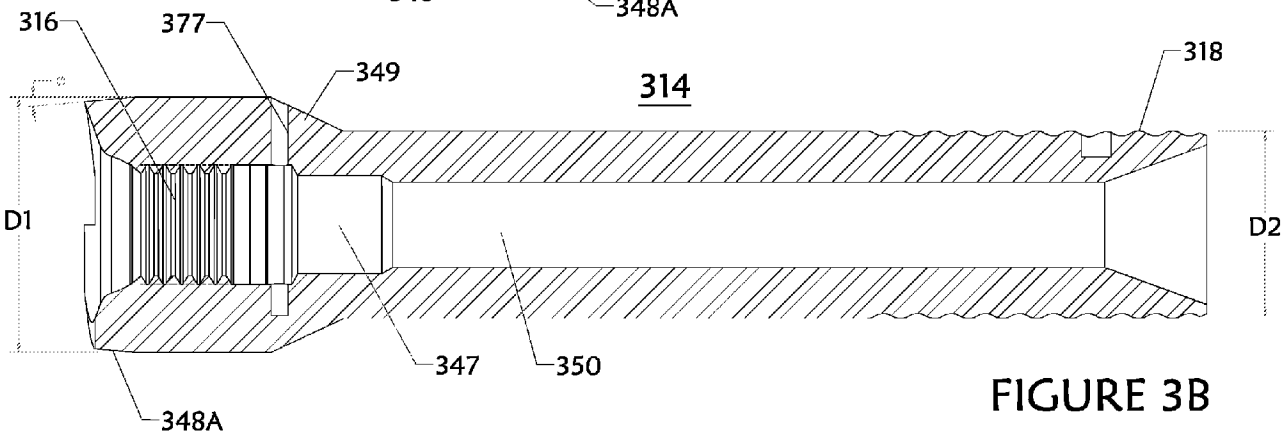
FIG. 3B shows a longitudinal cross-sectional view of a mandrel usable with a downhole tool according to embodiments of the disclosure.
Figure 3D:
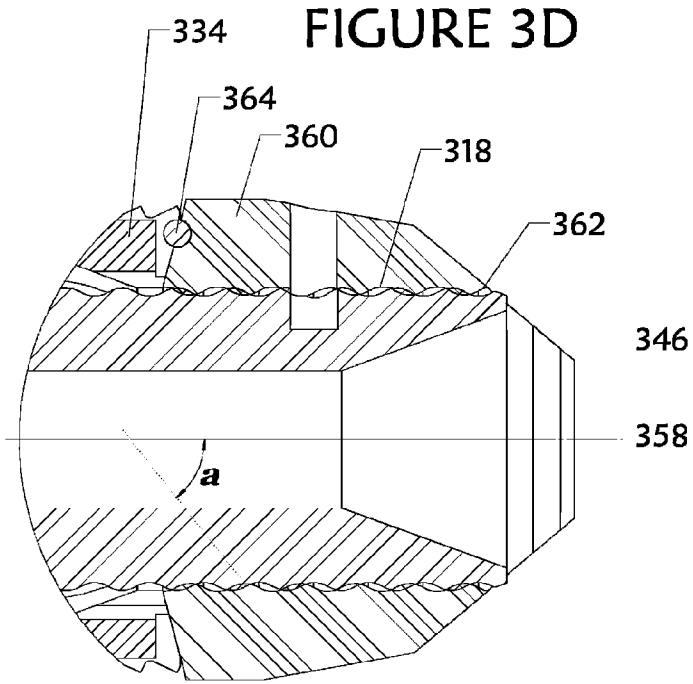
FIG. 3D shows a longitudinal cross-sectional view of an end of a mandrel engaged with a sleeve according to embodiments of the disclosure.
Figure 3C:
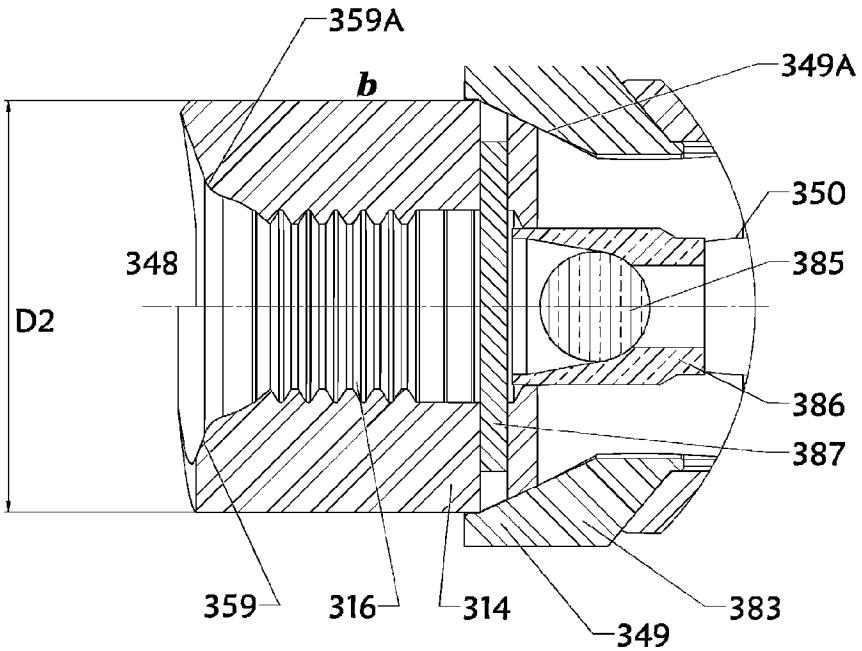
FIG. 3C shows a longitudinal cross-sectional view of an end of a mandrel usable with a downhole tool according to embodiments of the disclosure.

FIG. 3D illustrates an embodiment of component connectivity at the distal end 346 of the mandrel 314. As shown, the mandrel 314 may be coupled with a sleeve 360 having corresponding threads 362 configured to mate with the second set of threads 318. In this manner, setting of the tool may result in distribution of load forces along the second set of threads 318 at an angle a away from axis 358. There may be one or more balls 364 disposed between the sleeve 360 and slip 334. The balls 364 may help promote even breakage of the slip 334.

Accordingly, the use of round threads may allow a non-axial interaction between surfaces, such that there may be vector forces in other than the shear/axial direction. The round thread profile may create radial load (instead of shear) across the thread root. As such, the rounded thread profile may also allow distribution of forces along more thread surface(s). As composite material is typically best suited for compression, this allows smaller components and added thread strength. This beneficially provides upwards of 5-times strength in the thread profile as compared to conventional composite tool connections.

With particular reference to FIG. 3C, the mandrel 314 may have a ball seat 386 disposed therein. In some embodiments, the ball seat 386 may be a separate component, while in other embodiments the ball seat 386 may be formed integral with the mandrel 314. There also may be a drop ball seat surface 359 formed within the bore 350 at the proximate end 348. The ball seat 359 may have a radius 359A that provides a rounded edge or surface for the drop ball to mate with. In an embodiment, the radius 359A of seat 359 may be smaller than the ball that seats in the seat. Upon seating, pressure may "urge" or otherwise wedge the drop ball into the radius, whereby the drop ball will not unseat without an extra amount of pressure. The amount of pressure required to urge and wedge the drop ball against the radius surface, as well as the amount of pressure required to unwedge the drop ball, may be predetermined. Thus, the size of the drop ball, ball seat, and radius may be designed, as applicable.

The use of a small curvature or radius 359A may be advantageous as compared to a conventional sharp point or edge of a ball seat surface. For example, radius 359A may provide the tool with the ability to accommodate drop balls with variation in diameter, as compared to a specific diameter. In addition, the surface 359 and radius 359A may be better suited to distribution of load around more surface area of the ball seat as compared to just at the contact edge/point of other ball seats.

Referring now to FIGS. 6A, 6B, 6C, 6D, 6E, and 6F together, an isometric view, a longitudinal cross-sectional view, a close-up longitudinal cross-sectional view, a side longitudinal view, a longitudinal cross-sectional view, and an underside isometric view, respectively, of a composite deformable member 320 (and its subcomponents) usable with a downhole tool in accordance with embodiments disclosed herein, are shown. The composite member 320 may be configured in such a manner that upon a compressive force, at least a portion of the composite member may begin to deform (or expand, deflect, twist, unspring, break, unwind, etc.) in a radial direction away from the tool axis (e.g., 258, FIG. 2C). Although exemplified as "composite", it is within the scope of the disclosure that member 320 may be made from metal, including alloys and so forth.

During the setting sequence, the seal element 322 and the composite member 320 may compress together. As a result of an angled exterior surface 389 of the seal element 322 coming into contact with the interior surface 388 of the composite member 320, a deformable (or first or upper) portion 326 of the composite member 320 may be urged radially outward and into engagement the surrounding tubular (not shown) at or near a location where the seal element 322 at least partially sealingly engages the surrounding tubular. There may also be a resilient (or second or lower) portion 328. In an embodiment, the resilient portion 328 may be configured with greater or increased resilience to deformation as compared to the deformable portion 326.

The composite member 320 may be a composite component having at least a first material 331 and a second material 332, but composite member 320 may also be made of a single material. The first material 331 and the second material 332 need not be chemically combined. In an embodiment, the first material 331 may be physically or chemically bonded, cured, molded, etc. with the second material 332. Moreover, the second material 332 may likewise be physically or chemically bonded with the deformable portion 326. In other embodiments, the first material 331 may be a composite material, and the second material 332 may be a second composite material.

The composite member 320 may have cuts or grooves 330 formed therein. The use of grooves 330 and/or spiral (or helical) cut pattern(s) may reduce structural capability of the deformable portion 326, such that the composite member 320 may "flower" out. The groove 330 or groove pattern is not meant to be limited to any particular orientation, such that any groove 330 may have variable pitch and vary radially.

With groove(s) 330 formed in the deformable portion 326, the second material 332, may be molded or bonded to the deformable portion 326, such that the grooves 330 are filled in and enclosed with the second material 332. In embodiments, the second material 332 may be an elastomeric material. In other embodiments, the second material 332 may be 60-95 Duro A polyurethane or silicone. Other materials may include, for example, TFE or PTFE sleeve option-heat shrink. The second material 332 of the composite member 320 may have an inner material surface 368.

Different downhole conditions may dictate choice of the first and/or second material. For example, in low temp operations (e.g., less than about 250 F), the second material comprising polyurethane may be sufficient, whereas for high temp operations (e.g., greater than about 250 F) polyurethane may not be sufficient and a different material like silicone may be used.

The use of the second material 332 in conjunction with the grooves 330 may provide support for the groove pattern and reduce preset issues. With the added benefit of second material 332 being bonded or molded with the deformable portion 326, the compression of the composite member 320 against the seal element 322 may result in a robust, reinforced, and resilient barrier and seal between the components and with the inner surface of the tubular member (e.g., 208 in FIG. 2B). As a result of increased strength, the seal, and hence the tool of the disclosure, may withstand higher downhole pressures. Higher downhole pressures may provide a user with better frac results.

Groove(s) 330 allow the composite member 320 to expand against the tubular, which may result in a formidable barrier between the tool and the tubular. In an embodiment, the groove 330 may be a spiral (or helical, wound, etc.) cut formed in the deformable portion 326. In an embodiment, there may be a plurality of grooves or cuts 330. In another embodiment, there may be two symmetrically formed grooves 330, as shown by way of example in FIG. 6E. In yet another embodiment, there may be three grooves 330.

Figure 6A:
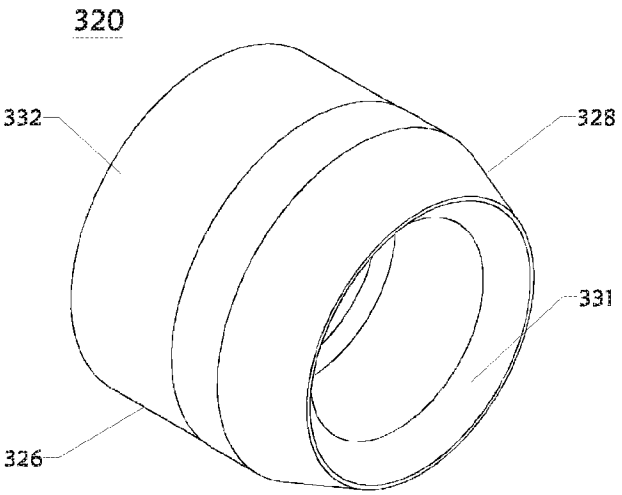
FIG. 6A shows an isometric view of a composite deformable member usable with a downhole tool according to embodiments of the disclosure.
Figure 6B:
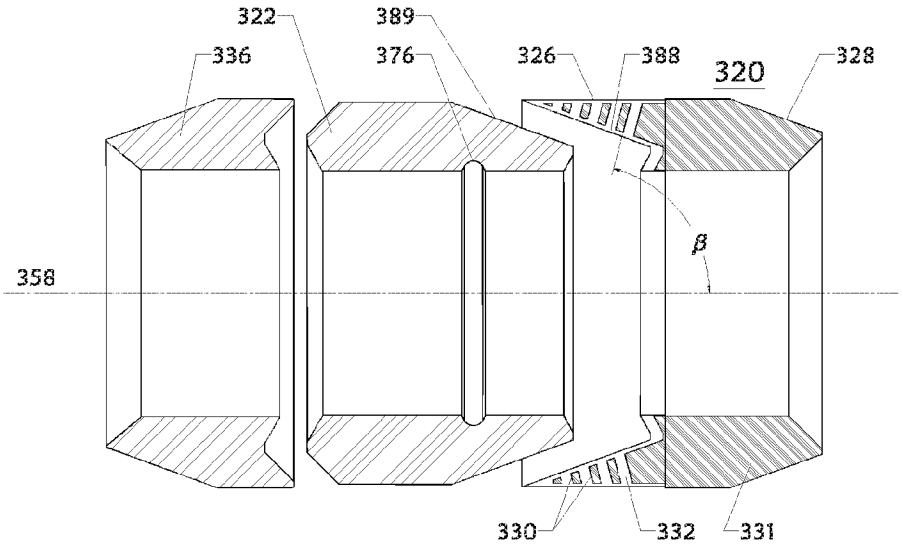
FIG. 6B shows a longitudinal cross-sectional view of a composite deformable member usable with a downhole tool according to embodiments of the disclosure.
Figure 6C:
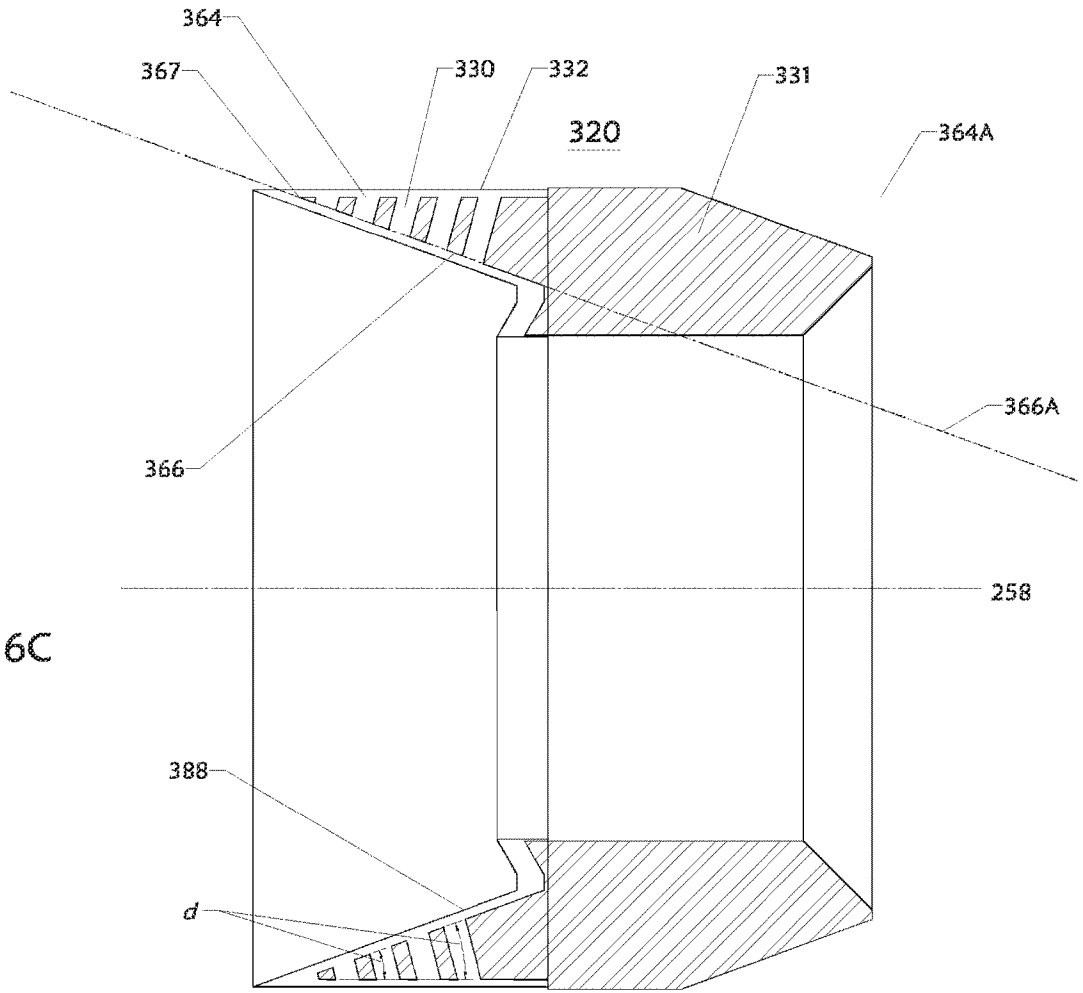
FIG. 6C shows a close-up longitudinal cross-sectional view of a composite deformable member usable with a downhole tool according to embodiments of the disclosure.
Figure 6F:
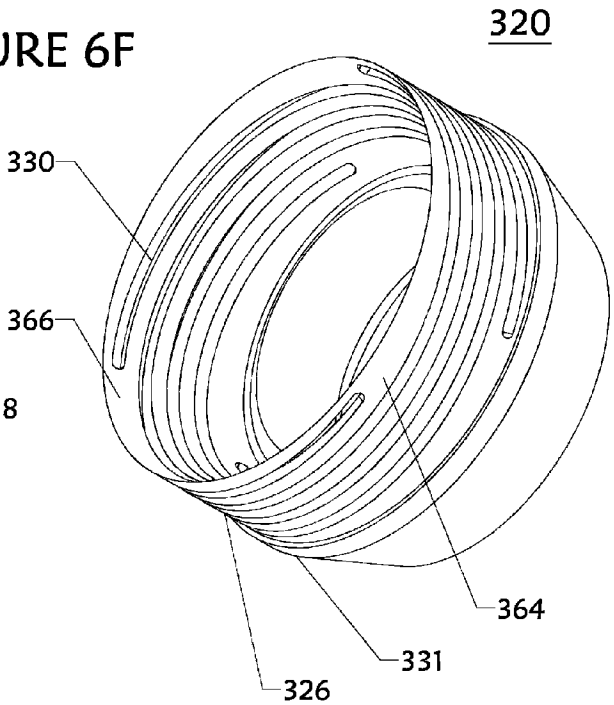
FIG. 6F shows an underside isometric view of a composite deformable member usable with a downhole tool according to embodiments of the disclosure.
Figure 6E:
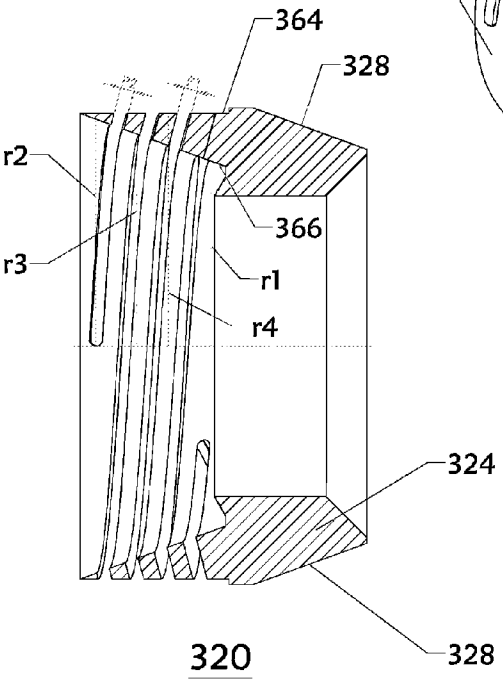
FIG. 6E shows a longitudinal cross-sectional view of a composite deformable member usable with a downhole tool according to embodiments of the disclosure.
Figure 6D:
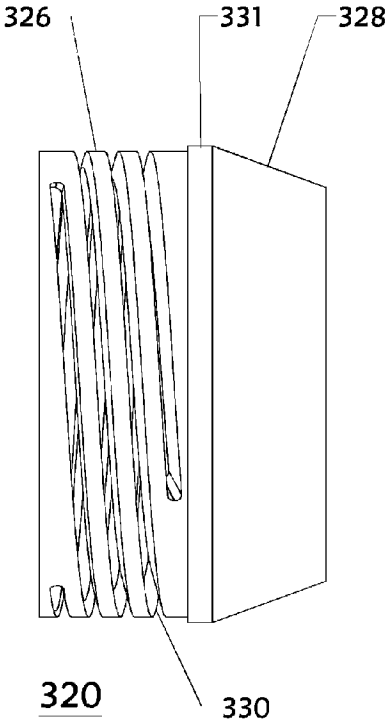
FIG. 6D shows a side longitudinal view of a composite deformable member usable with a downhole tool according to embodiments of the disclosure.

As illustrated by FIG. 6C, the depth d of any cut or groove 330 may extend entirely from an exterior side surface 364 to an upper side interior surface 366. The depth d of any groove 330 may vary as the groove 330 progresses along the deformable portion 326. In an embodiment, an outer planar surface 364A may have an intersection at points tangent the exterior side 364 surface, and similarly, an inner planar surface 366A may have an intersection at points tangent the upper side interior surface 366. The planes 364A and 366A of the surfaces 364 and 366, respectively, may be parallel or they may have an intersection point 367. Although the composite member 320 is depicted as having a linear surface illustrated by plane 366A, the composite member 320 is not meant to be limited, as the inner surface may be non-linear or non-planar (i.e., have a curvature or rounded profile).

In an embodiment, the groove(s) 330 or groove pattern may be a spiral pattern having constant pitch ($p_1$ about the same as $p_2$), constant radius ($r_3$ about the same as $r_4$) on the outer surface 364 of the deformable member 326. In an embodiment, the spiral pattern may include constant pitch ($p_1$ about the same as $p_2$), variable radius ($r_1$ unequal to $r_2$) on the inner surface 366 of the deformable member 326.

In an embodiment, the groove(s) 330 or groove pattern may be a spiral pattern having variable pitch ($p_1$ unequal to $p_2$), constant radius ($r_3$ about the same as $r_4$) on the outer surface 364 of the deformable member 326. In an embodiment, the spiral pattern may include variable pitch ($p_1$ unequal to $p_2$), variable radius ($r_1$ unequal to $r_2$) on the inner surface 366 of the deformable member 320.

As an example, the pitch (e.g., $p_1$, $p_2$, etc.) may be in the range of about 0.5 turns/inch to about 1.5 turns/inch. As another example, the radius at any given point on the outer surface may be in the range of about 1.5 inches to about 8 inches. The radius at any given point on the inner surface may be in the range of about less than 1 inch to about 7 inches. Although given as examples, the dimensions are not meant to be limiting, as other pitch and radial sizes are within the scope of the disclosure.

In an exemplary embodiment reflected in FIG. 6B, the composite member 320 may have a groove pattern cut on a back angle β. A pattern cut or formed with a back angle may allow the composite member 320 to be unrestricted while expanding outward. In an embodiment, the back angle β may be about 75 degrees (with respect to axis 258). In other embodiments, the angle β may be in the range of about 60 to about 120 degrees The presence of groove(s) 330 may allow the composite member 320 to have an unwinding, expansion, or "flower" motion upon compression, such as by way of compression of a surface (e.g., surface 389) against the interior surface of the deformable portion 326. For example, when the seal element 322 moves, surface 389 is forced against the interior surface 388. Generally the failure mode in a high pressure seal is the gap between components; however, the ability to unwind and/or expand allows the composite member 320 to extend completely into engagement with the inner surface of the surrounding tubular.

Figure 4A:
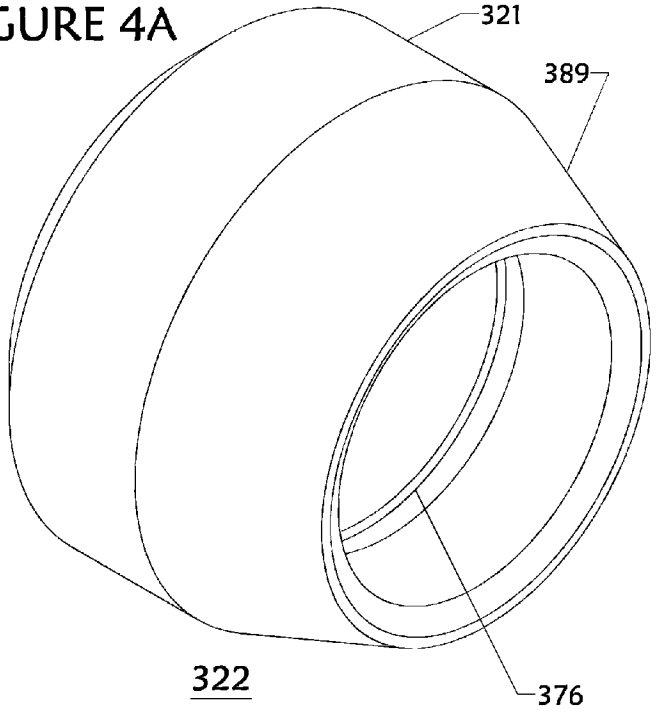
FIG. 4A shows a longitudinal cross-sectional view of a seal element usable with a downhole tool according to embodiments of the disclosure.
Figure 4B:
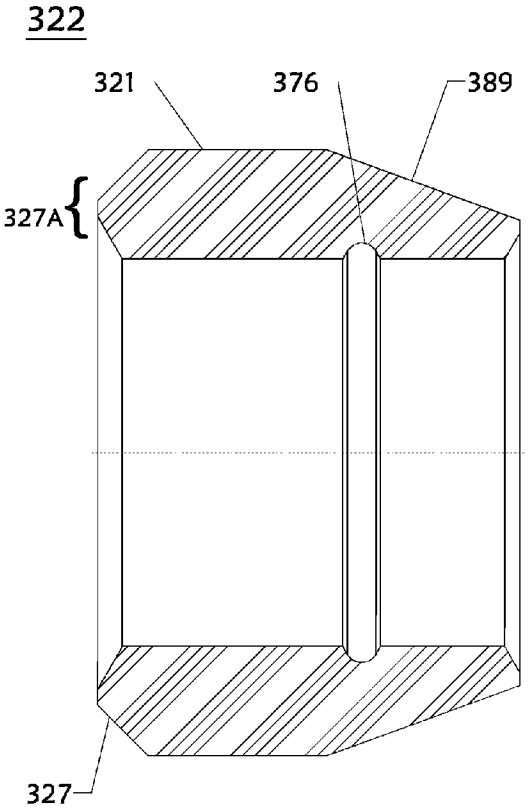
FIG. 4B shows an isometric view of a seal element usable with a downhole tool according to embodiments of the disclosure.

Referring now to FIGS. 4A and 4B together, a longitudinal cross-sectional view and an isometric view of a seal element (and its subcomponents), respectively, usable with a downhole tool in accordance with embodiments disclosed herein are shown. The seal element 322 may be made of an elastomeric and/or poly material, such as rubber, nitrile rubber, Viton or polyurethane, and may be configured for positioning or otherwise disposed around the mandrel (e.g., 214, FIG. 2C). In an embodiment, the seal element 322 may be made from 75 Duro A elastomer material. The seal element 322 may be disposed between a first slip and a second slip (see FIG. 2C, seal element 222 and slips 234, 236).

The seal element 322 may be configured to buckle (deform, compress, etc.), such as in an axial manner, during the setting sequence of the downhole tool (202, FIG. 2C). However, although the seal element 322 may buckle, the seal element 322 may also be adapted to expand or swell, such as in a radial manner, into sealing engagement with the surrounding tubular (208, FIG. 2B) upon compression of the tool components. In a preferred embodiment, the seal element 322 provides a fluid-tight seal of the seal surface 321 against the tubular.

The seal element 322 may have one or more angled surfaces configured for contact with other component surfaces proximate thereto. For example, the seal element may have angled surfaces 327 and 389. The seal element 322 may be configured with an inner circumferential groove 376. The presence of the groove 376 assists the seal element 322 to initially buckle upon start of the setting sequence. The groove 376 may have a size (e.g., width, depth, etc.) of about 0.25 inches.

Slips. Referring now to FIGS. 5A, 5B, 5C, 5D, 5E, 5F, and 5G together, an isometric view, a lateral view, and a longitudinal cross-sectional view of one or more slips, and an isometric view of a metal slip, a lateral view of a metal slip, a longitudinal cross-sectional view of a metal slip, and an isometric view of a metal slip without buoyant material holes, respectively, (and related subcomponents) usable with a downhole tool in accordance with embodiments disclosed herein are shown. The slips 334, 342 described may be made from metal, such as cast iron, or from composite material, such as filament wound composite. During operation, the winding of the composite material may work in conjunction with inserts under compression in order to increase the radial load of the tool.

Figure 5A:
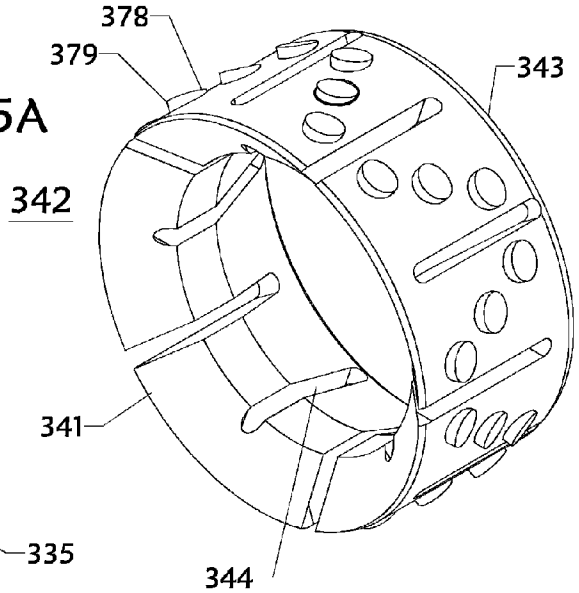
FIG. 5A shows an isometric view of one or more slips usable with a downhole tool according to embodiments of the disclosure.
Figure 5C:
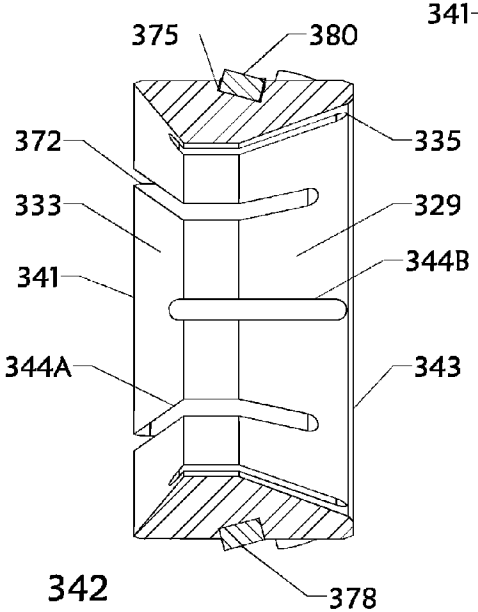
FIG. 5C shows a longitudinal cross-sectional view of one or more slips usable with a downhole tool according to embodiments of the disclosure.
Figure 5B:
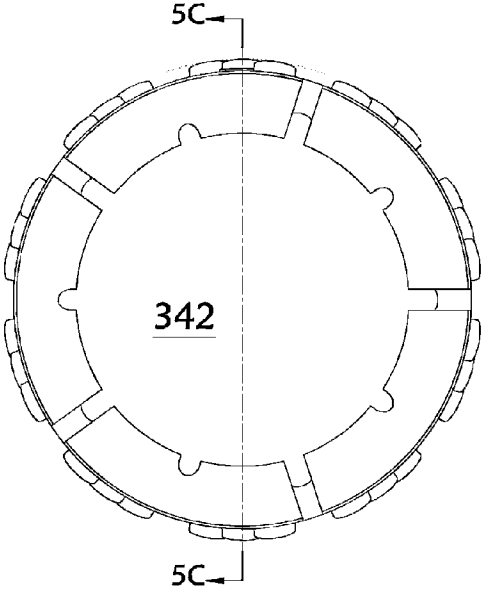
FIG. 5B shows a lateral view of one or more slips usable with a downhole tool according to embodiments of the disclosure.
Figure 5D:
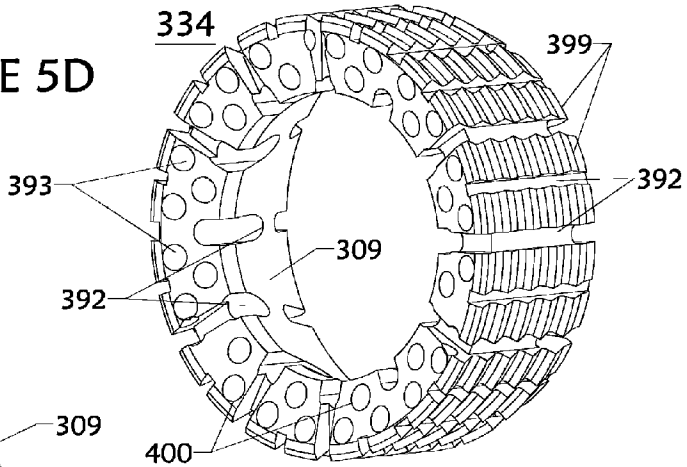
FIG. 5D shows an isometric view of a metal slip usable with a downhole tool according to embodiments of the disclosure.

Slips 334, 342 may be used in either upper or lower slip position, or both, without limitation. As apparent, there may be a first slip 334, which may be disposed around the mandrel (214, FIG. 2C), and there may also be a second slip 342, which may also be disposed around the mandrel. Either of slips 334, 342 may include a means for gripping the inner wall of the tubular, casing, and/or well bore, such as a plurality of gripping elements, including serrations or teeth 398, inserts 378, etc. As shown in FIGS. 5D-5F, the first slip 334 may include rows and/or columns 399 of serrations 398. The gripping elements may be arranged or configured whereby the slips 334, 342 engage the tubular (not shown) in such a manner that movement (e.g., longitudinally axially) of the slips or the tool once set is prevented.

In embodiments, the slip 334 may be a poly-moldable material. In other embodiments, the slip 334 may be hardened, surface hardened, heat-treated, carburized, etc., as would be apparent to one of ordinary skill in the art. However, in some instances, slips 334 may be too hard and end up as too difficult or take too long to drill through.

Typically, hardness on the teeth 398 may be about 40-60 Rockwell. As understood by one of ordinary skill in the art, the Rockwell scale is a hardness scale based on the indentation hardness of a material. Typical values of very hard steel have a Rockwell number (HRC) of about 55-66. In some aspects, even with only outer surface heat treatment the inner slip core material may become too hard, which may result in the slip 334 being impossible or impracticable to drill-thru.

Thus, the slip 334 may be configured to include one or more holes 393 formed therein. The holes 393 may be longitudinal in orientation through the slip 334. The presence of one or more holes 393 may result in the outer surface(s) 307 of the metal slips as the main and/or majority slip material exposed to heat treatment, whereas the core or inner body (or surface) 309 of the slip 334 is protected. In other words, the holes 393 may provide a barrier to transfer of heat by reducing the thermal conductivity (i.e., k-value)

of the slip 334 from the outer surface(s) 307 to the inner core or surfaces 309. The presence of the holes 393 is believed to affect the thermal conductivity profile of the slip 334, such that that heat transfer is reduced from outer to inner because otherwise when heat/quench occurs the entire slip 334 heats up and hardens.

Thus, during heat treatment, the teeth 398 on the slip 334 may heat up and harden resulting in heat-treated outer area/teeth, but not the rest of the slip. In this manner, with treatments such as flame (surface) hardening, the contact point of the flame is minimized (limited) to the proximate vicinity of the teeth 398.

With the presence of one or more holes 393, the hardness profile from the teeth to the inner diameter/core (e.g., laterally) may decrease dramatically, such that the inner slip material or surface 309 has a HRC of about ~15 (or about normal hardness for regular steel/cast iron). In this aspect, the teeth 398 stay hard and provide maximum bite, but the rest of the slip 334 is easily drillable.

One or more of the void spaces/holes 393 may be filled with useful "buoyant" (or low density) material 400 to help debris and the like be lifted to the surface after drill-thru. The material 400 disposed in the holes 393 may be, for example, polyurethane, light weight beads, or glass bubbles/beads such as the K-series glass bubbles made by and available from 3M. Other low-density materials may be used.

The advantageous use of material 400 helps promote lift on debris after the slip 334 is drilled through. The material 400 may be epoxied or injected into the holes 393 as would be apparent to one of skill in the art.

The slots 392 in the slip 334 may promote breakage. An evenly spaced configuration of slots 392 promotes even breakage of the slip 334.

First slip 334 may be disposed around or coupled to the mandrel (214, FIG. 2B) as would be known to one of skill in the art, such as a band or with shear screws (not shown) configured to maintain the position of the slip 334 until sufficient pressure (e.g., shear) is applied. The band may be made of steel wire, plastic material or composite material having the requisite characteristics in sufficient strength to hold the slip 334 in place while running the downhole tool into the wellbore, and prior to initiating setting. The band may be drillable.

When sufficient load is applied, the slip 334 compresses against the resilient portion or surface of the composite member (e.g., 220, FIG. 2C), and subsequently expand radially outwardly to engage the surrounding tubular (see, for example, slip 234 and composite member 220 in FIG. 2C).

Figure 5G:
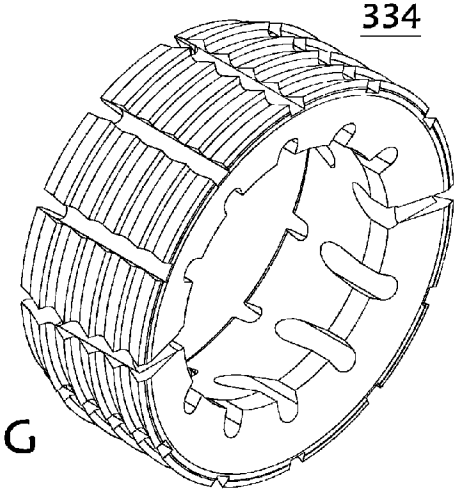
FIG. 5G shows an isometric view of a metal slip without buoyant material holes usable with a downhole tool according to embodiments of the disclosure.
Figure 5F:
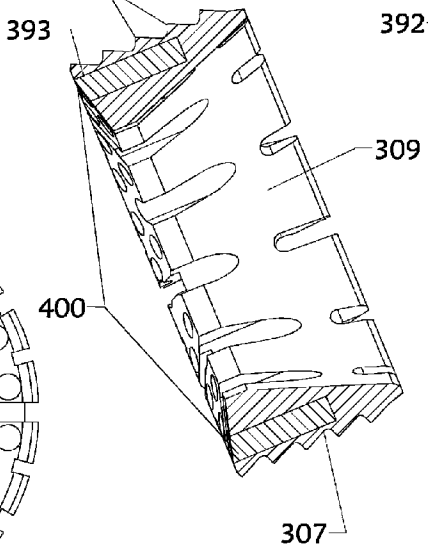
FIG. 5F shows a longitudinal cross-sectional view of a metal slip usable with a downhole tool according to embodiments of the disclosure.
Figure 5E:
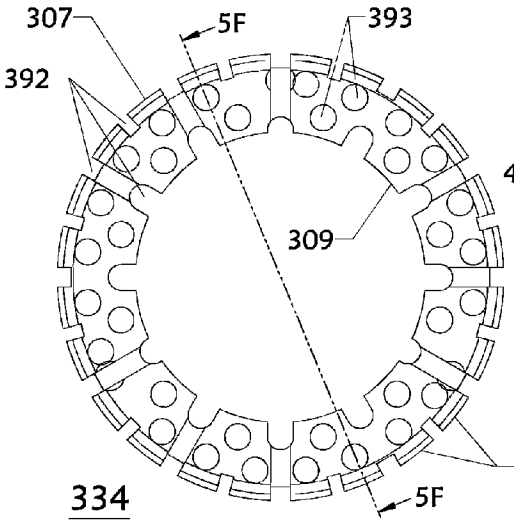
FIG. 5E shows a lateral view of a metal slip usable with a downhole tool according to embodiments of the disclosure.

FIG. 5G illustrates slip 334 may be a hardened cast iron slip without the presence of any grooves or holes 393 formed therein.

Figure 11A:
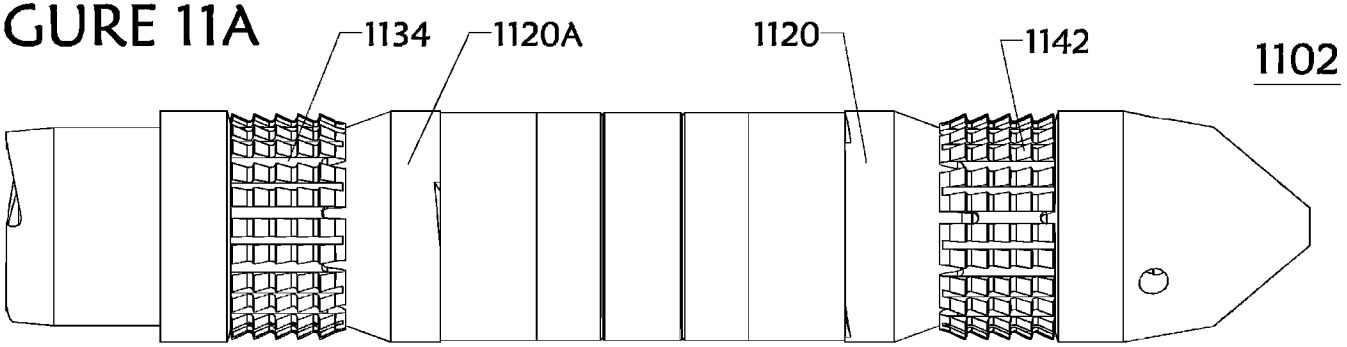
FIG. 11A shows a side longitudinal view of a downhole tool configured with a plurality of composite members and metal slips according to embodiments of the disclosure.
Figure 11B:
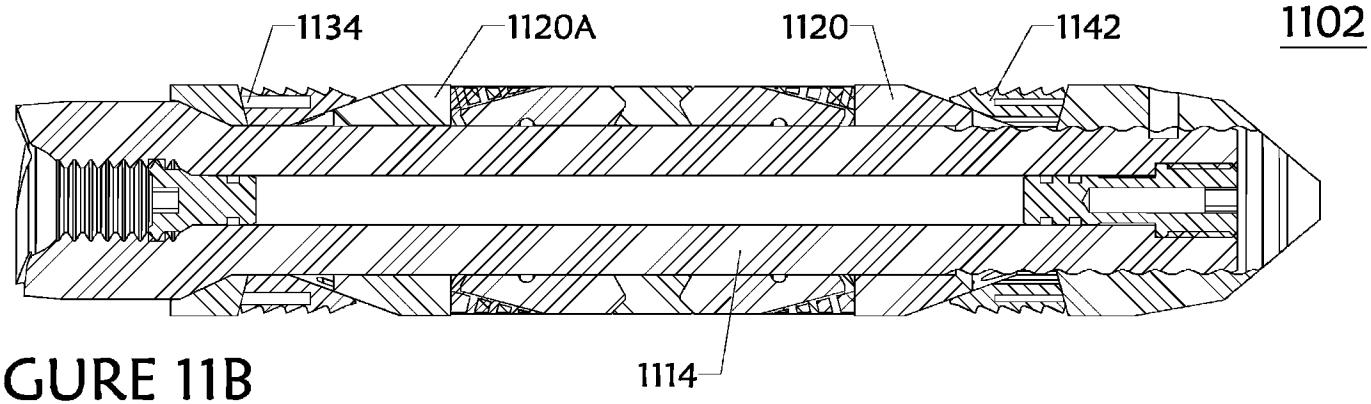
FIG. 11B shows a longitudinal cross-section view of a downhole tool configured with a plurality of composite members and metal slips according to embodiments of the disclosure.

Referring briefly to FIGS. 11A and 11B together, various views of a downhole tool 1102 configured with a plurality of composite members 1120, 1120A and metal slips 1134, 1142, according to embodiments of the disclosure, are shown. The slips 1134, 1142 may be one-piece in nature, and be made from various materials such as metal (e.g., cast iron) or composite. It is known that metal material results in a slip that is harder to drill-thru compared to composites, but in some applications it might be necessary to resist pressure and/or prevent movement of the tool 1102 from two directions (e.g., above/below), making it beneficial to use two slips 1134 that are metal. Likewise, in high pressure/high temperature applications (HP/HT), it may be beneficial/better to use slips made of hardened metal. The slips 1134, 1142 may be disposed around 1114 in a manner discussed herein.

It is within the scope of the disclosure that tools described herein may include multiple composite members 1120, 1120A. The composite members 1120, 1120A may be identical, or they may different and encompass any of the various embodiments described herein and apparent to one of ordinary skill in the art.

Referring again to FIGS. 5A-5C, slip 342 may be a one-piece slip, whereby the slip 342 has at least partial connectivity across its entire circumference. Meaning, while the slip 342 itself may have one or more grooves 344 configured therein, the slip 342 has no separation point in the pre-set configuration. In an embodiment, the grooves 344 may be equidistantly spaced or cut in the second slip 342. In other embodiments, the grooves 344 may have an alternatingly arranged configuration. That is, one groove 344A may be proximate to slip end 341 and adjacent groove 344B may be proximate to an opposite slip end 343. As shown in groove 344A may extend all the way through the slip end 341, such that slip end 341 is devoid of material at point 372.

Where the slip 342 is devoid of material at its ends, that portion or proximate area of the slip may have the tendency to flare first during the setting process. The arrangement or position of the grooves 344 of the slip 342 may be designed as desired. In an embodiment, the slip 342 may be designed with grooves 344 resulting in equal distribution of radial load along the slip 342. Alternatively, one or more grooves, such as groove 344B may extend proximate or substantially close to the slip end 343, but leaving a small amount material 335 therein. The presence of the small amount of material gives slight rigidity to hold off the tendency to flare. As such, part of the slip 342 may expand or flare first before other parts of the slip 342.

The slip 342 may have one or more inner surfaces with varying angles. For example, there may be a first angled slip surface 329 and a second angled slip surface 333. In an embodiment, the first angled slip surface 329 may have a 20-degree angle, and the second angled slip surface 333 may have a 40-degree angle; however, the degree of any angle of the slip surfaces is not limited to any particular angle. Use of angled surfaces allows the slip 342 significant engagement force, while utilizing the smallest slip 342 possible.

The use of a rigid single- or one-piece slip configuration may reduce the chance of presetting that is associated with conventional slip rings, as conventional slips are known for pivoting and/or expanding during run in. As the chance for pre-set is reduced, faster run-in times are possible.

The slip 342 may be used to lock the tool in place during the setting process by holding potential energy of compressed components in place. The slip 342 may also prevent the tool from moving as a result of fluid pressure against the tool. The second slip (342, FIG. 5A) may include inserts 378 disposed thereon. In an embodiment, the inserts 378 may be epoxied or press fit into corresponding insert bores or grooves 375 formed in the slip 342.

Figure 13D:
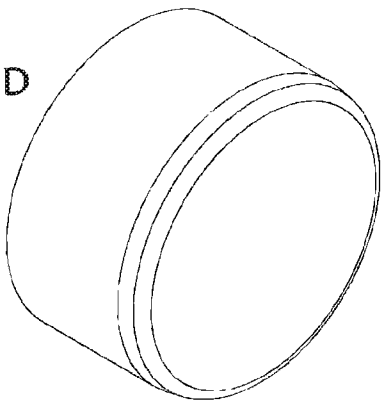
FIG. 13D shows a topside isometric view of an insert(s) usable with a slip(s) according to embodiments of the disclosure.
Figure 13C:
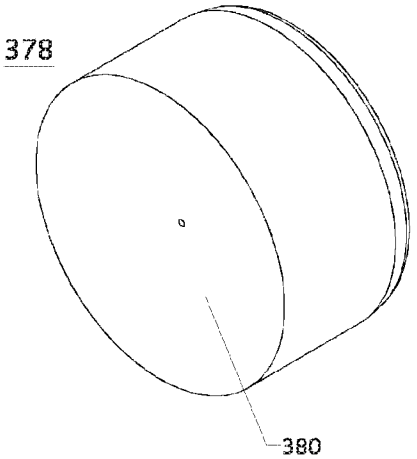
FIG. 13C shows an alternative underside isometric view of an insert usable with a slip(s) according to embodiments of the disclosure.
Figure 13B:
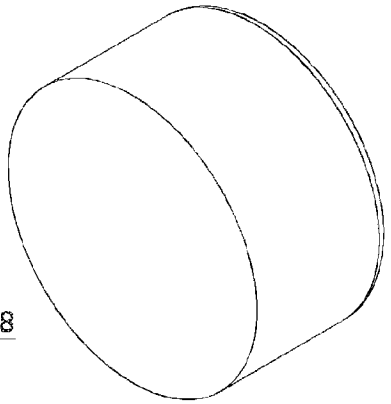
FIG. 13B shows an underside isometric view of an insert usable with a slip(s) according to embodiments of the disclosure.
Figure 13A:
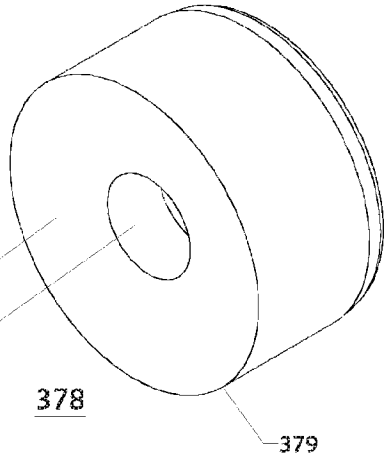
FIG. 13A shows an underside isometric view of an insert(s) configured with a hole usable with a slip(s) according to embodiments of the disclosure.

Referring briefly to FIGS. 13A-13D together, FIG. 13A shows an underside isometric view of an insert(s) configured with a hole usable with a slip(s); FIG. 13B shows an underside isometric view of an insert usable with a slip(s); FIG. 13C shows an alternative underside isometric view of an insert usable with a slip(s); and FIG. 13D shows a topside isometric view of an insert(s) usable with a slip(s); according to embodiments of the disclosure, are shown.

One or more of the inserts 378 may have a flat surface 380A or concave surface 380. In an embodiment, the concave surface 380 may include a depression 377 formed therein. One or more of the inserts 378 may have a sharpened (e.g., machined) edge or corner 379, which allows the insert 378 greater biting ability.

Figure 8A:
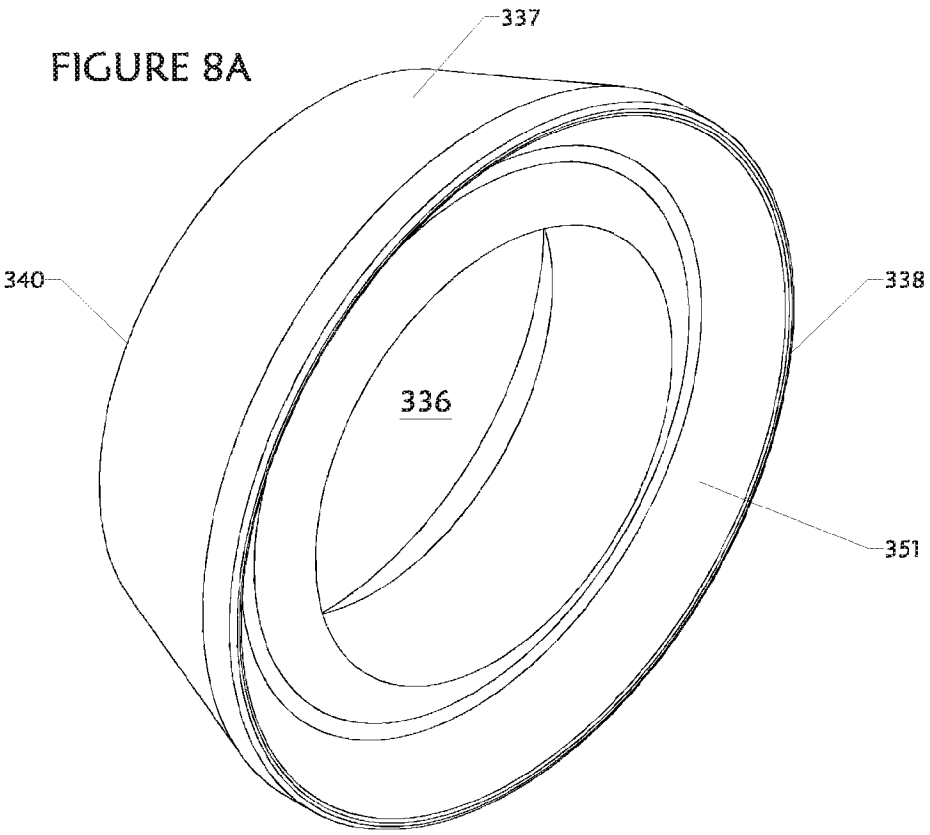
FIG. 8A shows an underside isometric view of a cone usable with a downhole tool according to embodiments of the disclosure.
Figure 8B:
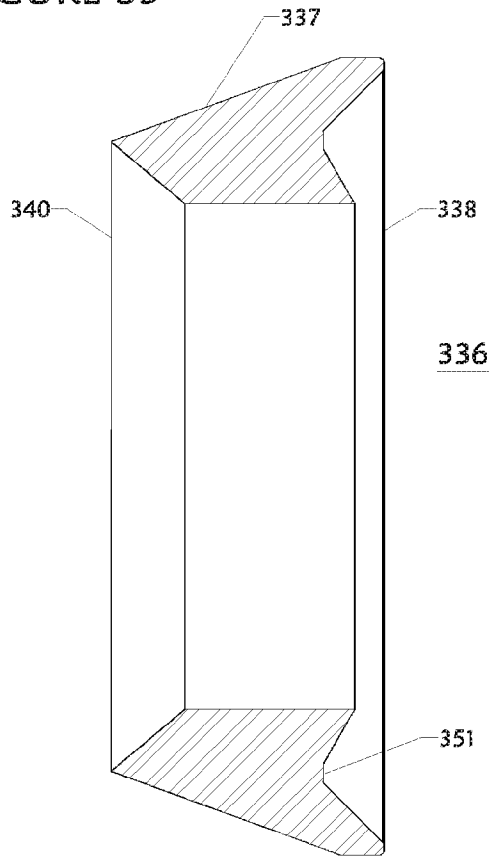
FIG. 8B shows a longitudinal cross-sectional view of a cone usable with a downhole tool according to embodiments of the disclosure.

Referring now to FIGS. 8A and 8B together, an underside isometric view and a longitudinal cross-sectional view, respectively, of one or more cones 336 (and its subcomponents) usable with a downhole tool in accordance with embodiments disclosed herein, are shown. In an embodiment, cone 336 may be slidingly engaged and disposed around the mandrel (e.g., cone 236 and mandrel 214 in FIG. 2C). Cone 336 may be disposed around the mandrel in a manner with at least one surface 337 angled (or sloped, tapered, etc.) inwardly with respect to other proximate components, such as the second slip (242, FIG. 2C). As such, the cone 336 with surface 337 may be configured to cooperate with the slip to force the slip radially outwardly into contact or gripping engagement with a tubular, as would be apparent and understood by one of skill in the art.

During setting, and as tension increases through the tool, an end of the cone 336, such as second end 340, may compress against the slip (see FIG. 2C). As a result of conical surface 337, the cone 336 may move to the underside beneath the slip, forcing the slip outward and into engagement with the surrounding tubular (see FIG. 2A). A first end 338 of the cone 336 may be configured with a cone profile 351. The cone profile 351 may be configured to mate with the seal element (222, FIG. 2C). In an embodiment, the cone profile 351 may be configured to mate with a corresponding profile 327A of the seal element (see FIG. 4A). The cone profile 351 may help restrict the seal element from rolling over or under the cone 336.

Figure 9A:
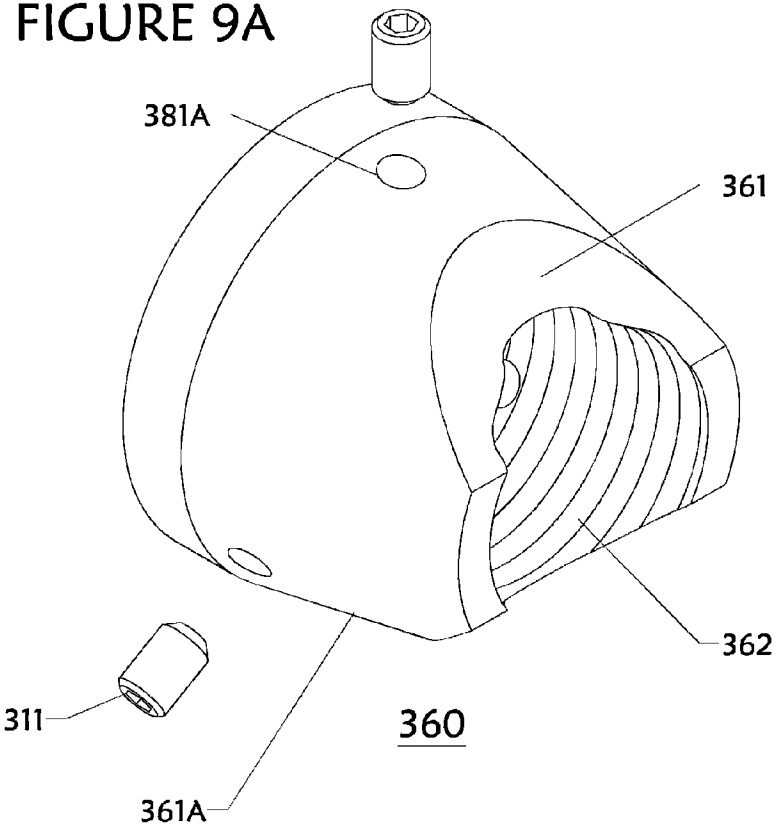
FIG. 9A shows an isometric view of a lower sleeve usable with a downhole tool according to embodiments of the disclosure.
Figure 9B:
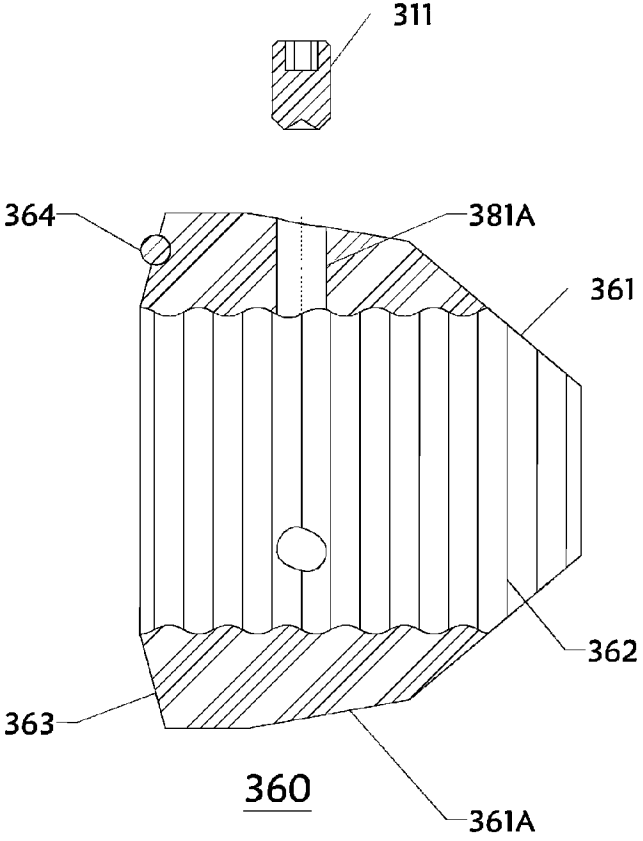
FIG. 9B shows a longitudinal cross-sectional view of the lower sleeve of FIG. 9A, according to embodiments of the disclosure.

Referring now to FIGS. 9A and 9B, an isometric view, and a longitudinal cross-sectional view, respectively, of a lower sleeve 360 (and its subcomponents) usable with a downhole tool in accordance with embodiments disclosed herein, are shown. During setting, the lower sleeve 360 will be pulled as a result of its attachment to the mandrel 214. As shown in FIGS. 9A and 9B together, the lower sleeve 360 may have one or more holes 381A that align with mandrel holes (281B, FIG. 2C). One or more anchor pins 311 may be disposed or securely positioned therein. In an embodiment, brass set screws may be used. Pins (or screws, etc.) 311 may prevent shearing or spin off during drilling.

As the lower sleeve 360 is pulled, the components disposed about mandrel between the may further compress against one another. The lower sleeve 360 may have one or more tapered surfaces 361, 361A which may reduce chances of hang up on other tools. The lower sleeve 360 may also have an angled sleeve end 363 in engagement with, for example, the first slip (234, FIG. 2C). As the lower sleeve 360 is pulled further, the end 363 presses against the slip. The lower sleeve 360 may be configured with an inner thread profile 362. In an embodiment, the profile 362 may include rounded threads. In another embodiment, the profile 362 may be configured for engagement and/or mating with the mandrel (214, FIG. 2C). Ball(s) 364 may be used. The ball(s) 364 may be for orientation or spacing with, for example, the slip 334. The ball(s) 364 and may also help maintain break symmetry of the slip 334. The ball(s) 364 may be, for example, brass or ceramic.

Figure 7A:
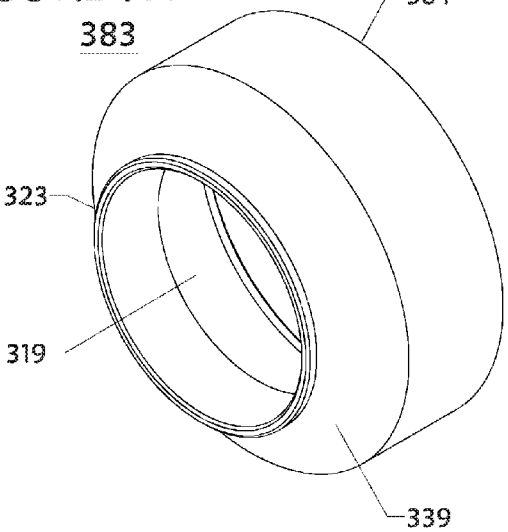
FIG. 7A shows an isometric view of a bearing plate usable with a downhole tool according to embodiments of the disclosure.
Figure 7B:
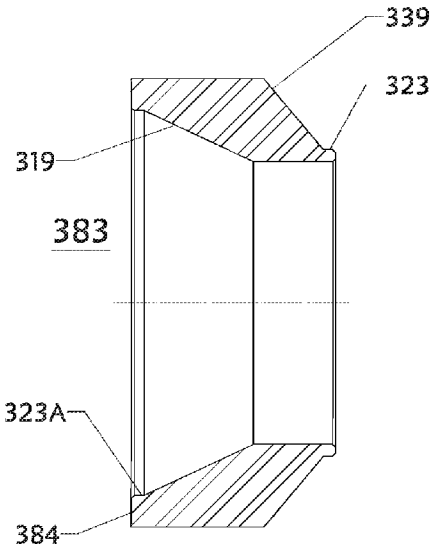
FIG. 7B shows a longitudinal cross-sectional view of a bearing plate usable with a downhole tool according to embodiments of the disclosure.

Referring now to FIGS. 7A and 7B together, an isometric view and a longitudinal cross-sectional view, respectively, of a bearing plate 383 (and its subcomponents) usable with a downhole tool in accordance with embodiments disclosed herein are shown. The bearing plate 383 may be made from filament wound material having wide angles. As such, the bearing plate 383 may endure increased axial load, while also having increased compression strength.

Because the sleeve (254, FIG. 2C) may held rigidly in place, the bearing plate 383 may likewise be maintained in place. The setting sleeve may have a sleeve end 255 that abuts against bearing plate end 284, 384. Briefly, FIG. 2C illustrates how compression of the sleeve end 255 with the plate end 284 may occur at the beginning of the setting sequence. As tension increases through the tool, an other end 239 of the bearing plate 283 may be compressed by slip 242, forcing the slip 242 outward and into engagement with the surrounding tubular (208, FIG. 2B).

Inner plate surface 319 may be configured for angled engagement with the mandrel. In an embodiment, plate surface 319 may engage the transition portion 349 of the mandrel 314. Lip 323 may be used to keep the bearing plate 383 concentric with the tool 202 and the slip 242. Small lip 323A may also assist with centralization and alignment of the bearing plate 383.

Figure 10A:
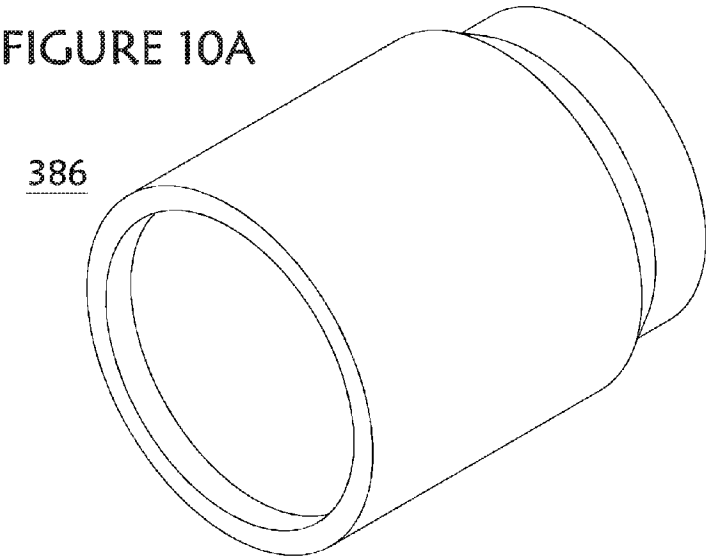
FIG. 10A shows an isometric view of a ball seat usable with a downhole tool according to embodiments of the disclosure.
Figure 10B:
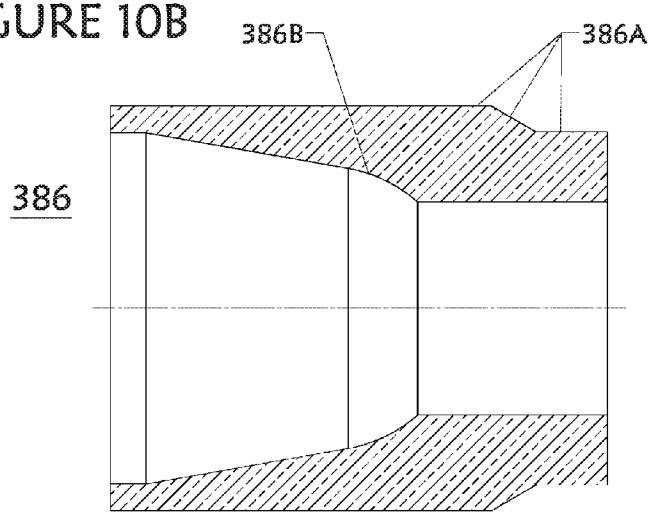
FIG. 10B shows a longitudinal cross-sectional view of a ball seat usable with a downhole tool according to embodiments of the disclosure.

Referring now to FIGS. 10A and 10B together, an isometric view and a longitudinal cross-sectional view, respectively, of a ball seat 386 (and its subcomponents) usable with a downhole tool in accordance with embodiments disclosed herein are shown. Ball seat 386 may be made from filament wound composite material or metal, such as brass. The ball seat 386 may be configured to cup and hold a ball 385, whereby the ball seat 386 may function as a valve, such as a check valve. As a check valve, pressure from one side of the tool may be resisted or stopped, while pressure from the other side may be relieved and pass therethrough.

In an embodiment, the bore (250, FIG. 2D) of the mandrel (214, FIG. 2D) may be configured with the ball seat 386 formed therein. In some embodiments, the ball seat 386 may be integrally formed within the bore of the mandrel, while in other embodiments, the ball seat 386 may be separately or optionally installed within the mandrel, as may be desired. As such, ball seat 386 may have an outer surface 386A bonded with the bore of the mandrel. The ball seat 386 may have a ball seat surface 386B.

The ball seat 386 may be configured in a manner so that when a ball (385, FIG. 3C) seats therein, a flowpath through the mandrel may be closed off (e.g., flow through the bore 250 is restricted by the presence of the ball 385). The ball 385 may be made of a composite material, whereby the ball 385 may be capable of holding maximum pressures during downhole operations (e.g., fracing).

As such, the ball 385 may be used to prevent or otherwise control fluid flow through the tool. As applicable, the ball 385 may be lowered into the wellbore (206, FIG. 2A) and flowed toward a ball seat 386 formed within the tool 202. Alternatively, the ball 385 may be retained within the tool 202 during run in so that ball drop time is eliminated. As such, by utilization of retainer pin (387, FIG. 3C), the ball 385 and ball seat 386 may be configured as a retained ball plug. As such, the ball 385 may be adapted to serve as a check valve by sealing pressure from one direction, but allowing fluids to pass in the opposite direction.

Figure 12A:
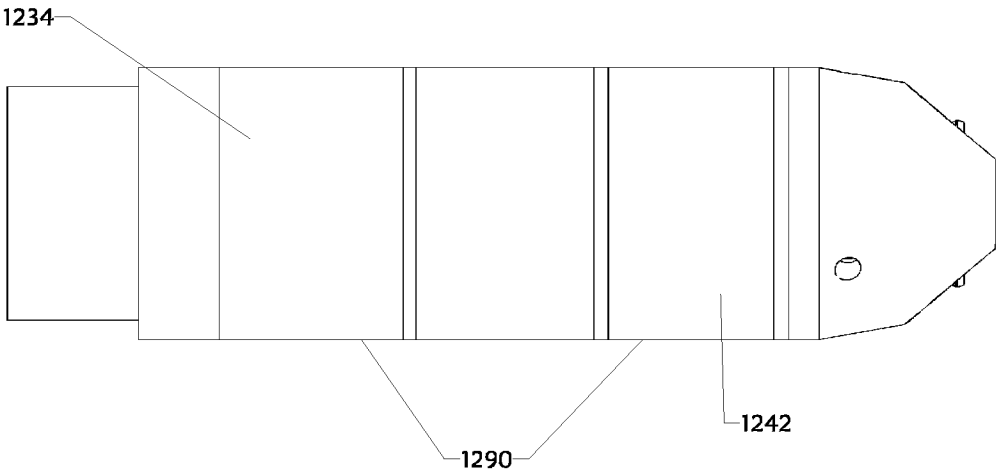
FIG. 12A shows a longitudinal side view of an encapsulated downhole tool according to embodiments of the disclosure.
Figure 12B:
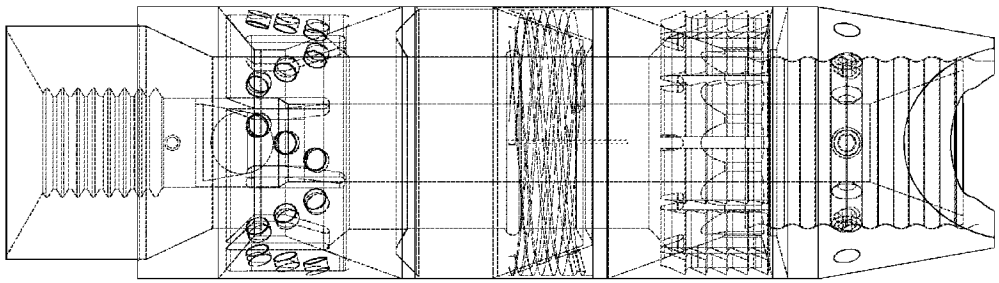
FIG. 12B shows a partial see-thru longitudinal side view of the encapsulated downhole tool of FIG. 12A, according to embodiments of the disclosure.

Referring now to FIGS. 12A and 12B together, FIG. 12A shows a longitudinal side view of an encapsulated downhole tool according to embodiments of the disclosure, and FIG. 12B shows a partial see-thru longitudinal side view of the encapsulated downhole tool of FIG. 12A, according to embodiments of the disclosure;

In embodiments, the downhole tool 1202 of the present disclosure may include an encapsulation. Encapsulation may be completed with an injection molding process. For example, the tool 1202 may be assembled, put into a clamp device configured for injection molding, whereby an encapsulation material 1290 may be injected accordingly into the clamp and left to set or cure for a pre-determined amount of time on the tool 1202 (not shown).

Encapsulation may help resolve presetting issues; the material 1290 is strong enough to hold in place or resist movement of, tool parts, such as the slips 1234, 1242, and sufficient in material properties to withstand extreme downhole conditions, but is easily breached by tool 1202 components upon routine setting and operation. Example materials for encapsulation include polyurethane or silicone; however, any type of material that flows, hardens, and does not restrict functionality of the downhole tool may be used, as would be apparent to one of skill in the art.

Figure 14A:
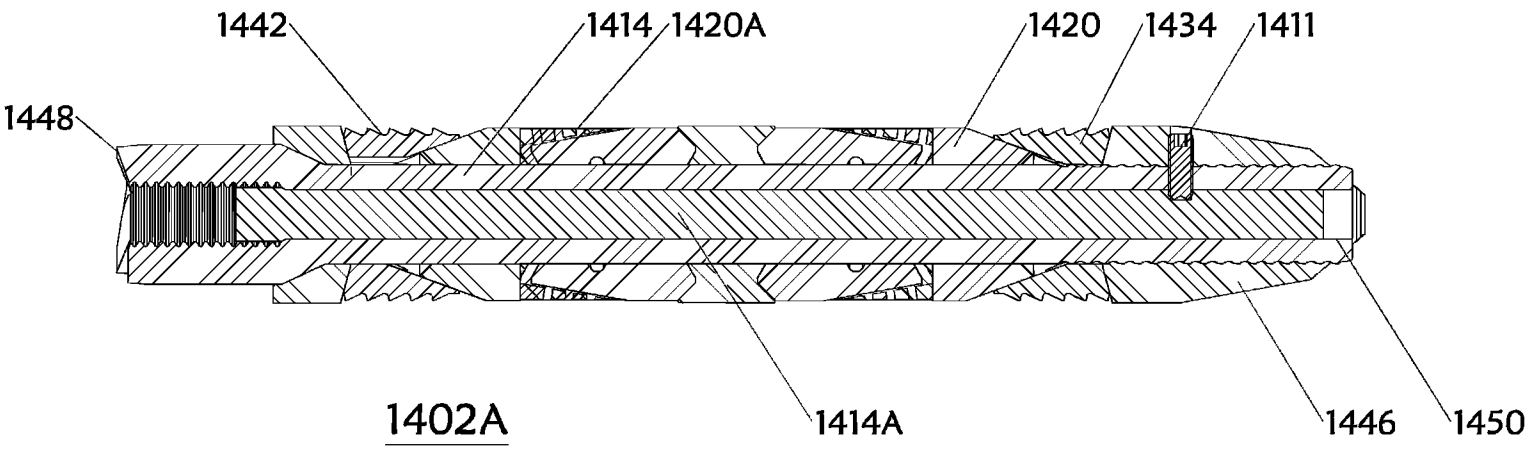
FIG. 14A shows a longitudinal cross-section view of a downhole tool having a dual metal slip and dual composite member configuration according to embodiments of the disclosure.
Figure 14B:
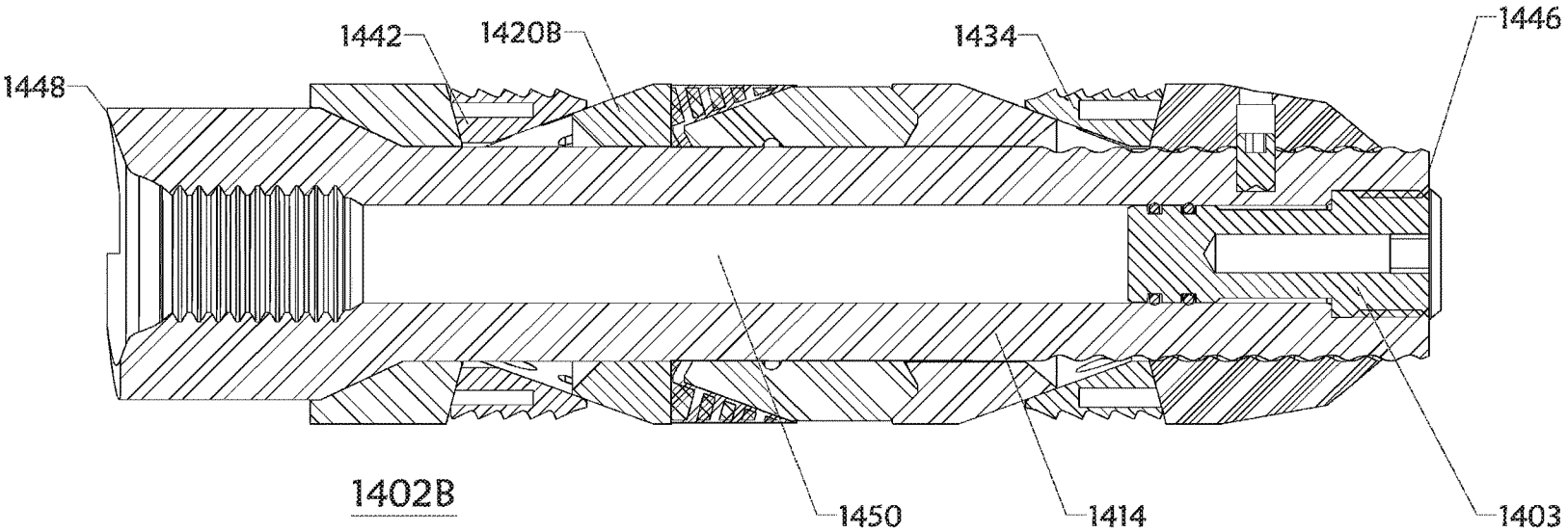
FIG. 14B shows a longitudinal cross-section view of a downhole tool having a dual metal slip configuration according to embodiments of the disclosure.

Referring now to FIGS. 14A and 14B together, longitudinal cross-sectional views of various configurations of a downhole tool in accordance with embodiments disclosed herein, are shown. Components of downhole tool 1402 may be arranged and operable, as described in embodiments disclosed herein and understood to one of skill in the art.

The tool 1402 may include a mandrel 1414 configured as a solid body. In other aspects, the mandrel 1414 may include a flowpath or bore 1450 formed therethrough (e.g., an axial bore). The bore 1450 may be formed as a result of the manufacture of the mandrel 1414, such as by filament or cloth winding around a bar. As shown in FIG. 14A, the mandrel may have the bore 1450 configured with an insert 1414A disposed therein. Pin(s) 1411 may be used for securing lower sleeve 1460, the mandrel 1414, and the insert 1414A. The bore 1450 may extend through the entire mandrel 1414, with openings at both the first end 1448 and oppositely at its second end 1446. FIG. 14B illustrates the end 1448 of the mandrel 1414 may be fitted with a plug 1403.

In certain circumstances, a drop ball may not be a usable option, so the mandrel 1414 may optionally be fitted with the fixed plug 1403. The plug 1403 may be configured for easier drill-thru, such as with a hollow. Thus, the plug may be strong enough to be held in place and resist fluid pressures, but easily drilled through. The plug 1403 may be threadingly and/or sealingly engaged within the bore 1450.

The ends 1446, 1448 of the mandrel 1414 may include internal or external (or both) threaded portions. In an embodiment, the tool 1402 may be used in a frac service, and configured to stop pressure from above the tool 1401. In another embodiment, the orientation (e.g., location) of composite member 1420B may be in engagement with second slip 1442. In this aspect, the tool 1402 may be used to kill flow by being configured to stop pressure from below the tool 1402. In yet other embodiments, the tool 1402 may have composite members 1420, 1420A on each end of the tool. FIG. 14A shows composite member 1420 engaged with first slip 1434, and second composite member 1420A engaged with second slip 1442. The composite members 1420, 1420A need not be identical. In this aspect, the tool 1402 may be used in a bidirectional service, such that pressure may be stopped from above and/or below the tool 1402. A composite rod may be glued into the bore 1450.

Figure 15A:
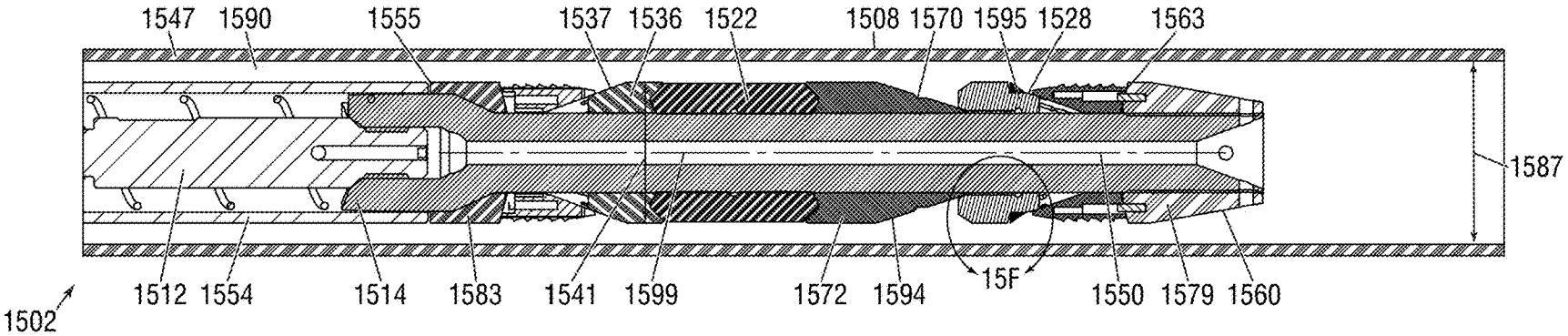
FIG. 15A shows a longitudinal cross-sectional view of a system having a downhole tool configured with a fingered member prior to setting according to embodiments of the disclosure.
Figure 15F:
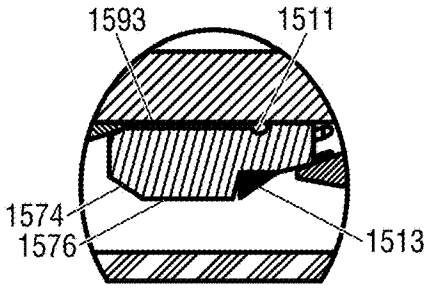
FIG. 15F shows a close-up partial cross-sectional view of the fingered member of FIG. 15A according to emobodiments of the disclosure.
Figure 15B:
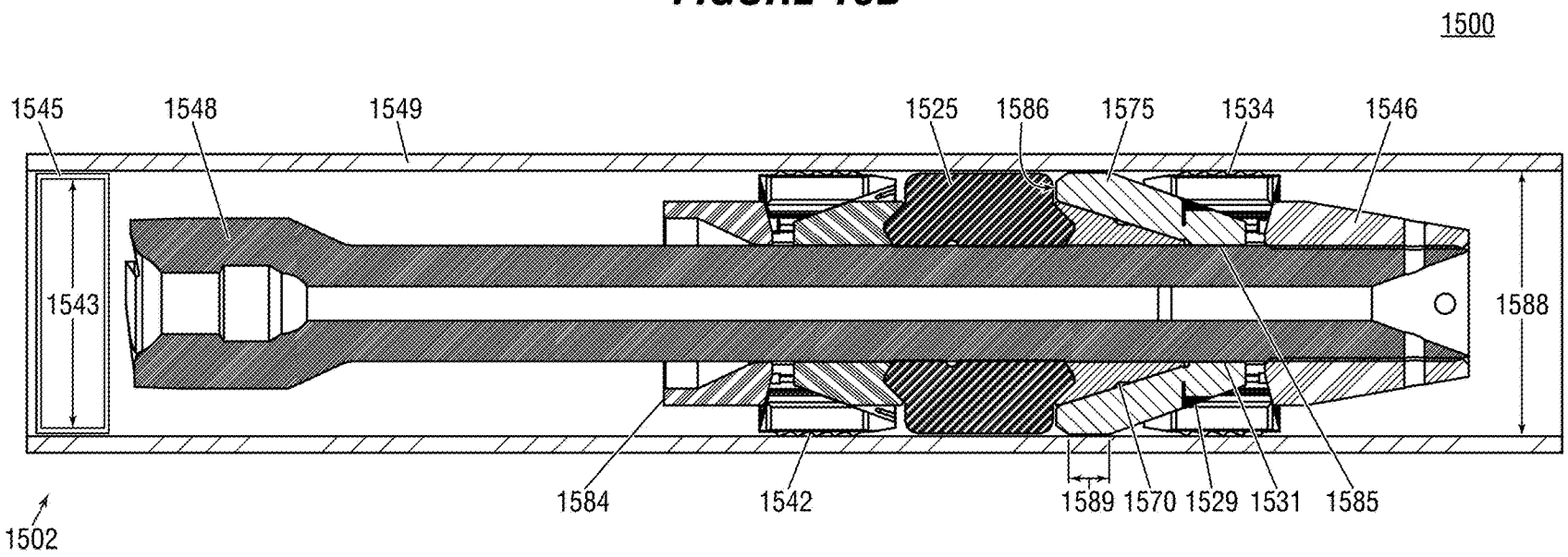
FIG. 15B shows a longitudinal cross-sectional view of the downhole tool of FIG. 15A in a set position according to embodiments of the disclosure.

Referring now to FIGS. 15A and 15B together, a longitudinal cross-sectional view of a system having a downhole tool configured with a fingered member prior to setting; and a longitudinal cross-sectional view of the downhole tool in a set position, illustrative of embodiments disclosed herein, are shown. Downhole tool 1502 may be run, set, and operated as described herein and in other embodiments (such as in System 200), and as otherwise understood to one of skill in the art. A workstring 1512 may be used to position or run the downhole tool 1502 into and through a wellbore to a desired location within a tubular 1508, which may be casing (e.g., casing, hung casing, casing string, etc.).

The downhole tool 1502 may be suitable for variant downhole conditions, such as when multiple ID's are present within tubular 1508. This may occur, for example, where part of the tubular 1508 has been damaged and an "insert" or a patch is positioned within the tubular so that production (or other downhole operation) may still occur or continue. Damage within tubular 1508 may occur with greater likelihood when drilling has resulted in bends in the wellbore. Although examples are described here, there are any number of non-limiting ways (including other forms of a damage) that may ultimately result in the presence of two or more ID's within the tubular 1508, which may be in the form of a narrowing or restriction of some kind, two different ID pipe segments joined together, and so forth.

In order to perform a downhole operation, such as a frac, the tool 1502 must by necessity be operable in a manner whereby it may be moved (or run-in) through a narrowed tubular ID 1543, and yet still be operable for successful setting within a second ID 1588. In an embodiment, the first ID 1587 of a first portion 1547 of the tubular 1508 and a second ID 1588 of a second portion 1549 of the tubular 1508 may be the same. In this respect, a narrowing 1545 (such as by patch or insert) may have a third ID 1543 that is less than the first ID 1587/second ID 1588, and the tool 1502 needs to have a narrow enough run-in OD 1541 to pass therethrough, yet still be functional to properly set within the second portion 1549. In embodiments, the first ID 1587 of the first portion 1547 of the tubular 1508 is smaller than a second ID 1588 of the second portion 1549 of the tubular (where the second portion is further downhole than the first portion). In this respect, the tool 1502 needs to have a narrow enough run-in OD 1541 to pass through the first portion 1547, yet still properly set within the second portion 1549, and properly form a seal 1525 in a tool annulus 1590. The formed seal 1525 may withstand pressurization of greater than 10,000 psi. In an embodiment, the seal 1525 withstands pressurization in the range of about 5,000 psi to about 15,000 psi.

In contrast to a conventional plug, downhole tool 1502 provides the ability to be narrow enough on its OD 1541 to pass through a narrow tubular ID 1543, yet still have an ability to plug/seal an annulus 1590 around the tool 1502.

Accordingly the tool 1502 may have fingered member 1576. Although many configurations are possible, the fingered member 1576 may generally have a circular body (or ring shaped) portion 1595 configured for positioning on or disposal around the mandrel 1514. Extending from the circular body portion may be two or more fingers (dogs, protruding members, etc.) 1577 (see FIG. 15D). In the assembled tool configuration, the fingers 1577 may be referred to as facing "uphole" or toward the top (proximate end) of the tool 1502.

The fingers 1577 may be formed with a finger surface at an angle Φ (with respect to a long axis 1599 of the tool), which may result in a (annular) void space 1593. Fingers 1577 may also be formed with a gap (1581, FIG. 15D) therebetween. The size of the fingers 1577 in terms of width, length, and thickness, and the number of fingers 1577 may be optimized in a manner that results in the greatest ability to fill in or occlude annulus 1590 and provide sufficient support for the sealing element 1522.

During setting, the fingered member 1576 may be urged along a proximate surface 1594 (or vice versa, the proximate surface 1594 may be urged against an underside of the fingered member 1576). The proximate surface 1594 may be an angled surface or taper of cone 1572. Although not shown here, other components may be positioned proximate to the underside (or end 1575) of fingered member 1576, such as a composite member (320, FIG. 6A) or an insert (1699, FIG. 16A). As the fingered member 1576 and the surface 1594 are urged together, the fingers 1577 may be resultantly urged radially outward toward the inner surface of the tubular 1508. One or more ends 1575 of corresponding fingers 1577 may eventually come into contact with the tubular 1508, as shown by contact point 1586. Ends 1575 may be configured (such as by machining) with an end taper 1574.

The use of an end taper 1574 may be multipurpose. For example, if the tool 1502 needs to be removed (or moved uphole) prior to setting, the ends 1575 of the fingers 1577 may be less prone to catching on surfaces as the tool 1502 moves uphole. In addition, the ends 1575 of the fingers 1577 may have more surface area contact with the tubular 1508, as illustrated by a length 1589 of contact surfaces (at contact point 1586).

The surface 1594 may be smooth and conical in nature, which may result in smooth, linear engagement with the fingered member 1576. In other aspects, the surface 1594 may be configured with a detent (or notch) 1570. In the assembled position, the ends 1575 of the fingers 1577 may reside or be positioned within the detent 1570. The arrangement of the ends 1575 within the detent 1570 may prevent inadvertent operation of the fingered member 1576. In this respect, a certain amount of setting force is required to "bump" the ends of the fingers 1577 out of and free of the detent 1570 so that the fingered member 1576 and the surface 1594 can be urged together, and the fingers 1577 extended outwardly.

The mandrel 1514 may include one or more sets of threads. In embodiments, the distal end 1546 may include an outer surface configured with rounded threads. In embodiments, the proximate end 1548 may include an inner surface along the bore 1550 configured with shear threads.

The fingered member 1576 may be disposed around the mandrel 1514. In particular, the circular (or ring) shape body 1595 may be configured for positioning onto or around the mandrel 1514. In an assembled configuration, the cone (or first conical shaped member) 1572 may be disposed around the mandrel 1514, and in engagement with ends 1575 and/or an underside (see 1597, FIG. 15D) of the fingered member 1577. In embodiments, the cone may be (or may be substituted as) the composite member (320, FIG. 6A). In this respect, the cone or first conical member 1572 may have a resilient portion and a deformable portion, whereby the resilient portion may be engaged with the underside. However, the first conical shaped member 1572 is not meant to be limited, and need only be that which includes a surface suitable for urging fingers 1577 radially outward as the cone 1572 and fingered member 1576 are urged together.

The fingered member 1576 may include a plurality of fingers 1577. In embodiments, there may be a range of about 6 to about 10 fingers 1577. The fingers 1577 may be configured for at least partially blocking the annulus 1590 around the tool (or "tool annulus"), and providing adequate support (or backup) to the sealing element 1522 upon its extrusion into the annulus 1590, as illustrated in FIG. 15B. The fingers 1577 may be configured symmetrically and equidistantly to each other. As the fingers 1577 are urged outwardly they may provide a synergistic effect of centralizing the downhole tool 1502, which may be of greater benefit in situations where the second portion 1549 of the tubular 1508 has a horizontal orientation.

The fingered member 1576 may be referred to as having a "transition zone" 1510, essentially being the part of the member where the fingers 1577 begin to extend away from the body 1595. In this respect, the fingers 1577 are connected to or integral with the body 1595. In operation as the fingers 1577 are urged radially outward, a flexing (or partial break or fracture) may occur within the transition zone 1510. The transition zone 1510 may include an outer surface 1529 and inner surface 1531. The outer surface 1529 and inner surface 1531 may be separated by a portion or amount of material 1585. The fingered member 1576 may be configured so that the flexing, break or fracture occurs within the material 1585. Flexing or fracture may be induced within the material as a result of one or more grooves. For example, the inner surface 1531 may have a first finger groove 1511. The outer surface 1529 may in addition or alternatively have a finger groove, such as a second finger groove 1513. Briefly, FIG. 15F illustrates a close-up partial cross-sectional view of the fingered member 1575, with material (1585) between first and second finger grooves 1511, 1513.

Returning again to FIGS. 15A-15B, the presence of the material 1585 may provide a natural "hinge" effect whereby the fingers 1577 become moveable from the body (ring) 1595, such as when the fingered member 1576 is urged against surface 1594. After setting one or more fingers 1577 may remain at least partially connected with body 1595 in the transition zone 1510. The presence of the material 1585 may promote uniform flexing of the fingers 1577. The presence of material 1585 may also ensure enough strength within the member 1576 to support or limit the extrusion of the sealing element 1522 and subsequent downhole pressure load. The length of the fingers 1577 and/or amount of material 1585 are operational variables that may be modified to suit a particular need for a respective annulus size.

As shown in the Figures, the downhole tool 1502 may include other components, such as a first slip 1534; a second slip 1542; a bearing plate 1583; a second conical member (or cone) 1536; and a lower sleeve 1560 threadingly engaged with the mandrel 1514 (e.g., threaded connection 1579).

Components of the downhole tool 1502 may be arranged and disposed about the mandrel 1514, as described herein and in other embodiments, and as otherwise understood to one of skill in the art. Thus, downhole tool 1502 may be comparable or identical in aspects, function, operation, components, etc. as that of other tool embodiments provided for herein, and redundant discussion is limited for sake of brevity, while structural (and functional) differences are discussed in with detail, albeit in a non-limiting manner.

The tool 1502 may be deployed and set with a conventional setting tool (not shown) such as a Model 10, 20 or E-4 Setting Tool available from Baker Oil Tools, Inc., Houston, Tex. Once the tool 1502 reaches the set position within the tubular 1508, the setting mechanism or workstring 1512 may be detached from the tool 1502 by various methods, resulting in the tool 1502 left in the surrounding tubular and one or more sections of the wellbore isolated (and seal 1525 formed within the annulus 1590). In an embodiment, once the tool 1502 is set, tension may be applied to the adapter (if present) until the connection (e.g., threaded connection) between the adapter and the mandrel 1514 is broken.

The downhole tool 1502 may include the mandrel 1514 that extends through the tool (or tool body) 1502. The mandrel 1514 may be a solid body. In other aspects, the mandrel 1514 may include a flowpath or bore 1550 formed therein (e.g., an axial bore), which may extend partially or for a short distance through the mandrel 1514. As shown, the bore 1550 may extend through the entire mandrel 1514, with an opening at its proximate (or top) end 1548 and oppositely at its distal (or bottom) end 1546 (near downhole end of the tool 1502).

The workstring 1512 and setting sleeve 1554 may be part of the plugging tool system 1500 utilized to run the downhole tool 1502 into the wellbore, and activate the tool 1502 to move from an unset to set position. The set position may include seal element 1522 and/or slips 1534, 1542 engaged with the tubular 1508. In an embodiment, the setting sleeve 1554 may be utilized to force or urge compression and swelling (extrusion) of the seal element 1522 into sealing engagement with the surrounding tubular 1508.

When the setting sequence begins, the mandrel 1514 may be pulled into tension while the setting sleeve 1554 remains stationary. The lower sleeve 1560 may be pulled as well because of its attachment to the mandrel 1514 by virtue of the coupling of threads (or threaded connection) 1579.

As the lower sleeve 1560 is pulled toward the setting sleeve 1554, the components disposed about mandrel 1514 between the lower sleeve 1560 and the setting sleeve 1554 may begin to compress against one another resulting in setting forces (Fs). This force(s) and resultant movement causes compression and expansion of seal element 1522. The lower sleeve 1560 may also have an angled sleeve end 1563 in engagement with the slip 1534, and as the lower sleeve 1560 is pulled, the end 1563 compresses against the slip 1534. As a result, slip(s) 1534 may move along a tapered or angled surface 1528 of the fingered member 1576, and eventually radially outward into engagement with the surrounding tubular 1508.

Initially, the seal element 1522 may swell into contact with the tubular, followed by further tension in the tool 1502 that may result in the cone 1572 and fingered member 1576 being compressed together, such that surface 1594 acts on the interior surface (or underside) 1597. Additional tension or load may be applied to the tool 1502 that results in movement of cone 1536, which may be disposed around the mandrel 1514 in a manner with at least one surface 1537 angled (or sloped, tapered, etc.) inwardly of second slip 1542. The second slip 1542 may reside adjacent or proximate to collar or cone 1536. As such, the seal element 1522 forces the cone 1536 against the slip 1542, moving the slip 1542 radially outwardly into contact or gripping engagement with the tubular 1508. Accordingly, the one or more slips 1534, 1542 may be urged radially outward and into engagement with the tubular 1508. In an embodiment, cone 1536 may be slidingly engaged and disposed around the mandrel 1514. As shown, the first slip 1534 may be at or near distal end 1546, and the second slip 1542 may be disposed around the mandrel 1514 at or near the proximate end 1548. It is within the scope of the disclosure that the position of the slips 1534 and 1542 may be interchanged. Moreover, slip 1534 may be interchanged with a slip comparable to slip 1542, and vice versa. Although slips 1534, 1542 may be of an identical nature (e.g., hardened cast iron), they may be different (e.g., one slip made of composite, and the other slip made of composite material). One or both of slips 1534, 1542 may have a one-piece configuration in accordance with embodiments disclosed herein.

Because the sleeve 1554 is held rigidly in place, the sleeve 1554 may engage against a bearing plate 1583 that may result in the transfer load through the rest of the tool 1502. The setting sleeve 1554 may have a sleeve end 1555 that abuts against the bearing plate end 1584. As tension increases through the tool 1502, an end of the cone 1536, such as second end 1540, compresses against slip 1542, which may be held in place by the bearing plate 1583. As a result of cone 1536 having freedom of movement and its conical surface 1537, the cone 1536 may move to the underside beneath the slip 1542, forcing the slip 1542 outward and into engagement with the surrounding tubular 1508.

On occasion there may be a need for a narrow tool OD. In such an instance, a composite mandrel may ultimately be insufficient—that is, a narrow tool OD requires smaller components, including a narrower/smaller mandrel. A composite mandrel can only be reduced so far in its size and dimensions before it may be ill-suited to withstand downhole conditions and setting forces. Accordingly, a metal mandrel may be used—that is, a mandrel made of a metallic material. The metal or metallic material be any such material suitable for fabricating a mandrel useable in a narrow tool OD application.

Figure 18:
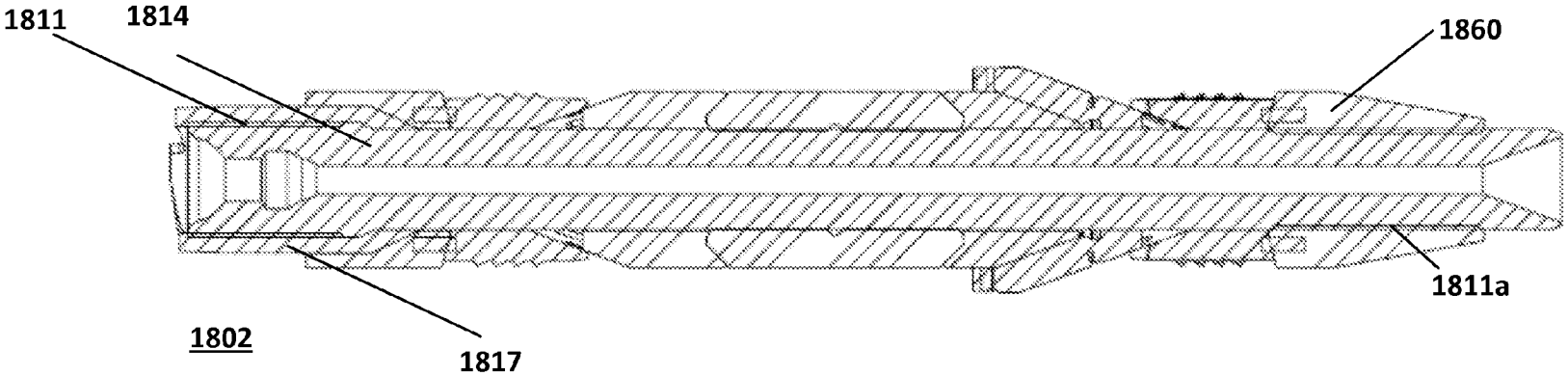
FIG. 18 shows a longitudinal cross-sectional view of a hybrid downhole tool having a metal mandrel and composite material components disposed thereon according to embodiments of the disclosure.

Referring now to FIG. 18, a longitudinal cross-sectional view of a hybrid downhole tool having a metal mandrel with composite components thereon, illustrative of embodiments disclosed herein, is shown.

Downhole tool 1802 may be run, set, and operated as described herein and in other embodiments (such as in Systems 200, 1500, etc.), and as otherwise understood to one of skill in the art. As downhole tool 1802 resembles tool 1502 in many ways, discussion directed to components, assembly, run in, setting, etc. is limited in order to avoid redundancy; however, that does not mean that tool 1802 is meant to be limited to embodiments like that of 1802, as other embodiments and configurations are possible, as would be apparent to one of skill in the art.

One particular area of distinction the presence of a metal mandrel 1814. As shown here, instead of an integral proximate end configured for mounting tool components thereon, a threadable ring 1817 may be threadingly engaged around the end of the mandrel 1814.

In embodiments, the mandrel 1814 may be made of materials such as aluminum, degradable metals and polymers, degradable composite metal, fresh-water degradable metal, and brine degradable metal. The metal material may be like that produce by Bubbletight, LLC of Needville, Tex., as would be apparent to one of skill in the art, including fresh-water degradable composite metal, ambient-temperature fresh-water degradable composite metal, ambient-temperature fresh-water degradable elastomeric polymer, and high-strength brine-degradable composite metal.

It may be more practicable to manufacture a metal rod, and machine on threads 1811, 1811*a*. Then, lower sleeve 1860 and ring 1817 may be threaded on the mandrel 1814, with other components positioned therebetween.

Figure 15E:
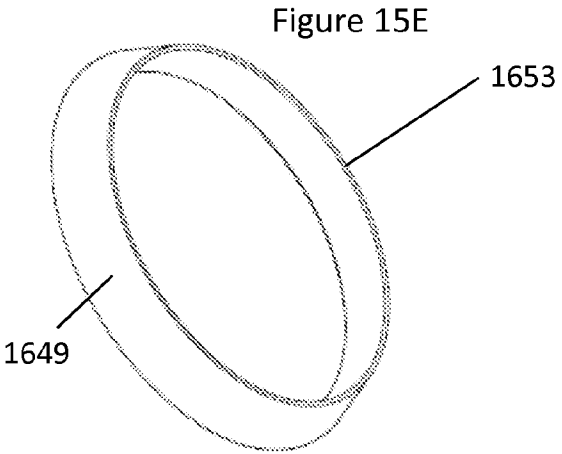
FIG. 15E shows an isometric view of a band (or ring) according to embodiments of the disclosure.
Figure 15C:
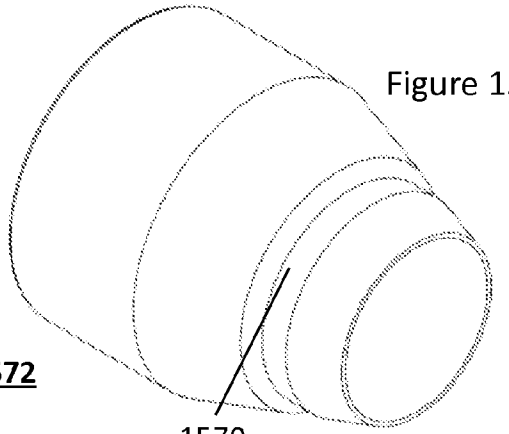
FIG. 15C shows an isometric view of a fingered member according to embodiments of the disclosure.
Figure 15D:
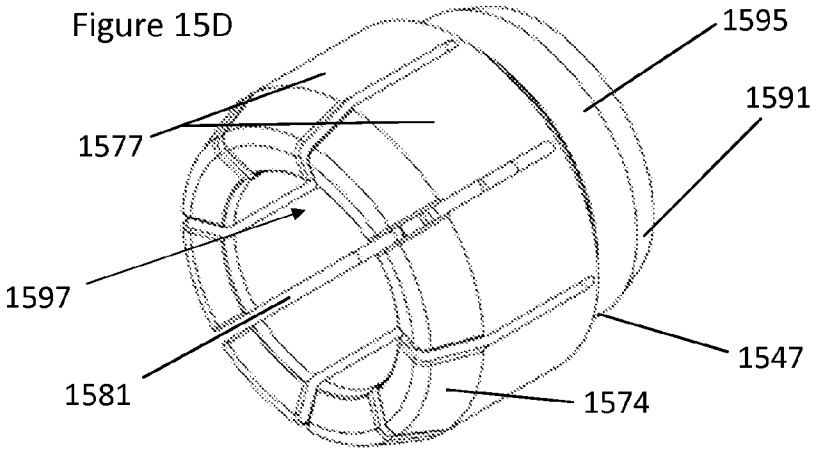
FIG. 15D shows an isometric view of a conical member according to embodiments of the disclosure.

Referring briefly to FIGS. 15C, 15D, and 15E together, an isometric view of a fingered member, an isometric view of a conical member, and an isometric view of a band (or ring), respectively, are shown.

Figure 16A:
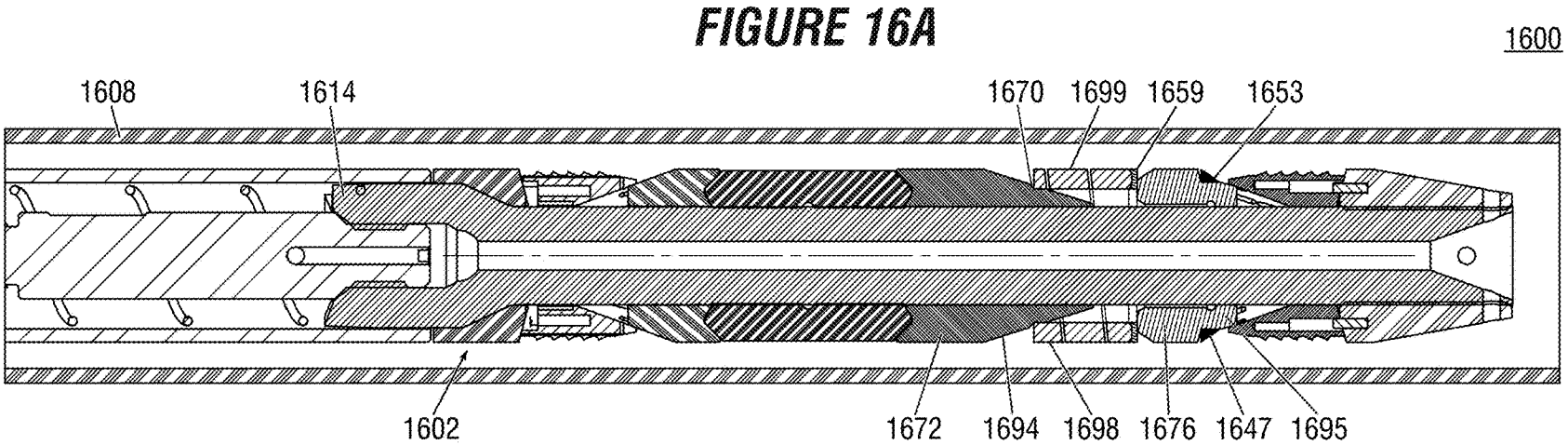
FIG. 16A shows a longitudinal cross-sectional view of a system having a downhole tool configured with a fingered member and an insert according to embodiments of the disclosure.
Figure 16B:
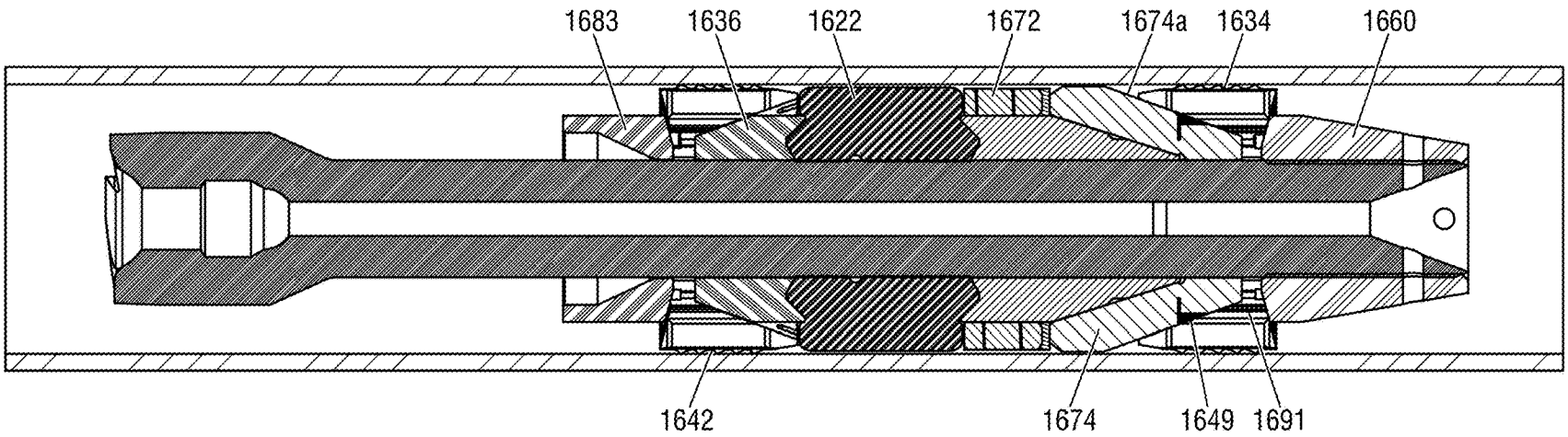
FIG. 16B shows a longitudinal cross-sectional view of the downhole tool of FIG. 16A in a set position according to embodiments of the disclosure.

Referring now to FIGS. 16A and 16B together, a longitudinal cross-sectional view of a system having a downhole tool configured with a fingered member and an insert; and a longitudinal cross-sectional view of the downhole tool in a set position, respectively, illustrative of embodiments disclosed herein, are shown. Downhole tool 1602 may be run, set, and operated as described herein and in other embodiments (such as in Systems 200, 1500, etc.), and as otherwise understood to one of skill in the art. As downhole tool 1602 resembles tool 1502 in many ways, discussion directed to components, assembly, run in, setting, etc. is limited in order to avoid redundancy; however, that does not mean that tool 1602 is meant to be limited to embodiments like that of 1502, as other embodiments and configurations are possible, as would be apparent to one of skill in the art.

One particular area of distinction the presence of an interim component disposed around a mandrel 1614, and between a cone 1672 and a fingered member 1676. As shown here, a ring-shaped "insert" 1699 may be used.

Figure 19B:
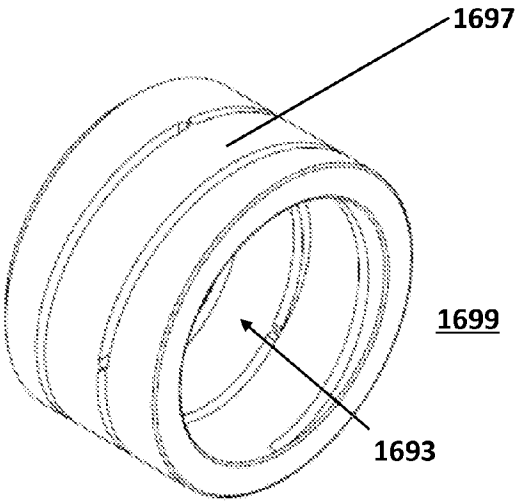
FIG. 19B shows an isometric view of the insert of FIG. 19A according to embodiments of the disclosure.
Figure 19A:
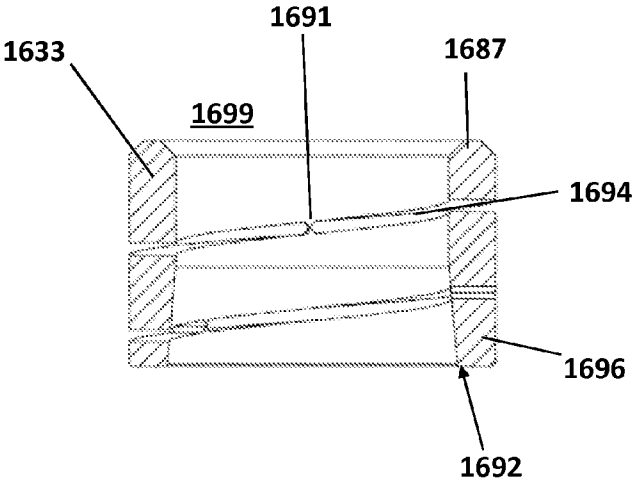
FIG. 19A shows a cross-sectional view of an insert according to embodiments of the disclosure.
Figure 19C:
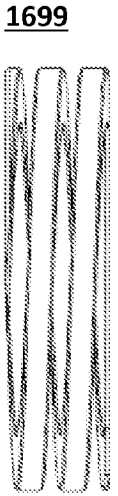
FIG. 19C shows a longitudinal body view of an insert variant according to embodiments of the disclosure.

Referring briefly to FIGS. 19A and 19B, a cross-sectional view, and an isometric view, respectively, of an insert, in accordance with embodiments disclosed herein, are shown. The insert 1699 may have a circular body 1697, having a first end 1696 and a second end 1633.

A groove or winding 1694 may be formed between the first end 1696 and the second end 1633. As the insert 1699 may be ring-shaped, there may be a hollow 1693 in the body 1697. Accordingly, the insert 1699 may be configured for positioning onto and/or around a mandrel (1614, FIG. 16A). The use of the groove 1694 may be beneficial as while it is desirous for insert 1699 to have some degree of rigidity, it is also desirous for the insert 1699 to expand (unwind, flower, etc.) beyond the original OD of the tool.

In this respect, the insert 1699 may be made of a low elongation material (e.g., physical properties of ~100% elongation). Insert 1699 material may be glass or carbon fiber or nanocarbon/nanosilica reinforced. The insert 1699 may durable enough to withstand compressive forces, but still expand or otherwise unwind upon being urged outwardly by the cone (1672, FIG. 16A). The insert 1699 may be made of PEEK (polyether ether ketone).

The groove 1694 may be continuous through the body 1697. However, the groove 1694 may be discontinuous, whereby a plurality of grooves are formed with (or otherwise defined by) a material portion 1691 present between respective grooves. The groove(s) 1694 may be helically formed in nature resulting in a 'spring-like' insert. An edge 1692 of the first end 1696 may be positioned within notch or detent (1670 of the cone 1672, FIG. 16A). Although not shown, a filler may be disposed within the groove(s) 1694. Use of the filler may help provide stabilization to the tool 1602 (and its components) during run-in. In embodiments, the filler may be made of silicone.

Figure 17A:
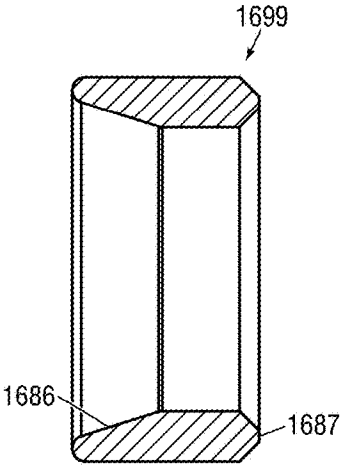
FIG. 17A shows a cross-sectional view a solid annular insert according to embodiments of the disclosure.
Figure 17B:
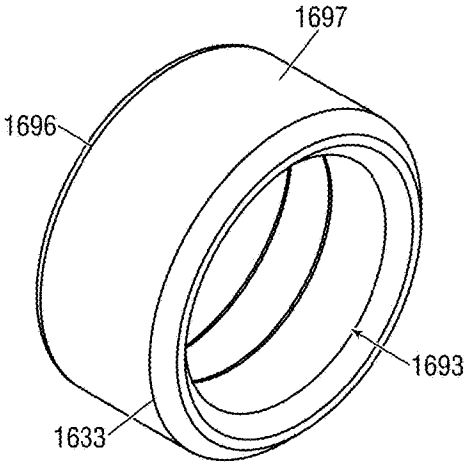
FIG. 17B shows an isometric view of the solid annular insert of FIG. 17A according to embodiments of the disclosure.

In an embodiments, the insert 1699 may have a solid ring body without the presence of a groove(s), as shown in FIGS. 17A and 17B. Referring back to FIGS. 19A and 19B, as the insert 1699 may be ring-shaped, there may be a hollow 1693 in the body 1697. Accordingly, the insert 1699 may be configured for positioning onto and/or around a mandrel (1614, FIG. 16A).

Referring again to FIGS. 16A and 16B, although its structure is not limited to its depiction here, the fingered member 1676 may generally have a circular body (or ring shaped) portion 1695 configured for positioning on or disposal around the mandrel 1614.

During setting, the fingered member 1676 may be urged along a proximate surface 1694 (or vice versa, the proximate surface 1694 may be urged against an underside of the fingered member 1676). The proximate surface 1694 may be an angled surface or taper of cone 1672.

Although insert 1699 may initially be between the fingered member 1676 and cone 1672, the insert 1699 will eventually compress, thereby allowing fingered member 1676 to contact the angled surface 1694. As the fingered member 1676 and the surface 1694 are urged together, the fingers (1577, FIG. 15D) may resultantly be urged outwardly toward the inner surface of the tubular 1608, as illustrated in FIG. 16B.

The configuration of the downhole tool 1602 provides the ability for the insert 1699 to be transitioned from its initial state of a first diameter (e.g., FIG. 16A) to its expanded state of a second diameter (e.g., FIG. 16B), and ultimately support the expansion or limit the extrusion of the sealing element 1622, resulting in a tool that has an effective increase in its OD.

Downhole tool 1602 may include sacrificial member (or barrier ring) 1659 disposed between the insert 1699 and the fingered member 1676. Sacrificial member 1659 may be made of a high elongation material (e.g., physical properties of ~200% elongation or greater).

Figure 17C:
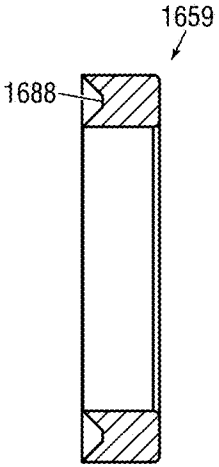
FIG. 17C shows a cross-sectional view a sacrificial ring member according to embodiments of the disclosure.
Figure 17D:
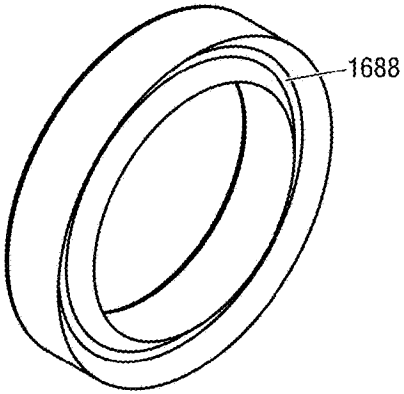
FIG. 17D shows an isometric view of the sacrificial ring member of FIG. 17C according to embodiments of the disclosure.

FIGS. 17C and 17D show a longitudinal cross-sectional view and an isometric view of the sacrificial member 1659. Referring briefly to FIGS. 19A and 17C together, the sacrificial member 1659 may be ring shaped, and configured for engagement (e.g., assembly configuration) with the insert 1699. The sacrificial member 1659 may be generally ring shaped, and configured for engagement with second end 1633. In aspects, the second end 1633 of the insert 1699 may have a lip 1687 configured to engage a recess (cavity, etc.) 1688 of the sacrificial member 1659.

The sacrificial member 1659 may be made of a pliable, high elongation material. An analogous comparison is that the insert 1699 material may be comparable to tire rubber, whereas the sacrificial member 1689 material may be comparable to rubber band rubber.

The sacrificial member 1659 may be useful for "buffering" the compressive forces that would otherwise be incurred by the insert 1699 and possibly causing undesired local elongation, where the insert 1699 could exceed its elongation limit and fail.

Referring again to FIGS. 16A and 16B, the use of the insert 1699 and sacrificial member 1689 may be useful/beneficial to prevent inadvertent tearing or fracturing in the insert 1699 as a result of what would otherwise be direct contact between finger ends 1675 and end 1696 of the insert 1699.

Downhole tool 1602 may include a cone ring or band 1653 (see also FIG. 15E). The cone ring 1653 may be ring shaped in nature and configured for fitting around body 1695. The cross-section of the cone ring 1653 may be triangular in shape. Although not limited to any particular material, the cone ring 1653 may be made of a durable, easily drillable material, such as aluminum. Accordingly the body 1695 may be configured in a manner whereby the cone ring 1653 may be disposed thereon. As shown in FIG. 16B, when the fingers (1577, FIG. 15D) are expanded, fingers surface(s) 1574*a*, cone ring surface 1649, and body taper 1651 (of body 1695) form a generally linear and continuous surface for slip 1634 to slidingly engage thereon. The presence of smooth continuity between surfaces may help ensure proper setting of slip 1634.

The downhole tool 1602 may include other components, such as a second slip 1642; a bearing plate 1683; a second conical member (or cone) 1636; and a lower sleeve 1660. Components of the downhole tool 1602 may be arranged and disposed about the mandrel 1614, as described herein and in other embodiments, and as otherwise understood to one of skill in the art. Thus, downhole tool 1602 may be comparable or identical in aspects, function, operation, components, etc. as that of other tool embodiments provided for herein, and redundant discussion is limited for sake of brevity, while structural (and functional) differences are discussed with detail, albeit in a non-limiting manner.

It is within the scope of the disclosure that the fingered member 1676 (or 1576, etc.) may be of a hybrid composite construction. That is, the ring body 1695 may be made of S-glass (or S2-glass), which is commonly understood as a high-Strength, stronger and stiffer material (with higher elastic modulus) as compared to an E-glass. This material may be formed at a desired wind angle to result in a composite material construction that has comparable physical properties to that of aluminum. That is, the more axial tilt in the wind angle, the lower radial load. In contrast, the more tangential the tilt, the greater the radial strength.

This added strength may be useful for supporting (or otherwise withstanding) forces incurred from the slip 1634 as the slip is urged into contact with the ring body 1695 and into engagement with the tubular 1608.

Instead of this material, the fingers (1577, FIG. 15D) may be made of electric or "E-glass". The material of the fingers may be formed at a second wind angle. This may provide for part of the fingered member 1676 having greater flexibility. In some respect, this results in the ring body 1695 being more of a purposeful resilient portion, and the fingers being more of a purposeful deformable portion.

Components of embodiments disclosed herein may be made from a combination of injection molding and machining.

Embodiments of the disclosure pertain to a method for performing a downhole operation in a tubular that includes various steps such as running a downhole tool through a first portion of the tubular; continuing to run the downhole tool until arriving at a position within a second portion of the tubular; and setting the downhole tool within the second portion. In particular, the first portion may include a first inner diameter that is smaller than a second inner diameter of the second portion.

In accordance with the method(s), the downhole tool may include a mandrel comprising one or more sets of threads; a fingered member disposed around the mandrel; and a first conical shaped member also disposed around the mandrel and in engagement with an underside of the fingered member, wherein the fingered member comprises a plurality of fingers configured for at least partially blocking a tool annulus.

The downhole tool of the method may further include a first slip; a second slip; a bearing plate; a second conical member; a sealing element; and a lower sleeve threadingly engaged with the mandrel. The first conical member may include a detent. Ends of the respective plurality of fingers may be positioned within the detent. The detent may be circumferential around a conical surface of the first conical member. The first conical member may include a resilient portion and a deformable portion. The resilient portion may be engaged with the underside. The resilient portion may include a detent. Ends of the respective plurality of fingers are positioned within the detent. One or more ends of respective fingers may have an outer tapered surface. One or more fingers may have an outer surface and an inner surface. A first finger groove may be disposed within the outer surface. A second finger groove may be disposed within the inner surface. One or more components of the tool may be made from a material that includes one or more of filament wound material, fiberglass cloth wound material, and molded fiberglass composite.

The downhole tool of the method is selected from a group consisting of a frac plug and a bridge plug.

Advantages. Embodiments of the downhole tool are smaller in size, which allows the tool to be used in slimmer bore diameters. Smaller in size also means there is a lower material cost per tool. Because isolation tools, such as plugs, are used in vast numbers, and are generally not reusable, a small cost savings per tool results in enormous annual capital cost savings.

A synergistic effect is realized because a smaller tool means faster drilling time is easily achieved. Again, even a small savings in drill-through time per single tool results in an enormous savings on an annual basis.

Advantageously, the configuration of components, and the resilient barrier formed by way of the composite member results in a tool that can withstand significantly higher pressures. The ability to handle higher wellbore pressure results in operators being able to drill deeper and longer wellbores, as well as greater frac fluid pressure. The ability to have a longer wellbore and increased reservoir fracture results in significantly greater production.

As the tool may be smaller (shorter), the tool may navigate shorter radius bends in well tubulars without hanging up and presetting. Passage through shorter tool has lower hydraulic resistance and can therefore accommodate higher fluid flow rates at lower pressure drop. The tool may accommodate a larger pressure spike (ball spike) when the ball seats.

The composite member may beneficially inflate or umbrella, which aids in run-in during pump down, thus reducing the required pump down fluid volume. This constitutes a savings of water and reduces the costs associated with treating/disposing recovered fluids.

One piece slips assembly are resistant to preset due to axial and radial impact allowing for faster pump down speed. This further reduces the amount of time/water required to complete frac operations.

Advantages of using a fingered member as described herein may provide for higher differential pressure capability, smaller patch ID, shorter tool length, lower tool cost, and easier/faster drillability.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The inclusion or discussion of a reference is not an admission that it is prior art to the present invention, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool comprising:
a mandrel made of composite material;
a fingered member disposed around the mandrel;
a first conical member also disposed around the mandrel; and
an insert positioned proximate to the fingered member and the first conical member, and in engagement with an end of the fingered member,
wherein the insert comprises a circular body, a first end, a second end, and a helical wound groove formed in the circular body between the first end and the second end, and
wherein the fingered member comprises a plurality of fingers.

2. The downhole tool of claim 1, the tool further comprising:
a first slip;
a second slip;
a bearing plate;
a second conical member;
a sealing element; and
a lower sleeve threadingly engaged with the mandrel.

3. The downhole tool of claim 2, wherein at least one of the first slip and the second slip further comprise: a metal slip configured with a one-piece circular slip body comprising at least one longitudinal hole.

4. The downhole tool of claims 1, wherein one or more components of the tool are made from a material comprising one or more of filament wound material, fiberglass cloth wound material, and molded fiberglass composite.

5. The downhole tool of claim 1, wherein one or more ends of the plurality of fingers comprises an outer tapered surface.

6. The downhole tool of claim 1, wherein one or more of the plurality of fingers comprises an outer surface, and an inner surface, and wherein a first finger groove is disposed within the outer surface, and wherein a second finger groove is disposed within the inner surface.

7. The downhole tool of claim 1, the mandrel further comprising:
a distal end having a first outer diameter;
a proximate end having a second outer diameter; and
an outer surface,
wherein the outer surface at the distal end is configured with a set of threads.

8. A downhole tool comprising:
a mandrel made of composite material;
a fingered member disposed around the mandrel; and
a first conical member also disposed around the mandrel and proximate to an end of the fingered member,
an insert positioned proximate to the fingered member and the first conical member,
wherein the insert comprises a circular body, a first end, a second end, and a helical wound groove formed in the circular body between the first end and the second end, and
wherein the fingered member comprises a plurality of fingers.

9. The downhole tool of claim 8, the tool further comprising:
a first slip;
a second slip;
a bearing plate;
a second conical member;
a sealing element; and
a lower sleeve threadingly engaged with the mandrel.

10. The downhole tool of claim 9, wherein one or more ends of the plurality of fingers comprises an outer tapered surface, and wherein at least one of the first slip and the second slip further comprise: a metal slip configured with a one-piece circular slip body comprising at least one longitudinal hole.

11. The downhole tool of claim 10, wherein the fingered member comprises an outer surface, and an inner surface, and wherein a first groove is disposed within the outer surface, and wherein a second groove is disposed within the inner surface.

12. The downhole tool of claim 10, wherein one or more components of the tool are made from a material comprising one or more of filament wound material, fiberglass cloth wound material, and molded fiberglass composite, wherein the mandrel further comprises: a distal end having a first outer diameter; a proximate end having a second outer diameter; and an outer surface, and wherein the outer surface at the distal end is configured with a set of threads.

13. A method for performing a downhole operation in a tubular, the method comprising:
running a downhole tool through a first portion of the tubular, wherein the downhole tool comprises:
a mandrel comprising one or more sets of threads;
a fingered member disposed around the mandrel;
a first conical shaped member also disposed around the mandrel; and
an insert positioned proximate to the fingered member and the first conical shaped member,
wherein the fingered member comprises a plurality of fingers configured to move from an initial position to a set position, and wherein the insert comprises a circular body, a first end, a second end, and a helical winding groove formed in the circular body between the first end and the second end;
continuing to run the downhole tool until arriving at a position within a second portion of the tubular; and
setting the downhole tool within the second portion,
wherein the first portion comprises a first inner diameter that is smaller than a second inner diameter of the second portion.

14. The method of claim 13, wherein the insert is made of polyether ether ketone.

15. The method of claim 13, wherein the downhole tool further comprises:
a first slip;
a second slip;
a bearing plate;
a second conical member;
a sealing element; and
a lower sleeve threadingly engaged with the mandrel.

16. The method of claim 15, wherein the fingered member comprises an outer surface, and an inner surface, and wherein a first groove is disposed within the outer surface, and wherein a second groove is disposed within the inner surface.

17. The method of claim 16, wherein one or more components of the tool are made from a material comprising one or more of filament wound material, fiberglass cloth wound material, and molded fiberglass composite.

18. The method of claim 13, wherein the insert comprises an outer surface and an inner surface, and wherein a depth of the helical winding groove extends between the outer surface and the inner surface.

19. A method of using a downhole tool in a tubular, the method comprising:

running the downhole tool through a restriction in a first portion of the tubular, wherein the downhole tool comprises:

a mandrel made of composite material;

a fingered member disposed around the mandrel;

a conical member also disposed around the mandrel;

an insert positioned proximate to the fingered member and the first conical shaped member; and a metal slip disposed around the mandrel, the metal slip configured with a one-piece circular slip body;

wherein the fingered member comprises a plurality of fingers configured to move from an initial position to a set position, and wherein the insert comprises a circular body, a first end, a second end, and a helical winding groove formed in the circular body between the first end and the second end;

continuing to run the downhole tool until arriving past the restriction at a position within a second portion of the tubular; and setting the downhole tool within the second portion, wherein the restriction comprises a first inner diameter that is smaller than a second inner diameter of the first portion of the tubular.

20. The method of claim 19, wherein the mandrel further comprises: a distal end having a first outer diameter; a proximate end having a second outer diameter; and an outer surface, wherein the second outer diameter is larger than the first outer diameter.

* * * * *